United States Patent [19]

Kato et al.

[11] Patent Number: 5,064,737

[45] Date of Patent: Nov. 12, 1991

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 527,397

[22] Filed: May 23, 1990

[30] Foreign Application Priority Data

May 23, 1989 [JP] Japan ..... 1-127816
May 23, 1989 [JP] Japan ..... 1-127817

[51] Int. Cl.[5] ..... G03G 5/087
[52] U.S. Cl. ..... 430/96; 430/49
[58] Field of Search ..... 430/96, 49

[56] References Cited

U.S. PATENT DOCUMENTS 4,960,661 10/1990 Kato et al. ..... 430/96

*Primary Examiner*—David Welsh
*Assistant Examiner*—S. Rosasco
*Attorney, Agent, or Firm*—Sughrue, Mion, Zinn, Macpeak & Seas

[57] ABSTRACT

An electrophotographic light-sensitive material is disclosed. The material comprises a support having formed thereon a photoconductive layer containing at least inorganic photoconductive particles and a binder resin, wherein the binder resin comprises at least one kind of a resin (A) and at least one kind of a resin (B) as defined in the specification.

The electrophotographic light-sensitive material of the present invention has excellent electrostatic characteristics, moisture resistance and durability.

8 Claims, No Drawings

ELECTROPHOTOGRAPHIC LIGHT-SENSITIVE MATERIAL

FIELD OF THE INVENTION

This invention relates to an electrophotographic light-sensitive material, and more particularly to an electrophotographic light-sensitive material having excellent electrostatic characteristics, moisture resistance, and durability.

BACKGROUND OF THE INVENTION

An electrophotographic light-sensitive material may have various structures depending upon the characteristics required or an electrophotographic process being employed.

An electrophotographic system in which the light-sensitive material comprises a support having thereon at least one photoconductive layer and, if necessary, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if necessary, transfer.

Furthermore, a process of using an electrophotographic light-sensitive material as an offset master plate for direct plate making is widely practiced.

A binder which is used for forming the photoconductive layer of an electrophotographic light-sensitive material is required to be excellent in the film-forming property by itself and the capability of dispersing therein a photoconductive powder as well as the photoconductive layer formed using the binder is required to have satisfactory adhesion to a base material or support. Also, the photoconductive layer formed by using the binder is required to have various excellent electrostatic characteristics such as high charging capacity, less dark decay, large light decay, and less fatigue before light-exposure and also have an excellent photographing property that the photoconductive layer stably maintaining these electrostatic properties to the change of humidity at photographing.

Binder resins which have been conventionally used include silicone resins (e.g., JP-B-34-6670, the term "JP-B" as used herein means an "examined published Japanese patent publication"), styrene-butadiene resins (e.g., JP-B-35-1960), alkyd resins, maleic acid resins, polyamides (e.g., JP-B-35-11219), polyvinyl acetate resins (e.g., JP-B-41-2425), vinyl acetate copolymers (e.g., JP-B-41-2426), acrylic resins (JP-B-35-11216), acrylic acid ester copolymers (e.g., JP-B-35-11219, JP-B-36-8510, and JP-B-41-13946), etc.

However, in the electrophotographic light-sensitive materials using these binder resins, there are various problems such as 1) the affinity of the binder with a photoconductive powder is poor whereby the dispersibility of the coating composition containing these binder resins decreases, 2) the charging property of the photoconductive layer containing the binder is low, 3) the quality (in particular, the dot image reproducibility and resolving power) of the imaged portions of copied images is poor, 4) the image quality is liable to be influenced by the environmental conditions (e.g., high temperature and high humidity or low temperature and low humidity) at the formation of copies, and 5) the photoconductive layer is insufficient in film strength and adhesion and, thus, when the light-sensitive material is used for an offset master, peeling of the photoconductive layer, etc. occurs at offset printing whereby the number of prints decreases.

For improving the electrostatic characteristics of a photoconductive layer, various approaches have hitherto been taken. For example, incorporation of a compound having an aromatic ring or a furan ring containing a carboxy group or a nitro group either alone or in combination with a dicarboxylic anhydride in a photoconductive layer is disclosed in JP-B-42-6878 and JP-B-45-3073. However, the thus improved electrophotographic graphic light-sensitive materials are still insufficient in electrostatic characteristics and, in particular, light-sensitive materials having excellent light decay characteristics have not yet been obtained. Thus, for compensating the insufficient sensitivity of these light-sensitive materials, an attempt to incorporate a large amount of a sensitizing dye in the photoconductive layer has been made. However, light-sensitive materials containing a large amount of a sensitizing dye undergo considerable deterioration of whiteness thereby reducing the quality as a recording medium, sometimes causing deterioration in dark decay characteristics, whereby satisfactory reproduced images canno be obtained.

On the other hand, JP-A-60-10254 (the term "JP-A" as used herein means an "unexamined published Japanese patent application") discloses a method of using a binder resin for a photoconductive layer by controlling the average molecular weight of the resin. That is, this reference discloses a technique of improving the electrostatic characteristics (in particular, reproducibility at repeated use as a PPC light-sensitive material), humidity resistance, etc., of the photoconductive layer by using an acrylic resin having an acid value of from 4 to 50 and an average molecular weight of from $1\times10^3$ to $1\times10^4$ and the acrylic resin having an average molecular weight of from $1\times10^4$ to $2\times10^5$.

Furthermore, lithographic printing master plates using electrophotographic light-sensitive materials have been extensively investigated and, as binder resins for a photoconductive layer having both the electrostatic characteristics as an electrophotographic light-sensitive material and the printing characteristics as a printing master plate, there are, for example, a combination of a resin having a molecular weight of from $1.8\times10^4$ to $10\times10^4$ and a glass transition point (Tg) of from 10° to 80° C. obtained by copolymerizing a (methacrylate monomer and other monomer in the presence of fumaric acid and a copolymer composed of a (methacrylate monomer and a copolymerizable monomer other than fumaric acid as disclosed in JP-B-50-31011, a terpolymer containing a (meth)acrylic acid ester unit with a substituent having a carboxylic acid group at least 7 atoms apart from the ester linkage as disclosed in JP-A-53-54027, a tetra- or pentapolymer containing an acrylic acid unit and a hydroxyethyl (meth)acrylate unit as disclosed in JP-A-54-20735 and JP-A-57-202544, and a terpolymer containing a (meth)acrylic acid unit with an alkyl group having from 6 to 12 carbon atoms as a substituent and a vinyl monomer containing a carboxylic acid as disclosed in JP-A-58-68046. These resins are disclosed as being effective for improving the oil-desensitization of the photoconductive layer.

However, none of these resins proposed have proved to be satisfactory for practical use in charging property, dark charge retention, electrostatic characteristics for photosensitivity, and the surface smoothness of the photoconductive layer.

Also, the practical evaluations on conventional binder resins which are said to be developed for electrophotographic lithographic master plates have found that they have problems in the aforesaid electrostatic characteristics, background staining of prints, etc.

For solving these problems, JP-A-63-217354 describes that the smoothness and the electrostatic characteristics of a photoconductive layer can be improved and images having no background staining are obtained by using a low-molecular weight resin (molecular weight of from 1,000 to 10,000) containing from 0.05 to 10% by weight a copolymer component having an acid group at the side chain of the copolymer as the binder resin, and also Japanese Patent Application 63-49817 and JP-A-63-220148 and JP-A-63-220149 described that the film strength of a photoconductive layer can be sufficiently increased to improve the printing impression without reducing the aforesaid characteristics by using the aforesaid low-molecular resin in a combination with a high-molecular resin (molecular weight of larger than 10,000).

However, it has been found that even in the case of using these resins, it is yet insufficient to keep the stable performance in the case of greatly changing the environmental condition from high-temperature and high-humidity to a low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

SUMMARY OF THE INVENTION

The invention has been made for solving the problems of conventional electrophotographic light-sensitive materials as described above and meeting the requirement for the light-sensitive materials.

An object of this invention is to provide an electrophotographic light-sensitive material having stable and excellent electrostatic characteristics and giving clear good images even when the environmental conditions at the formation of duplicated images are changed to a low-temperature and low-humidity or to high-temperature and high-humidity.

Another object of this invention is to provide a CPC electrophotographic light-sensitive material having excellent electrostatic characteristics and showing less environmental dependency.

A further object of this invention is to provide an electrophotographic light-sensitive material effective for a scanning exposure system using a semiconductor laser beam.

A still further object of this invention is to provide an electrophotographic lithographic printing master plate having excellent electrostatic characteristics (in particular, dark charge retentivity and photosensitivity), capable of reproducing faithful duplicated images to original, forming neither overall background stains nor dotted background stains of prints, and showing excellent printing durability.

It has now been discovered that the aforesaid objects can be attained by the present invention as described hereinbelow.

That is, according to this invention, there is provided an electrophotographic light-sensitive material comprising a support having formed thereon a photoconductive layer containing at least inorganic photoconductive particles and a binder resin, wherein the binder resin comprises at least one kind of a resin (A) shown below and at least one kind of a resin (B) shown below:

Resin (A):

A copolymer having a weight average molecular weight of from $1.0\times10^3$ to $2.0\times10^4$ containing at least one of polyester type macromonomers each having a weight average molecular weight of from $1.0\times10^3$ to $1.5\times10^4$ represented by following formula (I), (II), (III), or (IV);

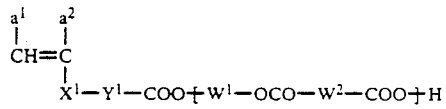

(I)

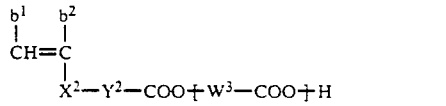

(II)

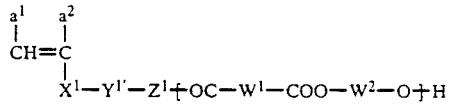

(III)

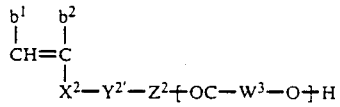

(IV)

wherein the bracketed group each represents a recurring unit; $a^1$ and $a^2$, which may be the same or different, each represents a hydrogen atom, a halogen atom, a cyano group, a hydrocarbon group having from 1 to 8 carbon atoms, —COOZ, or —COOZ bonded via a hydrocarbon group having from 1 to 8 carbon atoms (wherein Z represent a hydrocarbon group having from 1 to 18 carbon atoms); $X^1$ represents a direct bond or, —COO—, —OCO—, $\text{-}(CH_2)_{l_1}COO\text{-}$, $\text{-}(CH_2)_{l_2}\text{-}OCO\text{-}$ (wherein $l_1$ and $l_2$ each represents an integer of from 1 to 3),

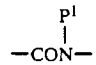

(wherein $p^1$ represents a hydrogen atom or a hydrocarbon group having from 1 to 12 carbon atoms), —CONHCONH—, —CONHCOO—, —O—,

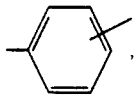

, or $—SO_2—$; $Y^1$ represents a group bonding $X^1$ to —COO—; $Y^2$ represents a group bonding $X^2$ to —COO—; $Y^{1'}$ represents a group bonding $X^1$ to $Z^1$; $Y^{2'}$ represents a group bonding $X^2$ to $Z^2$; $Z^1$ represents $—CH_2—$, —O—, or —NH—; $W^1$ and $W^2$, which may be the same or different, each represents a divalent aliphatic group, a divalent aromatic group (each group may have at least one bonding group selected from —O—, —S—,

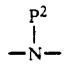

(wherein $P^2$ represents a hydrogen atom or a hydrocarbon group having from 1 to 12 carbon atoms), $—SO_2—$, —COO—, —OCO—, —CONHCO—, —NHCONH—,

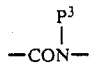

(wherein $P^3$ has the same meaning as $P^2$),

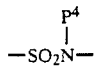

(wherein $P^4$ has the same meaning as $P^2$), and

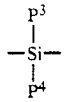

(wherein $p^3$ and $P^4$ are as defined above) in the bond of the divalent organic residue thereof); $b^1$ and $b^2$ have the same meaning as $a^1$ and $a^2$; $X^2$ has the same meaning as $X^1$; and $W^3$ represents a divalent aliphatic group;

Resin (B)

A resin which is a copolymer comprising (1) at least a mono-functional macromonomer having a weight average molecular weight of not more than $2\times10^4$, containing at least one of the polymer components shown by following formulae (VIa) and (VIb), and having a polymerizable double bond group represented by following formula (V) bonded to only one terminal of the polymer main chain thereof, and (2) a monomer represented by following formula (VII);

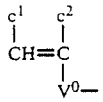

(V)

wherein $V^0$ represents —COO—, —OCO—, $—CH_2OCO—$, $—CH_2COO—$, —O—, $—SO_2—$, —CO—, —CONHCOO—, —CONHCONH—, $—CONHSO_2—$,

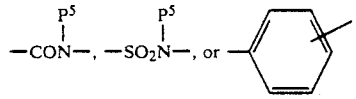

(wherein $P^5$ represents a hydrogen atom or a hydrocarbon group) and $c^1$ and $c^2$, which may be the same or different, each represents a hydrogen atom, a halogen atom, a cyano group, a hydrocarbon group, —COOZ', or —COOZ' bonded through a hydrocarbon group (wherein Z' represents a hydrogen atom or a hydrocarbon group which may be substituted);

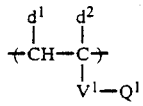

(VIa)

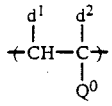

(VIb)

wherein $V^1$ has the same meaning as $V^0$ in formula (V) described above; $Q^1$ represents an aliphatic group having from 1 to 18 carbon atoms or an aromatic group having from 6 to 12 carbon atoms; $d^1$ and $d^2$, which may be the same or different, have the same meaning as $c^1$ and $c^2$ in formula (V); and $Q^0$ represents —CN, $—CONH_2$, or

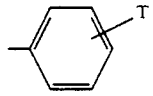

(wherein T represents a hydrogen atom, a hydrocarbon group, an alkoxy group, or —COOZ'' (Z'' represents an alkyl group, an aralkyl group, or an aryl group));

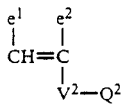

(VII)

wherein $V^2$ has the same meaning as $V^1$ in formula (VIa); $Q^2$ has the same meaning as $Q^1$ in formula (VIa), and $e^1$ and $e^2$, which may be the same or different, have the same meaning as $c^1$ and $c^2$ in formula (V).

DETAILED DESCRIPTION OF THE INVENTION

Then, the present invention is described hereinafter in detail.

The binder resin for use in this invention is composed of the graft-type copolymer (A) having a low molecular weight containing, as a copolymer component, a polyester type macromonomer containing a polymerizable double bond bonded to one terminal thereof and a carboxyl or hydroxyl group bonded to other terminal thereof (hereinafter sometimes referred to as (MA)), and the resin (B) composed of a graft-type polymer containing (1) at least one kind of a mono-functional macromonomer (hereinafter sometimes referred to as (MB)) having a polymerizable double bond group represented by the aforesaid formula (V) bonded to only one terminal of a polymer main chain containing at least a polymer component shown by the aforesaid formula (VIa) or (VIb) and (2) at least one kind of a monomer represented by the aforesaid formula (VII).

The graft-type copolymer which is used for the resin (A) in this invention may have at least one polar group selected from $—PO_3H_2$, $—SO_3H$, —COOH, —OH, and

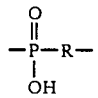

(wherein R represents a hydrocarbon group or —$OR^0$ (wherein $R^0$ represents a hydrocarbon group)) (hereinafter, the resin (A) having the polar group is sometimes referred to as resin (A')).

The conventionally known acid group-containing binder resins as described hereinbefore are mainly for offset master plates and hence have a large molecular weight (e.g., larger than $5\times10^4$) for improving the printing durability by keeping a high film strength. Also, these binder resins are random copolymers wherein the acid group-containing copolymer components randomly exist in the polymer main chain.

On the other hand, the resin (A) which is used for the binder resin in this invention is a graft-type copolymer and, in the copolymer, the acid group or hydroxy group and an optional polar group, if any, contained in the copolymer exists only at the terminal of the graft-portion or exist only at the terminal portion of the graft portion and the terminal of the polymer main chain.

Accordingly, it is assumed that the acid group or hydroxy group existing at a specific position apart from the main chain of the copolymer adsorbs onto the stoichiometric defect of an inorganic photoconductor and the main portion of the polymer mildly and sufficiently cover or coat the surface of the photoconductor. Thus, it has been confirmed that the electron trap of the photoconductor is compensated, the humidity resistance is improved, the photoconductive particles are sufficiently dispersed to inhibit the aggregation of the photoconductive particles, and also stable electrophotographic characteristics having a high performance can be maintained even when environmental conditions are greatly changed from high temperature and high humidity to low temperature and low humidity. Also, the resin (B) sufficiently increases the mechanical strength of the photoconductive layer, which is insufficient in the case of using the resin (A) alone, without reducing the high performance of the aforesaid electrophotographic characteristics by the use of the resin (A). The resin (B) is particularly effective in the case of using a scanning exposure system using a semiconductor laser.

Also, in this invention, the surface of the photoconductive layer becomes smooth. If an electrophotographic light-sensitive material having a rough photoconductive layer surface is used as a lithographic printing master place in electrophotographic system, the photoconductive layer formed is in a state that the photoconductive particles such as zinc oxide particles are inappropriately dispersed in the binder resin and, thus, aggregates of the photoconductive particles exist therein, thereby the non-imaged portions are not sufficiently rendered hydrophilic when the surface of the photoconductive layer is subjected to an oil-desensitization treatment with an oil-desensitizing solution to cause sticking of printing ink at printing using the printing plate thus made, which results in causing background staining of the non-imaged portions of prints.

Furthermore, it has been found that the graft-type copolymer for use in this invention shows good light sensitivity as compared to a random copolymer resin having a polar group not at the terminal of the graft portion but at a side chain linked to the polymer main chain.

Since a spectral sensitizing dye which is usually used for giving light sensitivity in the region of from visible light to infrared light sufficiently functions its spectral sensitizing action by adsorbing onto photoconductive particles, it is assumed that the binder resin for use in this invention properly interacts with photoconductive particles without hindering the adsorption of spectral sensitizing dyes onto the photoconductive particles. This action is particularly effective in a cyanine dye or a phthalocyanine-series pigment which is particularly effective as a spectral sensitizing dye for sensitizing the region of from near infrared to infrared.

When the low molecular weight resin (A) for use in this invention is singly used as a binder resin, the binder resin can sufficiently adsorb onto photoconductive particles and coat the surface of the particles, whereby the photoconductive layer has good surface smoothness and electrostatic characteristics and gives good images having no background stains as well as a sufficient film strength as a CPC light-sensitive material or an offset printing plate capable of giving several thousands prints is kept. However, when the resin (B) is used together with the resin (A) as in this invention, the mechanical strength of the photoconductive layer, which is yet insufficient by the use of the resin (A) alone can be further improved without reducing the aforesaid function of the resin (A).

Accordingly, the electrophotographic light-sensitive material of this invention shows excellent electrostatic characteristics even when the environmental condition is changed and also has a sufficiently high film strength, whereby the offset printing master plate made from the electrophotographic light-sensitive material of this invention can give 6,000 or more prints under severe printing condition (e.g., in the case of using large-sized printing machine with a high printing pressure).

Furthermore, it is preferred that the resin (B) has at least one polar group selected from —$PO_3H_2$, —COOH, OH, —SH, and

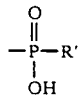

(wherein R' represents a hydrocarbon group or —$OR^0$ (wherein $R^0$ represents a hydrocarbon group) as R described above) at only one terminal of the comb-form copolymer main chain (hereinafter, the resin (B) having the polar group is, sometimes, referred to as resin (B')).

When the resin (B') is used, the electrostatic characteristics, in particular, D.R.R. (dark decay retentivity) and $E_{1/10}$ are more improved without reducing the excellent characteristics by the use of the resin (A) and the effects thereof are substantially not varied by the change of environmental condition such as the change of high temperature and high humidity to low temperature and low humidity. Furthermore, by the use of the resin (B'), the film strength of the photoconductive layer is increased whereby the printing durability can be improved.

In the resin (A), the weight average molecular weight of the graft-type copolymer is from $1\times10^3$ to $2\times10^4$, and preferably from $3\times10^3$ to $1\times10^4$ and the content of the copolymer component of the macromonomer (MA)

is from 1 to 80% by weight, and preferably from 5 to 70% by weight. Also, when the copolymer has a polar group at the terminal of the copolymer main chain, the content of the polar group in the copolymer is from 0.5 to 15% by weight, and preferably from 1 to 10% by weight.

Also, the glass transition point of the resin (A) is preferably from −20° C. to 120° C., and more preferably from −10° C. to 90° C.

If the molecular weight of the resin (A) is lower than $1\times10^3$, the film-forming property is reduced and a sufficient film strength can not be obtained. On the other hand, if the molecular weight thereof is larger than $2\times10^4$, the electrophotographic characteristics (in particular, initial potential and dark decay retentivity) are undesirably reduced. In particular, when the content of the polar groups exceeds 3% by weight in the case of the resin having such a higher molecular weight, the electrostatic characteristics are greatly reduced and when the electrophotographic light-sensitive material is used as an offset master plate, the occurrence of background stains become severe.

If the content of the polar groups (the carboxy group (—COOH) or the hydroxy group (—OH) at the graft terminal and an optional main chain terminal polar group) is less than 0.5% by weight, the initial potential is too low to obtain a sufficient image density. On the other hand, if the content of the polar groups is more than 15% by weight, the dispersibility of the binder resin for photoconductive particles is reduced to reduce the surface smoothness of the photoconductive layer and the high-humidity characteristics of the electrophotographic characteristics and, furthermore, when the electrophotographic light-sensitive material is used as an offset master plate after processing, the occurrence of background stain is increased.

Then, the macromonomer (MA) having such a polyester structure that a polymerizable double bond group is bonded at one terminal thereof and a carboxy group or a hydroxy group at the other terminal, which is used as a copolymer component of the graft-type copolymer resin in this invention, is described hereinafter in more detail.

In the formulae (I) to (IV) described above, the bracketed group represents a sufficient recurring unit for giving a weight average molecular weight of from $1\times10^3$ to $1.5\times10^4$ to the macromonomer (MA).

In the macromonomers shown by the formulae (I) and (III) described above, $a^1$ and $a^2$, which may be the same or different, each represents preferably a hydrogen atom, a halogen atom (e.g., chlorine, bromine, and fluorine), a cyano group, an alkyl group having from 1 to 3 carbon atoms (e.g., methyl, ethyl, and propyl), —COOZ, or $—CH_2COOZ$ (wherein Z represents an alkyl group having from 1 to 8 carbon atoms (e.g., methyl, ethyl, propyl, butyl, pentyl, hexyl, and octyl), an aralkyl group having from 7 to 9 carbon atoms (e.g., benzyl, phenethyl, and 3-phenylpropyl), or a phenyl group which may be substituted (e.g., phenyl, tolyl, xylyl, and methoxyphenyl)).

More preferably, one of $a^1$ and $a^2$ represents a hydrogen atom.

$X^1$ in the formulae preferably represents a direct bond, —COO—, —OCO—, $—CH_2COO—$, $—CH_2OCO—$, —CONH—, —CONHCONH—, —CONHCOO—,

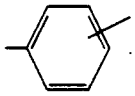

Also, $P^1$ represents a hydrogen atom or a hydrocarbon group having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, chlorobenzyl, methoxybenzyl, phenethyl, phenyl, tolyl, chlorophenyl, methoxyphenyl, and butylphenyl).

$Y^1$ represents a group linking $X^1$ and —COO— and $Y^{1'}$ represents a group linking $X^1$ and $Z^1$ and $Y^1$ and $Y^{1'}$ each is a direct bond or a linkage group. The linkage group is practically selected from

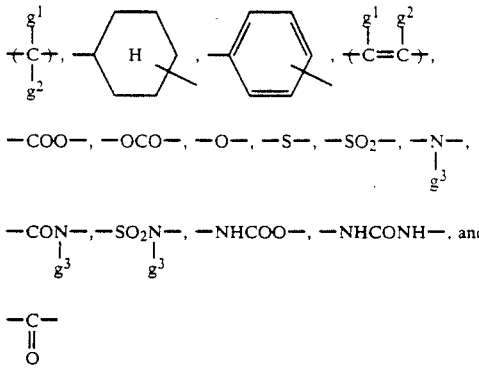

or is composed of a combination of these linkage groups (wherein $g^1$ and $g^2$, which may be the same or different, each represents a hydrogen atom, a halogen atom (e.g., preferably, fluorine, chlorine, and bromine), or a hydrocarbon group having from 1 to 7 carbon atoms (e.g., preferably, methyl, ethyl, propyl, butyl, 2-chloroethyl, 2-methoxyethyl, 2-methoxycarbonylethyl, benzyl, methoxybenzyl, phenyl, methoxyphenyl, and methoxycarbonylphenyl) and $g^3$ has the same meaning as $P^1$ described above).

Also, $w^1$ and $w^2$, which may be the same or different, each represents a divalent organic residue such as a divalent aliphatic group, a divalent aromatic group, or an organic residue composed of a combination of these divalent groups, each group or residue may have a bonding group selected from

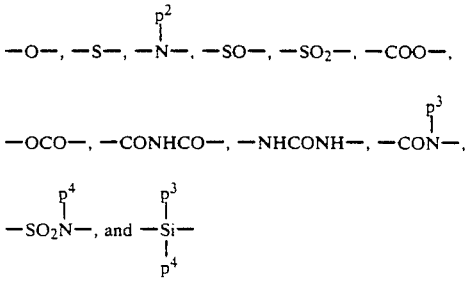

(wherein $P^2$, $P^3$, and $P^4$ each has the same meaning as $P^1$ described above).

Examples of the divalent aliphatic group include

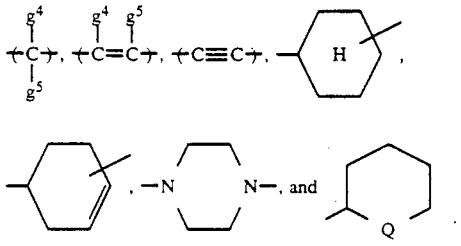

(wherein $g^4$ and $g^5$, which may be the same or different, each represents a hydrogen atom, a halogen atom (e.g., fluorine, chlorine, and bromine), or an alkyl group having from 1 to 12 carbon atoms (e.g., methyl, ethyl, propyl, chloromethyl, bromomethyl, butyl, hexyl, octyl, nonyl, and decyl); Q represents —O—, —S—, or —$NR^1$— (wherein $R^1$ represents an alkyl group having from 1 to 4 carbon atoms, —$CH_2Cl$ or —$CH_2Br$)).

Examples of the divalent aromatic group include a benzene ring group, and a 5- or 6-membered heterocyclic group wherein the hetero atom(s) constituting the heterocyclic ring are at least one hetero atom selected from oxygen, sulfur, and nitrogen. The aromatic group may have a substituent such as a halogen atom (e.g., fluorine, chlorine, and bromine), an alkyl group having from 1 to 8 carbon atoms (e.g., methyl, ethyl, propyl, butyl, hexyl, and octyl), and an alkoxy group having from 1 to 6 carbon atoms (e.g., methoxy, ethoxy, propoxy, and butoxy).

Examples of the heterocyclic group are furan, thiophene, pyridine, pyrazine, piperazine, tetrahydrofuran, pyrrole, tetrahydropyran, and 1,3-oxazoline.

In formulae (II) and (IV) described above, the preferred groups of $b^1$, $b^2$, $X^2$, $Y^2$, and $Y^{2'}$ are the same as the aforesaid preferred groups of $a^1$, $a^2$, $X^1$, $Y^1$, and $Y^{1'}$, respectively, in formulae (I) and (III).

In formulae (II) and (IV), $W^3$ represents a divalent aliphatic moiety such as, for example, —$CH_2)_n$ (wherein n represents an integer of from 2 to 18),

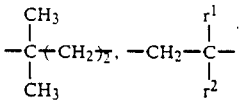

(wherein $r^1$ and $r^2$, which may be the same or different, each represents a hydrogen atom or an alkyl group having from 1 to 12 carbon atoms (e.g., methyl, ethyl, propyl, butyl, hexyl, octyl and decyl), with the proviso that $r^1$ and $r^2$ cannot represent hydrogen atoms as the same time),

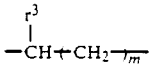

(wherein $r^3$ represents an alkyl group having from 1 to 12 carbon atoms and, more specifically, those described above for $r^1$ and $r^2$, and m represents an integer of from 3 to 18).

Specific examples of the moieties shown by

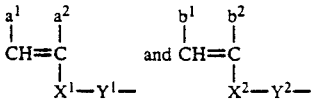

in the macromonomer shown by the formulae (I) and (II) are shown below although the invention is not limited thereto.

In the following formulae, a represents —H, —$CH_3$, —$CH_3COOCH_3$, —Cl, —Br, or —CN; b represents —H or —$CH_3$; h represents an integer of from 2 to 12; and i represents an integer of from 1 to 12.

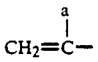

(A-1)

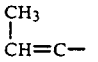

(A-2)

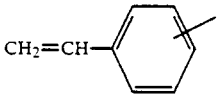

(A-3)

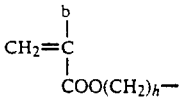

(A-4)

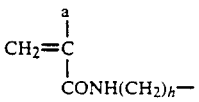

(A-5)

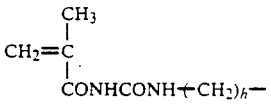

(A-6)

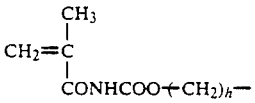

(A-7)

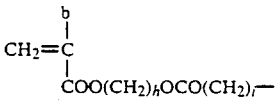

(A-8)

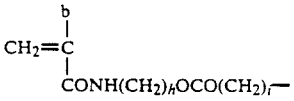

(A-9)

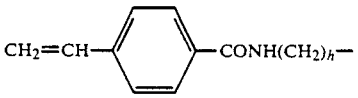

(A-10)

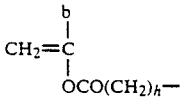

(A-11)

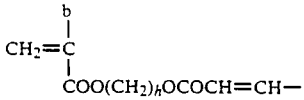

(A-12)

-continued (A-13)

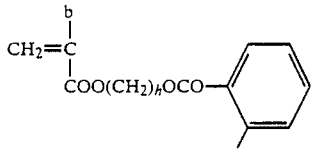

(A-14)

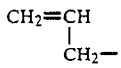

(A-15)

$CH_2{=}CH{-}CH_2CH_2{-}$ (A-16)

$CH_2{=}CH{-}CH_2{-}COO(CH_2)_hOCO(CH_2)_i{-}$ (A-17)

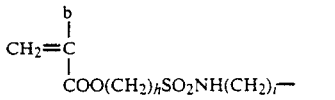

(A-18)

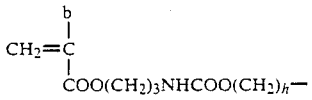

(A-19)

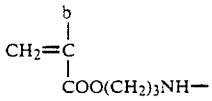

(A-20)

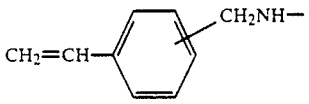

(A-21)

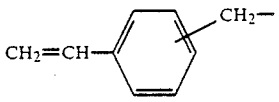

(A-22)

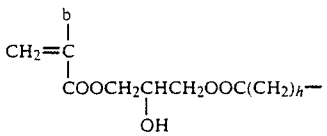

(A-23)

$CH_2{=}CH{-}CH_2OCO(CH_2)_h{-}$ (A-24)

$CH_2{=}CH{-}SO_2(CH_2)_h{-}$ (A-25)

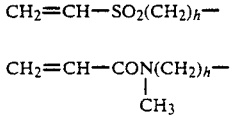

(A-26)

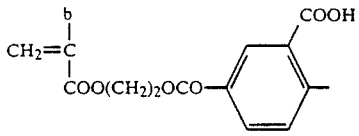

(A-27)

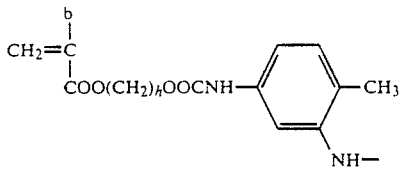

-continued (A-28)

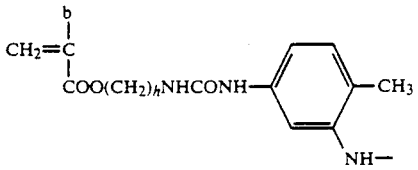

Specific examples of the moieties shown by

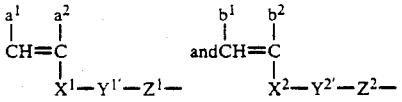

in the macromonomers shown by the formulae (III) and (IV) are shown below although the present invention is not limited thereto.

In the following formulae, a represents —H, —$CH_3$, —$CH_2COOCH_3$, —Cl, —Br, or —CN; b represents —H or —$CH_3$; X represents —Cl or —Br; h represents an integer of from 2 to 12; and i represents an integer of from 1 to 4.

(A-29)

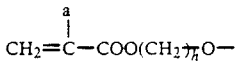

(A-30)

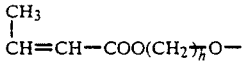

(A-31)

$CH_2{=}CH{-}$ (A-32)

$CH_2{=}CH{-}CH_2{-}$ (A-33)

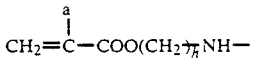

(A-34)

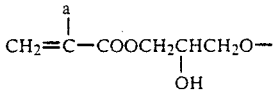

(A-35)

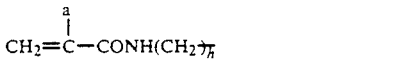

(A-36)

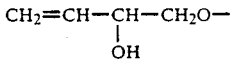

(A-37)

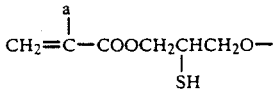

(A-38)

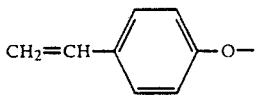

(A-39)

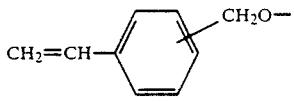

(A-40)

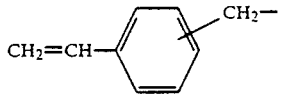

-continued (A-41)

$$CH_2{=}\overset{a}{\overset{|}{C}}{-}COO(CH_2)_n$$

(A-42)

$$CH_2{=}\overset{a}{\overset{|}{C}}{-}CONH(CH_2)_n$$

(A-43)

$$CH_2{=}\overset{b}{\overset{|}{C}}{-}CONHCOO(CH_2)_n$$

(A-44)

$$CH_2{=}\overset{b}{\overset{|}{C}}{-}CONHCONH(CH_2)_n$$

(A-45)

$$CH_2{=}CH{-}CH_2{-}COO(CH_2)_nO{-}$$

(A-46)

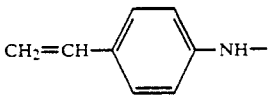

(A-47)

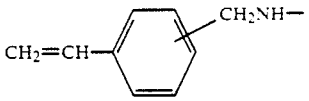

(A-48)

$$CH_2{=}\overset{b}{\overset{|}{C}}{-}COO\underset{\underset{CH_2CH_2X}{|}}{C}HO{-}$$

(A-49)

$$CH_2{=}\overset{b}{\overset{|}{C}}\underset{\underset{COO(CH_2)_3NHCOO(CH_2)_n}{|}}{}$$

(A-50)

$$CH_2{=}\overset{b}{\overset{|}{C}}{-}COO(CH_2CH_2O)_rCO(CH_2)_n$$

Specific examples of the organic residues shown by $w^1$ and $w^2$ in formulae (I) and (III) are illustrated below, but the present invention is not limited thereto.

In the following formulae, $R^1$ represents an alkyl group having from 1 to 4 carbon atoms, $-CH_2Cl$, or $-CH_2Br$; $R^2$ represents an alkyl group having from 1 to 8 carbon atoms, $(CH_2)_l OR_1$ (wherein $R_1$ is the same as described above and l represents an integer of from 2 to 8), $-CH_2Cl$, or $-CH_2Br$; $R_3$ represents $-H$ or $-CH_3$; $R_4$ represents an alkyl group having from 1 to 4 carbon atoms; Q represents $-O-$, $-S-$, or $-NR_1-$ (wherein $R_1$ is same as described above); p represents an integer of from 1 to 26; q represents an integer of from 1 to 4; r represents an integer of from 1 to 10; j represents an integer of from 0 to 4; and k represents an integer of from 2 to 6.

(B-1)

$$(CH_2)_p$$

(B-2)

$$-CH{=}CH-$$

(B-3)

$$-C{\equiv}C-$$

(B-4)

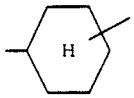

-continued (B-5)

$$-\overset{R_1}{\overset{|}{C}}H-$$

(B-6)

$$(\overset{R_1}{\overset{|}{C}}H{-}CH_2)_p$$

(B-7)

$$(\overset{R_2}{\overset{|}{C}}H{-}\overset{R_2}{\overset{|}{C}}H)$$

($R_2$ may be the same or different)

(B-8)

$$-CH_2{-}\underset{\underset{R_1}{|}}{\overset{R_1}{\overset{|}{C}}}{-}CH_2-$$

($R_1$ may be the same or different)

(B-9)

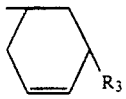

(B-10)

$$-\overset{R_4}{\overset{|}{C}}HCH_2(OCH_2CH_2)_qOCH_2\overset{R_4}{\overset{|}{C}}-$$

(B-11)

$$(CH_2CH_2OCH_2CH_2)_r(OCH_2CH_2)_j$$

(B-12)

$$(CH_2CH_2SCH_2CH_2)_r$$

(B-13)

$$(CH_2CH_2SCH_2CH_2OCH_2CH_2)_r$$

(B-14)

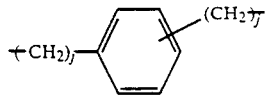

(B-15)

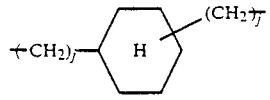

(B-16)

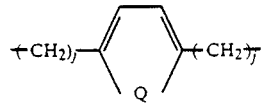

(B-17)

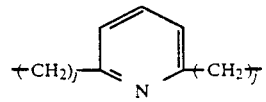

(B-18)

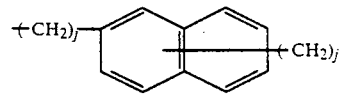

(B-19)

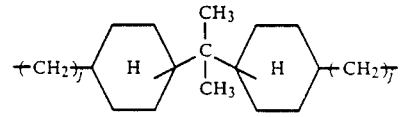

(B-20)

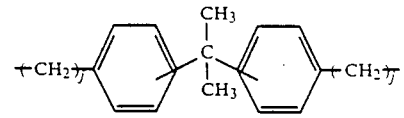

-continued (B-21)

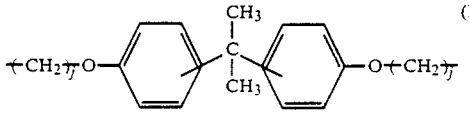

(B-22)

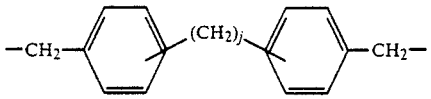

(B-23) $-CH_2-C\equiv C-CH_2-$ (B-24) $-CH_2-CH=CH-CH_2-$ (B-25) $-CH_2OCH_2CH_2-$ (B-26) $-CH_2CH_2CH_2OCH_2CH_2CH_2-$ (B-27) $\text{+}CH_2\text{+}_k SO_2\text{+}CH_2\text{+}_k$ (B-28) $\text{+}CH_2\text{+}_k S-S\text{+}CH_2\text{+}_k$ (B-29)

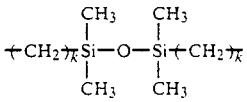

(B-30)

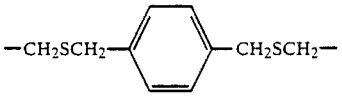

(B-31)

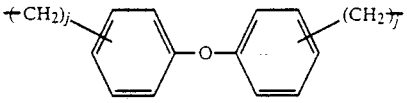

(B-32)

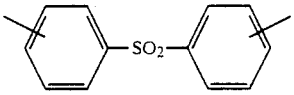

(B-33)

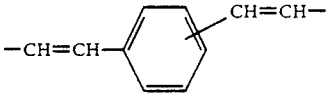

(B-34)

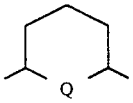

(B-35)

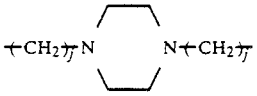

(B-36)

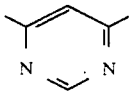

(B-37)

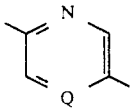

-continued (B-38)

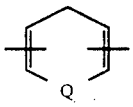

The macromonomer shown by formula (I) or (III) described above can be easily produced by a method of introducing a polymerizable double bond group into only the hydroxy group or carboxy group at one terminal of a polyester oligomer having a weight average molecular weight of from $1\times10^3$ to $1.5\times10^4$ by a macromolecular reaction, said polyester oligomer being synthesized by a polycondensation reaction of diol and a dicarboxylic acid, a dicarboxylic acid anhydride, or a dicarboxylic acid ester as described in *Kobunshi* (*Macromolecular*) *Data Handbook* (*Foundation*), edited by Kobunshi Gakkai, published by Baifukan, 1986.

The polyester can be synthesized by a conventionally known polycondensation reaction such as, practically, the methods described in Eiichiro Takiyama, *Polyester Resin Handbook*, published by Nikkan Kogyo Shinbun Sha, 1986; *Jushukugo to Jufuka* (*Polycondensation and Polyaddition*), edited by Kobunshi Gakkai, published by Kyoritsu Shuppan, 1980, and I. Goodman, *Encyclopedia of Polymer Science and Engineering*, Vol. 12, pl., published by John Wiley & Sons, 1985.

A polymerizable double bond group can be introduced into the hydroxy group only at one terminal of the polyester oligomer by using a method of esterifying an alcohol or a method of forming a urethane from an alcohol conventionally known in low molecular compounds.

That is, a method of esterifying an alcohol by a reaction thereof and a carboxylic acid, a carboxylic acid ester, a carboxylic acid halide or a carboxylic acid anhydride each having a polymerizable double bond group in the molecule or a method of forming a urethane of an alcohol by a reaction of the alcohol and a monoisocyanate having a polymerizable double bond group in the molecule can be used.

Practically, the methods described in *Shin·Jikken Kagaku Koza* (*New Experimental Chemistry Course*), 14, "Synthesis and Reaction of Organic Compounds (II)", Chapter 5, published by Maruzen K.K., 1977 and ibid., "Synthesis and Reaction of Organic Compounds (III)", page 1652, published by Maruzen K.K., 1978 can be used.

Also, a polymerizable double bond group can be introduced into the carboxy group only at one terminal of the polyester oligomer by a reaction of esterifying a carboxylic acid or a reaction of forming an acid amide from a carboxylic acid conventionally known in low molecular compounds.

That is, the macromonomer is synthesized by a macromolecular reaction between a compound having a polymerizable double bond group in the molecule and also having a functional group of causing a chemical reaction with a carboxylic acid (examples of the functional group are

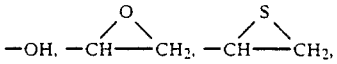

halides (e.g., chlorides, bromines, and iodides)) and the polyester oligomer.

Practically, the methods described in *Shin Jikken-Kagaku Koza* (*New Experimental Chemistry Course*), 14, "Synthesis and Reaction of Organic Compounds (II)", Chapter 5, published by Maruzen K.K., 1977 and Yoshio Iwakura and Keisuke Kurita, *Hanno Sei Kobunshi* (*Reactive Polymers*), published by Kodansha, 1977 can be used.

The macromonomer shown by formula (II) or (IV) can be produced by a method of synthesizing a polyester oligomer by a self polycondensation reaction of a carboxylic acid having a carboxy group or a hydroxy group in the molecule and then synthesizing the macromonomer from the oligomer by the same macromolecular reaction as the aforesaid synthesis of the macromonomer shown by formula (I) or (III), or a method of synthesizing the macromonomer by a living polymerization reaction of a carboxylic acid having a polymerizable double bond group and a lactone.

Practically, the methods described in T. Yasuda, T. Aido, and S. Inoue, *J. Macromol. Sci. Chem.*, A, 21, 1035(1984), T. Yasuda, T. Aida, and S. Inoue, *Macromolecules*, 17, 2217(1984), S. Sosnowski, S. Stomkowski, and P. Rempp., *Macromol. Chem.*, 188, 2267(1987), and T. Shiota and Y. Goto, *J. Appl. Polym. Sci.*, 11, 753(1967) can be used.

Then, practical examples of the macromonomer shown by formula (I) or (II) for use in this invention are illustrated below.

In the following formulae, the bracketed group represents a sufficient recurring unit for giving a weight average molecular weight of from $1\times10^3$ to $1.5\times10^4$ to the macromonomer; d represents —H or —$CH_3$; $R_5$ and $R_6$, which may be the same or different, each represents —$CH_3$ or —$C_2H_5$; $R_7$ and $R_8$, which may be the same or different, each represents —Cl, —Br, —$CH_2Cl$, or —$CH_2Br$; s represents an integer of from 1 to 25; t represents an integer of from 2 to 12; u represents an integer of from 2 to 12; x represents an integer of from 2 to 4; y represents an integer of from 2 to 6; and z represents an integer of from 1 to 4.

(MA-1)

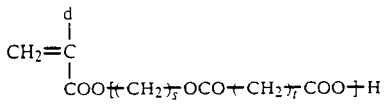

(MA-2)

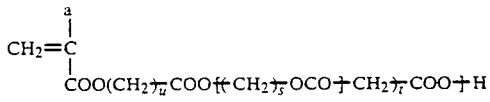

(MA-3)

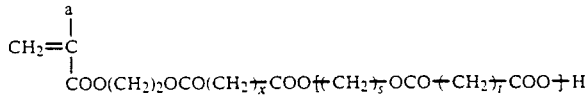

(MA-4)

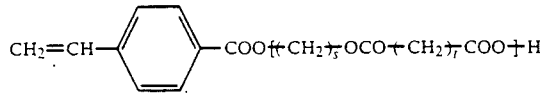

(MA-5)

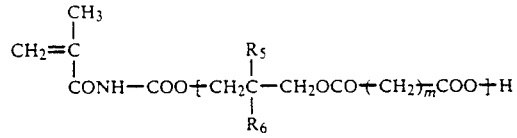

(MA-6)

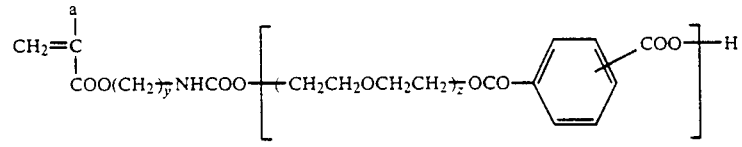

(MA-7)

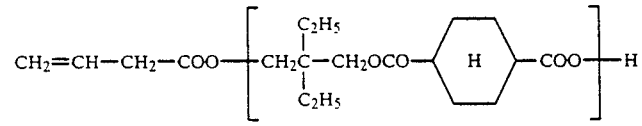

(MA-8)

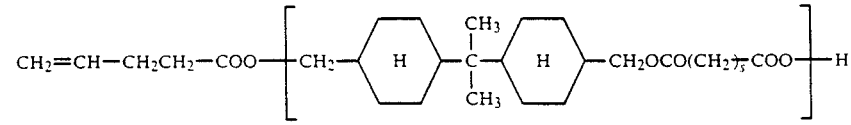

-continued
(MA-9)
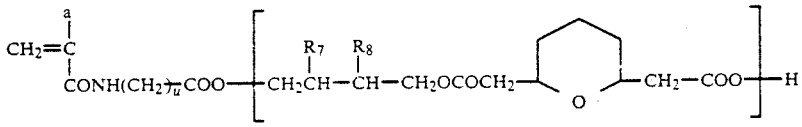
(MA-10)
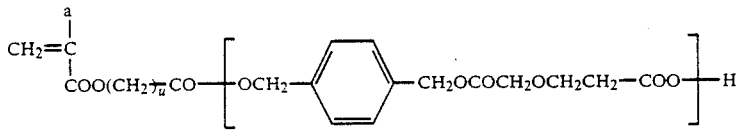
(MA-11)
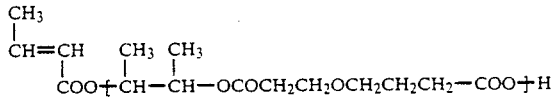
(MA-12)
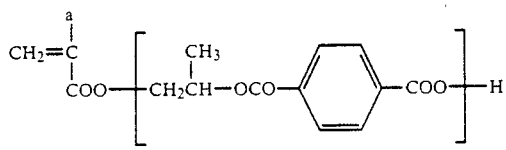
(MA-13)
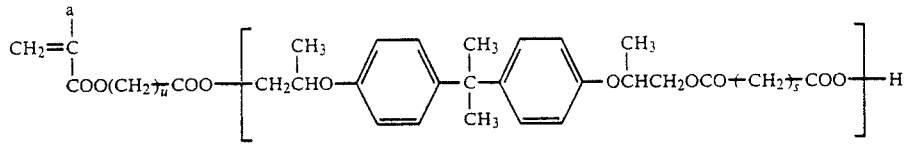
(MA-14)
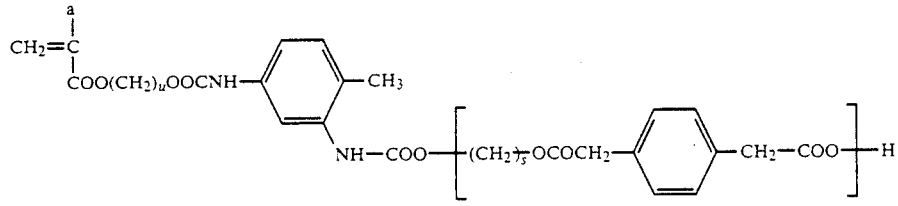
(MA-15)
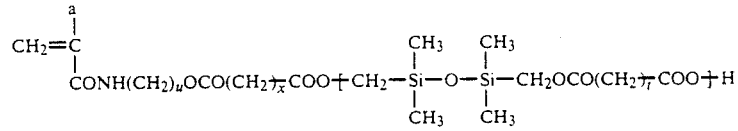
(MA-16)
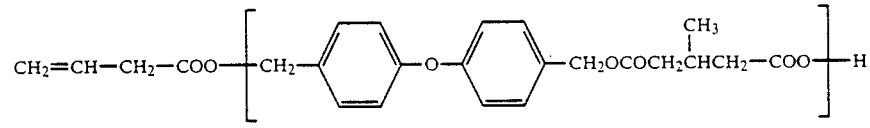
(MA-17)
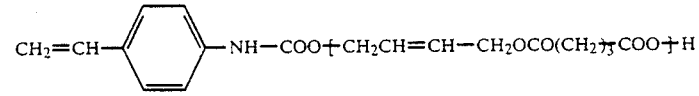
(MA-18)
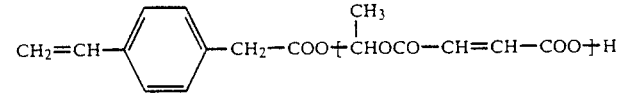
(MA-19)
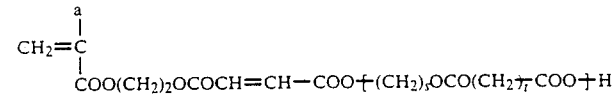

-continued (MA-20)

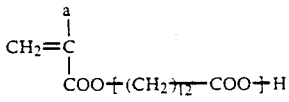

(MA-21)

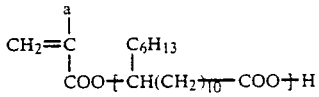

(MA-22)

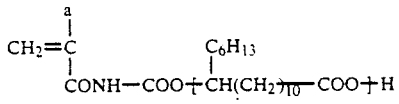

(MA-23)

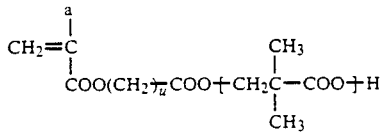

(MA-24)

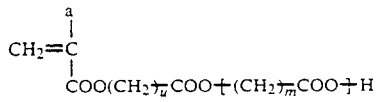

(MA-25)

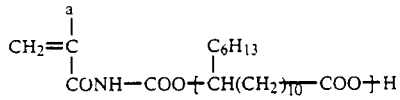

(MA-26)

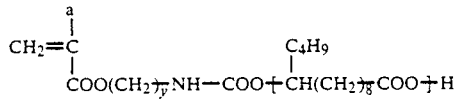

Furthermore, specific examples of the macromonomer shown by formula (III) or (IV) described above are illustrated below, but the present invention is not limited thereto.

In the following formula, the bracketed group represents a sufficient recurring unit for giving a weight average molecular weight of from $1\times10^3$ to $1.5\times10^4$ to the macromonomer; c represents —H or —$CH_3$; $R_5$ and $R_6$, which may be the same or different, each represents —$CH_3$ or —$C_2H_5$; $R_7$ represents —$CH_3$, —$C_2H_5$, —$C_3H_7$, or —$C_4H_9$; Y represents —Cl or Br; W represents —O— or —S—; s represents an integer of from 2 to 12; t represents an integer of from 1 to 25; u represents an integer of from 2 to 12; x represents an integer of from 2 to 16; y represents an integer of from 1 to 4; and z represents 0, 1, or 2.

(MA-27)

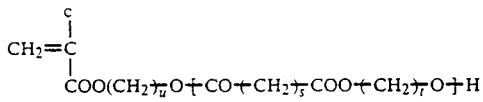

(MA-28)

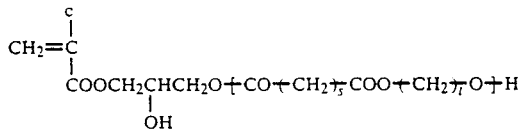

(MA-28)

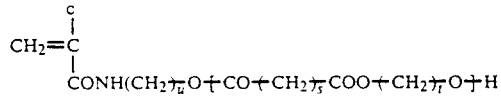

(MA-30)

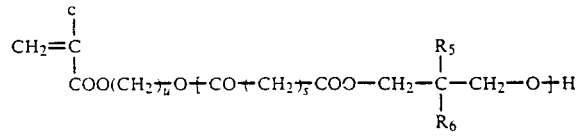

-continued
(MA-31)
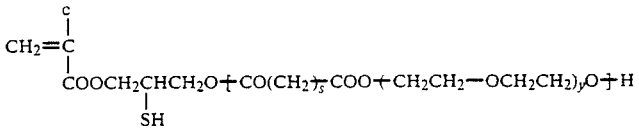
(MA-32)
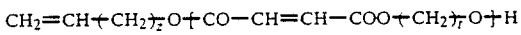
(MA-33)
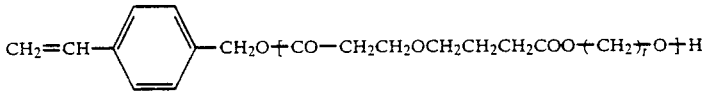
(MA-34)
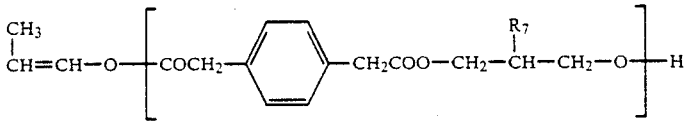
(MA-35)
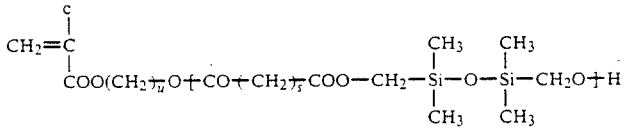
(MA-36)
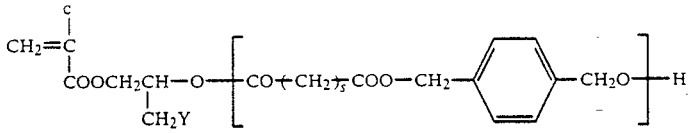
(MA-37)
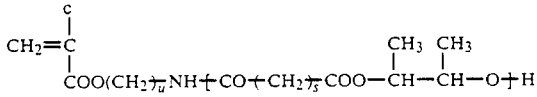
(MA-38)
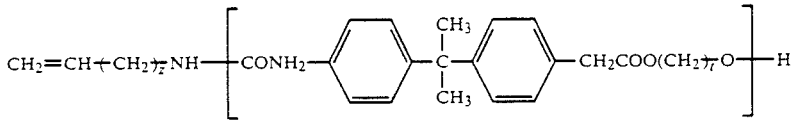
(MA-39)
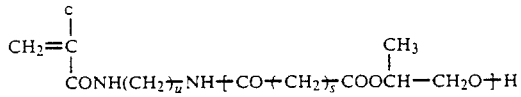
(MA-40)
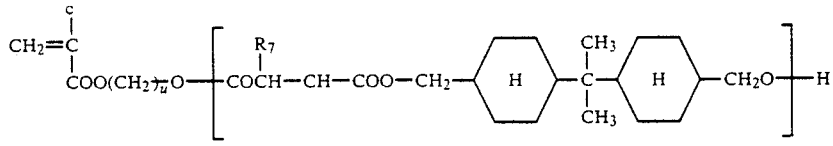
(MA-41)
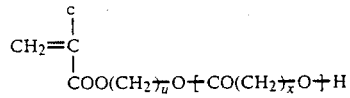
(MA-42)
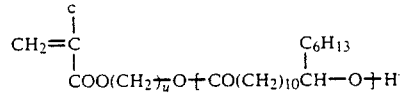
(MA-43)
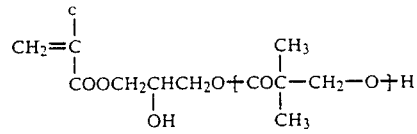

-continued (MA-44)

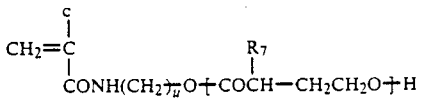

(MA-45)

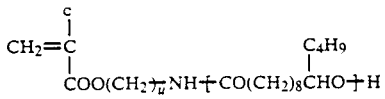

(MA-46)

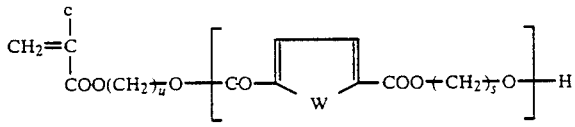

(MA-47)

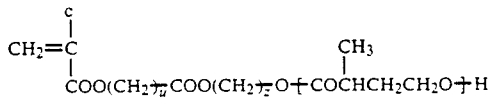

(MA-48)

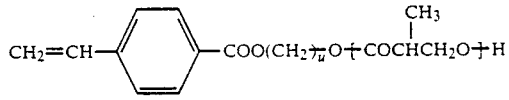

The resin (A) which is used for the binder resin in this invention is a graft copolymer having at least one of the macromonomers represented by the aforesaid formulae (I), (II), (III), and (IV) as a copolymer component and, as other copolymer component(s), any monomer(s) which meet the aforesaid properties required for the binder resin and can be radical-copolymerized with the aforesaid macromonomer can be used.

It is preferred that a monomer represented by following formula (VIII) is used as the other copolymer component in an amount of from 20 to 99% by weight, and preferably from 30 to 95% by weight of the copolymer.

(VIII)

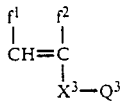

wherein $f^1$ and $f^2$ have the same meaning as $a^1$ and $a^2$ in formula (I) or (III) and represents preferably a hydrogen atom or a methyl group.

$X^3$ represents —COO—, —OCO—, or —O— and preferably represents —COO—.

$Q^3$ represents a hydrocarbon group having from 1 to 18 carbon atoms such as, preferably, an alkyl group having from 1 to 18 carbon atoms, which may be substituted, (e.g., methyl, ethyl, propyl, butyl, pentyl, hexyl, octyl, decyl, dodecyl, tridecyl, tetradecyl, 2-methoxyethyl, 2-ethoxyethyl, 2-hydroxyethyl, 3-hydroxypropyl, 2-hydroxypropyl, 2-chloroethyl, 2-cyanoethyl, 2-(N,N-dimethylamino)ethyl, 2,3-dihydroxypropyl, and 3-carbamoylopropyl), an aralkyl group having from 7 to 12 carbon atoms, which may be substituted (e.g., benzyl, phenethyl, methoxybenzyl, ethoxybenzyl, methylbenzyl, dimethylbenzyl, chlorobenzyl, dichlorobenzyl, dibromobenzyl, acetoxybenzyl, cyanobenzyl, naphthylmethyl, and 2-naphthylethyl), a cycloalkyl group having from 5 to 8 carbon atoms, which may be substituted (e.g., cyclopentyl, cyclohexyl, and cyclobutyl), or an aryl group which may be substituted (e.g., phenyl, tolyl, xylyl, mesityl, naphthyl, methoxyphenyl, ethoxyphenyl, chlorophenyl, dichlorophenyl, bromophenyl, dibromophenyl, chlorobromophenyl, acetoxyphenyl, acetylphenyl, chloromethylphenyl, bromomethylphenyl, cyanophenyl, and methoxycarbonylphenyl).

Furthermore, the resin (A) for use in this invention as the binder resin may further contain, as an additional copolymer component, other monomers together with the macromonomer(s) shown by the aforesaid formulae (I), (II), (III), and/or (IV) and the monomer shown by the aforesaid formula (VIII).

Such other monomers, include α-olefins, alkanoic acid vinyl esters, alkanoic acid allyl esters, acrylonitrile, methacrylonitrile, vinyl ethers, acrylamides, methacrylamides, styrenes, and heterocyclic vinyls (e.g., vinylpyrrolidone, vinylpyridine, vinylimidazole, vinylthiophene, vinylimidazole, vinylpyrazole, vinyldioxane, vinylquinoline, vinylthiazole, and vinyldioxane).

The content of the monomers other than the macromonomer shown by formula (I) to (IV) and the monomer shown by formula (VIII) should not exceed 20% by weight of the copolymer.

In the graft-type copolymer for use in this invention, the content of the copolymer component corresponding to the macromonomer shown by the formula (I), (II), (III), or (IV) is less than 1% by weight of the copolymer, the dispersibility as a coating composition for the photoconductive layer becomes insufficient. On the other hand, if the content exceeds 80% by weight of the copolymer, the copolymerization thereof with the monomer shown by formula (VIII) proceeds insufficiently, and homopolymers of the monomer shown by formula (VIII) and/or other monomers are undesirably formed in addition to the desired graft-type copolymer. Furthermore, if photoconductive particles are dispersed using such the aforesaid resin, the resin is aggregated with the photoconductive particles.

The resin (A) may further have a polar group (such as $—PO_3H_2$, $—SO_3H$, —COOH, —OH, or

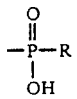

(wherein R represents a hydrocarbon group or —$OR^0$ (wherein $R^0$ represents a hydrocarbon group)) at the terminal of the main chain of the graft-type copolymer in addition to the carboxy group or the hydroxy group bonded to the terminal of the graft portion (i.e., resin (A')) as described hereinbefore, and the binder resin for use in this invention may contain the resin (A') together with the resin (A) having no polar group at the terminal of the main chain.

In

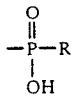

described above, the hydrocarbon group shown by R and $R^0$ includes an aliphatic group having from 1 to 18 carbon atoms and an aromatic group having from 6 to 12 carbon atoms.

Specific examples of the aliphatic group include an alkyl group having from 1 to 18 carbon atoms, which may be substituted (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylamino), a cycloalkyl group having from 5 to 8 carbon atoms (e.g., cycloheptyl, cyclohexyl, and cyclooctyl), an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, dichlorobenzyl, methylbenzyl, trimethylbenzyl, and methoxyl), etc. Also, specific examples of the aromatic group include an aryl group having from 6 to 12 carbon atoms, which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl), etc.

As OH-containing compounds, there are alcohols having a vinyl group or an allyl group (e.g., compounds having —OH in an ester substituent or an N-substituent of allyl alcohol, methacrylic acid ester, acrylamide, etc.) and methacrylic acid esters or methacrylic acid amides having hydroxyphenol or a hydroxyphenyl group as a substituent.

The resin (A') can be produced by a method of using a polymerization initiator having the polar group or functional group which can be converted into the polar group later, a method of using a chain transfer agent having the polar group or a functional group which can be converted into the polar group later, a method of using both the polymerization initiator and the chain transfer agent, or a method of introducing the polar group by utilizing a stop reaction in an anion polymerization reaction.

Examples of the production method thereof are described in P. Greyfuss and R. P. Quirk, *Encycl. Polym. Sci. Eng.*, 7, 551(1987), V. Percec, *Appl. Polym. Sci.*, 285, 95(1985), P. F. Rempp and E. Franta, *Adv. Polym. Sci.*, 58, 1(1984), Y. Yamashita, *J. Appl. Polym. Sci. Appl. Polym. Synp.*, 36, 193(1981), and R. Asami and M. Takaki, *Makromol. Chem. Suppl.*, 12, 163(1985).

The binder resin for use in this invention may contain two or more kinds of the aforesaid resins (A) (including the resin (A')).

On the other hand, the resin (B) for use in this invention is a resin composed of a graft-type copolymer meeting the aforesaid properties and having at least a monofunctional macromonomer (MB) and at least a monomer shown by formula (VII) described above.

The resin (B) is preferably a graft-type copolymer resin having a weight average molecular weight of at least $3\times10^4$, and more preferably from $5\times10^4$ to $3\times10^5$.

The glass transition point of the resin (B) is in the range of preferably from 0° C. to 120° C., and preferably from 10° C. to 90° C.

The mono-functional macromonomer (MB) is composed of at least one kind of the polymer components shown by the aforesaid formulae (VIa) and (VIb) having the polymerizable double bond group shown by the aforesaid formula (V) bonded to one terminal of the polymer main chain, the weight average molecular weight of the macromonomer being not more than $2\times10^4$.

In formulae (V), (VIa) and (VIb) described above, the hydrocarbon groups shown by $c^1$, $c^2$, $V^0$, $d^1$, $d^2$, $V^1$, $Q^1$, and $Q^0$ each has the number of carbon atoms indicated in each case (as unsubstituted hydrocarbon group) and these hydrocarbon groups may have a substituent.

In formula (V) showing the macromonomer (MB), $V^0$ represents —COO—, —OCO—, —$CH_2$OCO—, —O—, —$SO_2$—, —CO—, —CONHCOO—, —CONHCONH—, —CONH$SO_2$—,

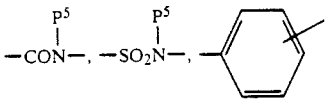

(wherein $P^5$ represents a hydrogen atom or a hydrocarbon group such as, preferably, an alkyl group having from 1 to 18 carbon atoms, which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms, which may be substituted (e.g., 2-methyl-1-propenyl, 2-butenyl, 2-pentenyl, 3-methyl-2-pentenyl, 1-pentenyl, 1-hexenyl, 2-hexnyl, and 4-methyl-2-hexenyl), an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopentyl), or an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $V^0$ represents

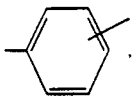

the benzene ring may have a substituent such as halogen atom (e.g., chlorine and bromine), an alkyl group (e.g., methyl, ethyl, propyl, butyl, chloromethyl, and methoxymethyl), an alkoxy group (e.g., methoxy, ethoxy, propioxy, and butoxy), etc.

Also, $c^1$ and $c^2$, which may be the same or different, each represents preferably a hydrogen atom, a halogen atom (e.g., chlorine and bromine), a cyano group, an alkyl group having from 1 to 4 carbon atoms (e.g., methyl, ethyl, propyl, and butyl), —COOR', or —COOZ' bonded via a hydrocarbon group (wherein Z' represents hydrogen atom, an alkyl group having from 1 to 18 carbon atoms, an alkenyl group, an aralkyl group, an alicyclic group, or an aryl group, and these groups may be substituted. Specific examples of these groups are those described above on $P^5$).

As described above, —COOZ' may be bonded via a hydrocarbon group and such a hydrocarbon group includes methylene, ethylene, propylene, etc.

In a more preferred embodiment on the formula (V), $V^0$ represents —COO—, —OCO—, —$CH_2$OCO—, —$CH_2$COO—, —O—, —CONHCOO—, —CONHCONH—, —CONH—, —$SO_2$NH—, or

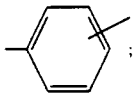

$c^1$ and $c^2$, which may be the same or different, each represents a hydrogen atom, a methyl group, —COOZ', or —$CH_2$COOZ' (wherein Z' represents a hydrogen atom or an alkyl group having from 1 to 6 carbon atoms (e.g., methyl, ethyl, propyl, butyl and hexyl)). It is most preferred that one of $c^1$ and $c^2$ is a hydrogen atom.

Specific examples of the polymerizable double bond group shown by formula (V) are

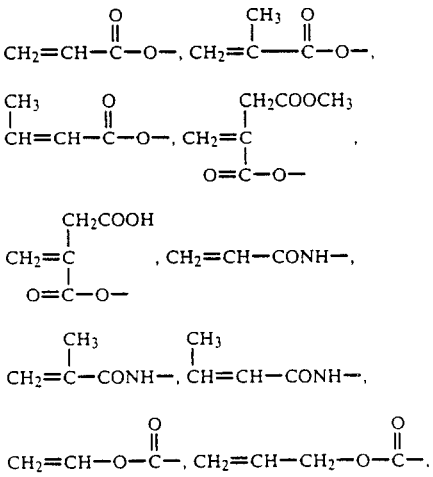

-continued

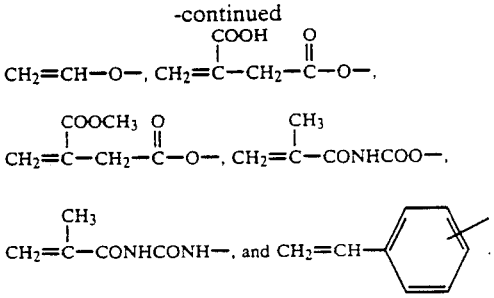

In formula (VI), $V^1$ has the same meaning as $V^0$ in formula (V) described above.

In formula (VI), $d^1$ and $d^2$, which may be the same or different, have the same meaning as $c^1$ and $c^2$ in formula (V).

$Q^1$ represents an aliphatic group having from 1 to 18 carbon atoms or an aromatic group having from 6 to 12 carbon atoms.

Specific examples of the aliphatic group include an alkyl group having from 1 to 18 carbon atoms, which may be substituted (e.g., methyl, ethyl, propyl, butyl, heptyl, hexyl, octyl, decyl, dodecyl, tridecyl, hexadecyl, octadecyl, 2-chloroethyl, 2-bromoethyl, 2-hydroxyethyl, 2-methoxyethyl, 2-ethoxyethyl, 2-cyanoethyl, 3-chloropropyl, 2-(trimethoxysilyl)ethyl, 2-tetrahydrofuryl, 2-thienylethyl, 2-N,N-dimethylaminoethyl, and 2-N,N-diethylaminoethyl), a cycloalkyl group having from 5 to 8 carbon atoms (e.g., cycloheptyl, cyclohexyl, and cyclooctyl), and an aralkyl group having from 7 to 12 carbon atoms, which may be substituted (e.g., benzyl, phenethyl, 3-phenylpropyl, naphthylmethyl, 2-naphthylethyl, chlorobenzyl, bromobenzyl, dichlorobenzyl, methylbenzyl, chloromethylbenzyl, dimethylbenzyl, trimethylbenzyl, and methoxybenzyl).

Also, Specific examples of the aromatic group include an aryl group having from 6 to 12 carbon atoms, which may be substituted (e.g., phenyl, tolyl, xylyl, chlorophenyl, bromophenyl, dichlorophenyl, chloromethylphenyl, methoxyphenyl, methoxycarbonylphenyl, naphthyl, and chloronaphthyl).

In formula (VIa), $V^1$ represents preferably —COO—, —OCO—, —$CH_2$COO—, —$CH_2$OCO—, —O—, —CO—, —CONHCOO—, —CONHCONH—, —CONH—, —$SO_2$NH—,

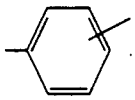

Preferred examples of $d^1$ and $d^2$ are the same as those of $c^1$ and $c^2$ described above.

In formula (VIb), $Q^0$ preferably represents —CN, —$CONH_2$, or

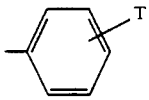

(wherein T represents a hydrogen atom, a halogen atom (e.g., chlorine and bromine), a hydrocarbon group (e.g., methyl, ethyl, propyl, butyl, chloromethyl and phenyl, and an alkoxy group (e.g., methoxy and ethoxy), or —COOZ" (wherein Z" represents an alkyl group having from 1 to 8 carbon atoms, an aralkyl group having from 7 to 12 carbon atoms, or an aryl group having from 7 to 12 carbon atoms)).

The macromonomer (MB) for use in this invention may contain two or more kinds of polymer components shown by formula (VIa) or (VIb) described above.

When $Q^1$ in formula (VIa) is an aliphatic group, it is preferred that the aliphatic group having from 6 to 12 carbon atoms exists in the range of not more than 20% by weight of the total polymer components in the macromonomer (MB).

Furthermore, when $V^1$ in formula (VIa) is —COO—, it is preferred that the polymer component shown by formula (VIa) exists in the range of at least 30% by weight of the total polymer components in the macromonomer (MB).

Also, examples of the monomer corresponding to the recurring unit which can be copolymerized with the polymer component shown by formula (VIa) and/or the polymer component shown by formula (VIb) in the macromonomer (MB) are acrylonitrile, methacrylonitrile, acrylamides, methacrylamides, styrene, styrene derivatives (e.g., vinyltoluene, chlorostyrene, dichlorostyrene, bromostyrene, hydroxymethylstyrene, and N,N-dimethylaminomethylstyrene), and heterocyclic vinyls (e.g., vinylpyridine, vinylimidazole, vinylpyrrolidone, vinylthiophene, vinylpyrazole, vinyldioxane, and vinyloxazine).

The macromonomer (MB) which is used for the resin (B) in this invention has a chemical structure that the polymerizable double bond group shown by formula (V) is bonded to only one terminal of the main chain of the polymer composed of the recurring unit shown by formula (VIa) and/or the recurring unit shown by formula (VIb) directly or by an optional linkage group.

The linkage group which links the component shown by formula (V) and the component shown by formula (VIa) or (VIb) is composed of an optional combination of the atomic groups such as a carbon-carbon bond (single bond or double bond), a carbon-hetero atom bond (examples of the hetero atom are oxygen, sulfur, nitrogen, and silicon), and a hetero atom-hetero atom bond.

Preferred macromonomers in the macromonomer (MB) for use in this invention are shown by following formula (IXa) or (IXb):

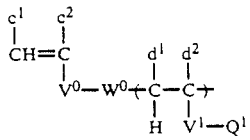

(IXa)

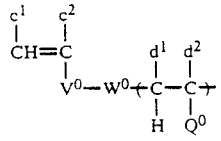

(IXb)

wherein $c^1$, $c^2$, $d^1$, $d^2$, $V^0$, $V^1$, $Q^1$, and $Q^0$ are the same as defined above for formulae (V), (VIa), and (VIb).

In the formulae (IXa) and (IXb), $W^0$ represents a simple bond or a linkage group singly composed of the atomic group selected from

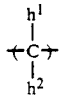

(wherein $h^1$ and $h^2$ each represents a hydrogen atom, a halogen atom (e.g., fluorine, chlorine, and bromine), a cyano group, a hydroxy group, or an alkyl group (e.g., methyl, ethyl, and propyl)),

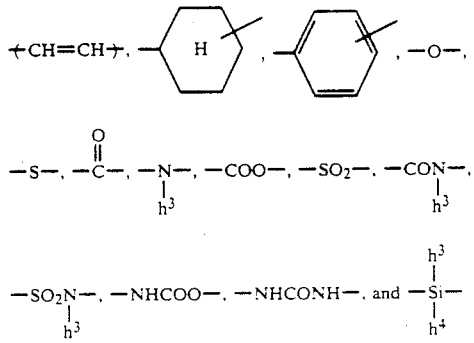

(wherein $h^3$ and $h^4$ each represents a hydrogen atom or the hydrocarbon group having the same meaning as $Q^1$ in formula (VI) described above) or composed of an optional combination of these atomic groups.

If the weight average molecular weight of the macromonomer (MB) exceeds $2\times10^4$, the copolymerizability with the monomer shown by formula (VII) is lowered. On the other hand, if the molecular weight thereof is too small, the effect for improving the electrophotographic characteristics of the photoconductive layer is reduced and hence the molecular weight is preferably larger than $1\times10^3$.

The macromonomer (MB) which is used for the resin (B) in this invention can be produced by conventionally known methods such as, for example, a method by an ion polymerization method, wherein the macromonomer is produced by reacting various reagents to a terminal of a living polymer obtained by an anion polymerization or a cation polymerization, a method by a radical polymerization, wherein a macromonomer is produced by reacting various reagents and an oligomer having a reactive group such as a carboxy group, a hydroxy group, an amino group, etc., at the terminal thereof obtained by a radical polymerization using a polymerization initiator and/or a chain transfer agent each having the reactive group in the molecule, and a method by a polyaddition condensation method of introducing a. polymerizable double bond group into an oligomer obtained by a polycondensation reaction or a poly addition reaction, in the same manner as the aforesaid radical polymerization method.

Practical methods for producing the macromonomer (BA) are described in P. Dreyfuss & R. P. Quirk, *Encycl. Polym. Sci. Eng.*, 7, 551(1987), P. F. Rempp & E. Franta, *Adv. Polym. Sci.*, 58, 1(1984), V. Percec, *Appl. Polym. Sci.*, 285, 95(1984), R. Asami & M. Takaki, *Makromol. Chem. Suppl.*, 12, 163(1985), P. Rempp et al, *Makromol. Chem. Suppl.*, 8, 3(1984), Yuusuke Kawakami, *Kagaku Kogyo* (*Chemical Industry*), 38, 56(1987), Yuuya Yamashita, *Kobunshi* (*Macromolecule*), 31, 988(1982), Shitoo Kobayashi, *Kobunshi* (*Macromolecule*), 30, 625(1981), Toshinobu Higashi Moti, *Nippon*

*Secchaku Kyokai Shi* (*Journal of Adhesive Society of Japan*), 18. 536(1982). Kooichi Ito, *Kobunshi Kako* (*Macromolecule Processing*), 35, 262(1986), and Kishiro Higashi & Takashi Tsuda. *Kinoo Zairyo* (*Functional Materials*), 1987, Nos. 10 and 5, and the literature references cited therein.

Then, specific examples of the macromonomer (MB) for use in this invention are illustrated below, but the scope of the present invention is not limited thereto.

In the following formulae, $c_1$ represents —H or —$CH_3$, $d_1$ represents —H or —$CH_3$, $d^2$ represents —H, —$CH_3$, or —$CH_2COOCH_3$; $R_{11}$ represents —$C_dH_{2d+1}$, —$CH_2C_6H_5$, —$C_6H_5$, or

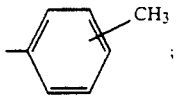

$R_{12}$ represents —$C_dH_{2d+1}$, $\text{-}(CH_2)_e\text{-}C_6H_5$, or

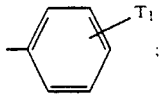

$R_{13}$ represents —$C_dH_{2d+1}$, —$CH_2C_6H_5$, or —$C_6H_5$; $R_{14}$ represents —$C_dH_{2d+1}$ or —$CH_2C_6H_5$; $R_{15}$ represents —$C_dH_{2d+1}$, —$CH_2C_6H_5$, or

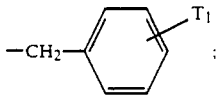

$R_{16}$ represents —$C_dH_{2d+1}$; $R_{17}$ represents —$C_dH_{2d+1}$, —$CH_2C_6H_5$, or

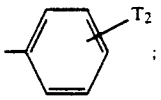

$R_{18}$ represents —$C_dH_{2d+1}$, —$CH_2C_6H_5$, or

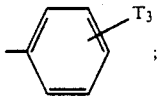

$V_1$ represents —$COOCH_3$, —$C_6H_5$, or —CN; $V_2$ represents —$OC_dH_{2d+1}$, —$OCOC_dH_{2d+1}$, —$COOCH_3$, —$C_6H_5$, or —CN; $V_3$ represents —$COOCH_3$, —$C_6H_5$,

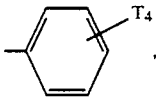

or —CN; $V_4$ represents —$OCOC_dH_{2d+1}$, —CN, —$CONH_2$, or —$C_6H_5$; $V_5$ represents —CN, —$CONH_2$, or —$C_6H_5$; $V_6$ represents —$COOCH_3$, —$C_6H_5$, or

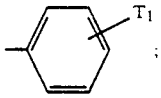

$T_1$ represents —$CH_3$, —Cl, —Br, or —$OCH_3$; $T_2$ represents —$CH_3$, —Cl, or —Br; $T_3$ represents —H, —Cl, —Br, —$CH_3$, —CN or —$COOCH_3$; $T_4$ represents —$CH_3$, —Cl, or —Br; $T_5$ represents —Cl, —Br, —F, —OH, or —CN; $T_6$ represents —H, —$CH_3$, —Cl, —Br, —$OCH_3$, or —$COOCH_3$; d represents an integer of from 1 to 18; e represents an integer of from 1 to 3; f represents an integer of from 2 to 4; and the parenthesized group or the bracketed group shows a recurring unit.

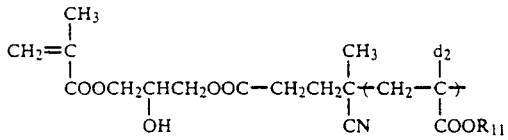

(MB-1)

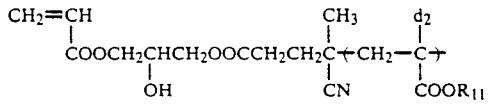

(MB-2)

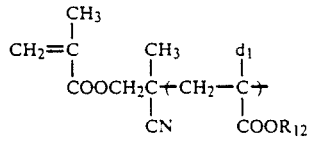

(MB-3)

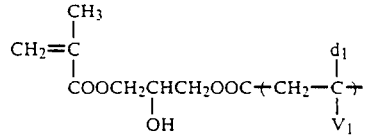

(MB-4)

-continued
(MB-5)
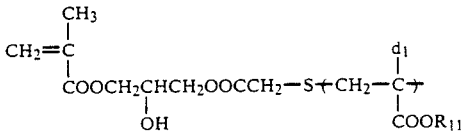
(MB-6)
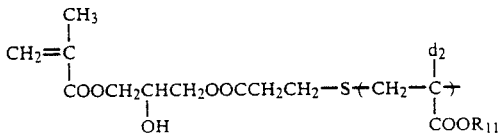
(MB-7)
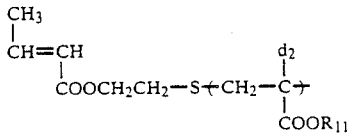
(MB-8)
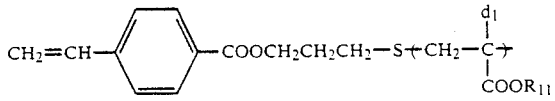
(MB-9)
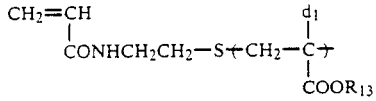
(MB-10)
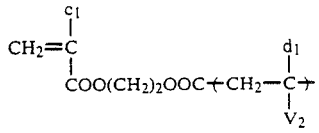
(MB-11)
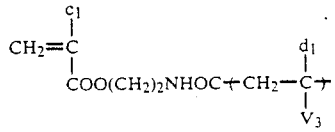
(MB-12)
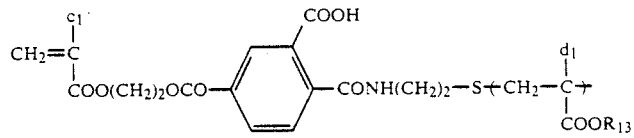
(MB-13)
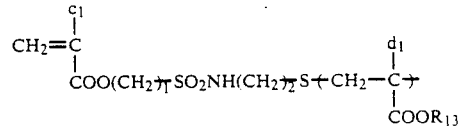
(MB-14)
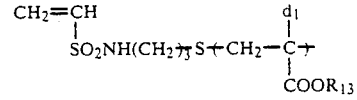
(MB-15)
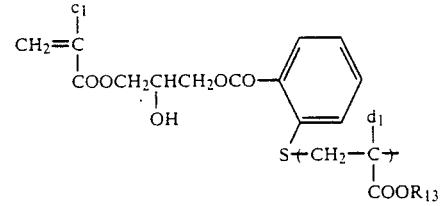

-continued
(MB-16)
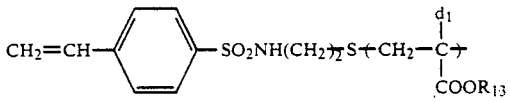
(MB-17)
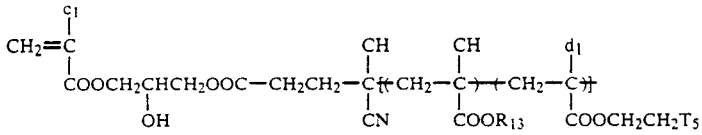
(MB-18)
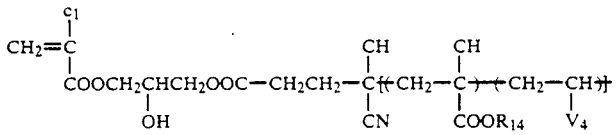
(MB-19)
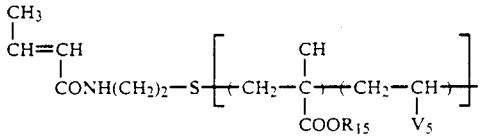
(MB-20)
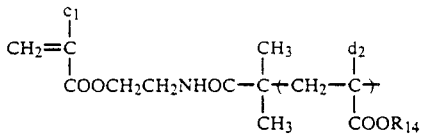
(MB-21)
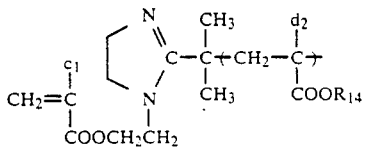
(MB-22)
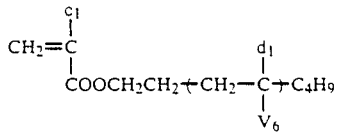
(MB-23)
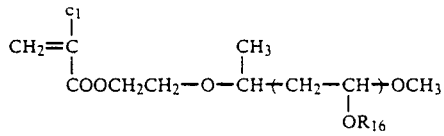
(MB-24)
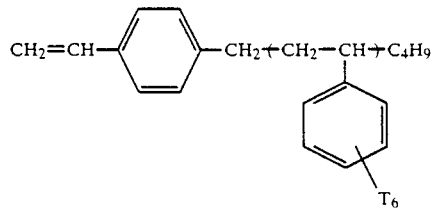
(MB-25)
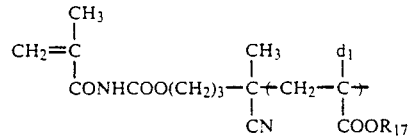

-continued (MB-26)

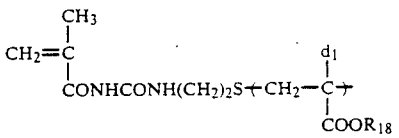

The monomer which is copolymerized with the aforesaid macromonomer (MB) is shown by the aforesaid formula (VII).

In formula (VII), $e^1$ and $e^2$, which may be the same or different, have the same meaning as $c^1$ and $c^2$ in formula (V) described above; $V^2$ has the same meaning as $V^1$ in formula (VIa); and $Q^2$ has the same meaning as $Q^1$ in formula (VIa).

Furthermore, the resin (B) for use in this invention may contain other monomer(s) as other copolymer component together with the aforesaid macromonomer (MB) and the monomer shown by formula (VII).

Examples of such other monomers are vinyl compounds having an acid group, α-olefins, acrylonitrile, methacrylonitrile, acrylamide, methacrylamide, styrene, methacrylamide, styrene, naphthalene compounds having a vinyl group (e.g., vinylnaphthalene and 1-isopropenylnaphthalene), and heterocyclic compounds having a vinyl group (e.g., vinylpyridine, vinylpyrrolidone, vinylthiophene, vinyltetrahydrofuran, vinyl-1,3-dioxolane, vinylimidazole, vinylthiazole, and vinyloxazoline).

In the resin (B), the composition ratio of copolymer component composed of the macromonomer (MB) as recurring unit to the copolymer component composed of the monomer shown by formula (VII) as recurring unit is from 1 to 80 to from 99 to 20, and preferably from 5 to 60 to from 95 to 40 by weight.

The aforesaid vinyl compounds having an acid group are described in *Kobunshi (Macromolecule) Data Handbook (Foundation)*, edited by Kobunshi Gakkai, published by Baifuukan, 1986.

Specific examples of the vinyl compound are acrylic acid, α- and/or β-substituted acrylic acids (e.g., α-acetoxyacrylic acid, α-acetoxymethylacrylic acid, α-(2-amino)methylacrylic acid, α-chloroacrylic acid, α-bromoacrylic acid, α-fluoroacrylic acid, α-tributylsilylacrylic acid, α-cyanoacrylic acid, β-chloroacrylic acid, β-bromoacrylic acid, α-chloro-β-methoxyacrylic acid, and α,β-dichloroacrylic acid), methacrylic acid, itaconic acid, itaconic acid half esters, itaconic acid half acids, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzensulfonic acid, vinylsulfonic acid, vinylphosphonic acid, half ester derivatives of the vinyl group or allyl group of a dicarboxylic acid, and the ester derivatives or amide derivatives of the aforesaid carboxylic acid or sulfonic acid having an acid group in the substituent thereof.

When the resin (B) contains the "vinyl compound having an acid group" as the copolymer component corresponding to the recurring unit, it is preferred that the content of the copolymer component having the acid group is not more than 10% by weight of the copolymer.

If the content of the acid group-having component exceeds 10% by weight, the interaction of the binder resin with inorganic photoconductive particles becomes remarkable to reduce the surface smoothness of the photoconductive layer, which results in reducing the electrophotographic characteristics (in particular, charging property and the dark charge retentivity) of the photoconductive layer.

Furthermore, the resin (B') which can be used in a preferred embodiment of this invention is a polymer composed of at least one kind of the recurring unit shown by formula (VII) and at least one kind of the recurring unit shown as the macromonomer (MB) and having at least one polar group selected from $-PO_3H_2$, $-SO_3H$, $-COOH$, $-OH$, $-SH$, and $-PO_3R'H$ bonded to one terminal only of the main chain of the polymer (wherein R' has the same meaning as aforesaid R (i.e., a hydrocarbon group or $-OR^0$, wherein $R^0$ represents a hydrocarbon group)) and specific examples of R' are the same as those illustrated above as the specific examples of R.

Also, when the resin has the aforesaid polar group bonded to one terminal of the polymer main chain, it is preferred that the resin does not contain a copolymer component having a polar group such as a carboxy group, a sulfo group, a hydroxy group, or a phosphono group in the polymer main chain.

In the resin (B'), the aforesaid polar group has a chemical structure that the polar group is bonded to one terminal of the polymer main chain directly or via an optional linkage group.

The aforesaid linkage group is composed of an optional combination of the atomic groups such as a carbon-carbon bond (single bond and double bond), a carbon-hetero atom bond (examples of the hetero atom are oxygen, sulfur, nitrogen, and silicon), and a hetero atom-hetero atom bond.

Specific examples of the linkage group include a linkage group singly composed of an atomic group selected from

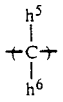

(wherein $h^5$ and $h^6$ have the same meaning as $h^1$ and $h^2$),

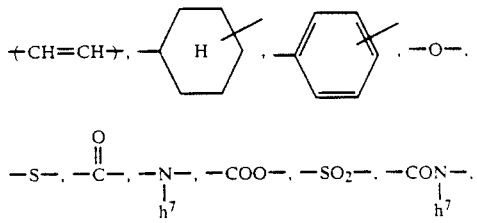

-continued $$-SO_2\underset{\underset{h^7}{|}}{N}-,\ -NHCOO-,\ -NHCONH-,\ \text{and}\ -\overset{\overset{h^7}{|}}{\underset{\underset{h^8}{|}}{Si}}-$$

(wherein $h^7$ and $h^8$ have the same meaning as $h^3$ and $h^4$) and a linkage group composed of an optional combination of the aforesaid atomic groups.

In the resin (B'), the content of the polar group bonded to one terminal of the polymer main chain is preferably from 0.1 to 15% by weight, and more preferably from 0.5 to 10% by weight per 100 parts by weight of the resin (B'). If the content thereof is less than 0.1% by weight, the effect of improving the film strength is reduced, while if the content thereof exceeds 15% by weight, photoconductive particles are not uniformly dispersed in the binder resin at the preparation of the dispersion thereof to cause aggregation. whereby a uniform coated layer is not formed.

The resin (B') having the specific polar group at only one terminal of the polymer main chain can be easily produced by a method by an ion polymerization, wherein various reagents are reacted to one terminal of a living polymer obtained by a conventionally known anion polymerization or cation polymerization, a method by a radical polymerization, wherein the radical polymerization is carried out using a polymerization initiator and/or a chain transfer agent each having the specific polar group in the molecule, or a method wherein a reactive group of a polymer having the reactive group at the terminal thereof obtained by the aforesaid ion polymerization or radical polymerization is converted into the specific polar group by a macromolecular reaction.

Practical methods of producing the resin (B') for use in this invention are described in P. Dreyfuss & R. P. Quirk, *Encycl. Polym. Sci. Eng.*, 7, 551(1987), Yoshiki Nakajoo & Yuuya Yamashita, *Senryo to Yakuhin* (*Dyes and Chemicals*), 30, 232(1985), and Akira Ueda & Susumu Nagai, *Kagaku to Kogyo* (*Science and Industry*), 60, 57(1986) and the literature references cited therein.

The ratio of the amount of the resin (A) and the amount of the resin (B) (including the resin (B')) for use in this invention varies depending upon the kind, particle sizes, and surface state of inorganic photoconductive particles used, but the ratio of resin (A)/resin (B) is 5 to 80/95 to 20, and preferably 10 to 60/90 to 40 by weight ratio.

The inorganic photoconductive material which can be used in the present invention includes zinc oxide, titanium oxide, zinc sulfide, cadmium sulfide, cadmium carbonate, zinc selenide, cadmium selenide, tellurium selenide, lead sulfide, etc.

The amount of the binder resin for use in this invention is from 10 to 100 parts by weight, and preferably from 15 to 50 parts by weight per 100 parts by weight of inorganic photoconductive particles.

If necessary, the photoconductive layer in this invention may contain various spectral sensitizers.

Examples of suitable spectral sensitizing dyes are carbonium dyes, diphenylmethane series dyes, triphenylmethane series dyes, xanthene series dyes, phthalein series dyes, polymethine dyes (e.g., oxonol dyes, merocyanine dyes, cyanine dyes, rhodacyanine dyes, and styryl dyes), and phthalocyanine dyes (inclusive of metallized dyes) described in Harumi Miyamoto & Hidehiko Takei, *Imaging*, No. 8, 12(1973), C. J. Young, *RCA Review*, 15, 469(1954), Koohei Seida et al, *Journal of Electric Communication Society of Japan*, 63-C, No. 2, 97(1980), Yuuji Harasaki et al, *Journal of Industrial Chemistry*, 66, 78 and 188(1963), and Tadaaki Tani, *Journal of the Society of Photographic Science and Technology of Japan*, 35, 208(1972).

Specific examples of suitable carbonium series dyes, triphenylmethane dyes, xanthene series dyes, and phthalein series dyes are described in JP-B-51-452, JP-A-50-90334, JP-A-50-114227, JP-A-53-39310, JP-A-53-82353 and JP-A-57-16455, and U.S. Pat. Nos. 3,052,540 and 4,054,450.

Also, as polymethine dyes such as oxonol dyes, merocyanine dyes, cyanine dyes, and rhodacyanine dyes, the dyes described in F. M. Harmmar, *The Cyanine Dyes and Related Compounds* can be used, and specific examples such dyes include those described in U.S. Pat. Nos. 3,047,384, 3,110,591, 3,121,008, 3,125,447, 3,128,179, 3,132,942, and 3,622,317, British Patents 1,226,892, 1,309,274, and 1,405,898, and JP-B-48-7814 and JP-B-55-18892.

Furthermore, polymethine dyes capable of spectrally sensitizing in the wavelength region of from near infrared to infrared longer than 700 nm are described in JP-B-51-41061, JP-A-47-840, JP-A-47-44180, JP-A-49-5034, JP-A-49-45122, JP-A-57-46245, JP-A-56-35141, JP-A-57-157254, JP-A-61-26044, and JP-A-61-27551, U.S. Pat. Nos. 3,619,154 and 4,175,956, and *Research Disclosure*, 216, 117–118(1982).

The light-sensitive material of this invention is excellent in that, even when various sensitizing dyes are used for the photoconductive layer, the performance thereof is reluctant to vary by such sensitizing dyes.

If desired, the photoconductive layers may further contain various additives commonly employed in electrophotographic photoconductive layers, such as chemical sensitizers. Examples of such additives are electron-acceptive compounds (e.g., halogen, benzoquinone, chloranil, acid anhydrides, and organic carboxylic acids) described in *Imaging* 1973, (No. 8), page 12, and polyarylalkane compounds, hindered phenol compounds, and p-phenylenediamine compounds described in Hiroshi Kokado et al, *Recent Photoconductive Materials and Development and Practical Use of Light-sensitive Materials*, Chapters 4 to 6, published by Nippon Kagaku Joho K.K., 1986.

There is no particular restriction on the amount of these additives but the amount thereof is usually from 0.001 to 2.0 parts by weight per 100 parts by weight of the photoconductive material.

The thickness of the photoconductive layer is from 1 μm to 100 μm, and preferably from 10 μm to 50 μm.

Also, when the photoconductive layer is used as a charge generating layer of a double layer type electrophotographic light-sensitive material having the charge generating layer and a charge transporting layer, the thickness of the charge generating layer is from 0.01 μm to 1 μm, and preferably from 0.05 μm to 0.5 μm.

As the case may be, an insulating layer is formed on the photoconductive layer for the protection of the photoconductive layer and the improvement of the durability and the dark decay characteristics of the photoconductive layer. In this case, the thickness of the insulating layer is relatively thin, but, when the light-sensitive material is used for a specific electrophotographic process, the insulating layer having a relatively large thickness is formed.

In the latter case, the thickness of the insulating layer is from 5 μm to 70 μm, and particularly from 10 μm to 50 μm.

As the charge transporting material for the double layer type light-sensitive material, there are polyvinylcarbazole, oxazole series dyes, pyrazoline series dyes, and triphenylmethane series dyes. The thickness of the charge transfer layer is from 5 μm to 40 μm, and preferably from 10 μm to 30 μm.

Resins which can be used for the insulating layer and the charge transfer layer typically include thermoplastic and thermosetting resins such as polystyrene resins, polyester resins, cellulose resins, polyether resins, vinyl chloride resins, vinyl acetate resins, vinyl chloride-vinyl acetate copolymer resins, polyacryl resins, polyolefin resins, urethane resins, epoxy resins, melamine resins, and silicone resins.

The photoconductive layer according to the present invention can be provided on any known support. In general, a support for an electrophotographic photosensitive layer is preferably electrically conductive. Any of conventionally employed conductive supports may be utilized in this invention. Examples of usable conductive supports includes a base, e.g., a metal sheet, paper, a synthetic resin sheet, etc., having been rendered electrically conductive by, for example, impregnation with a low resistant substance; the abovedescribed base with the back side thereof (opposite to the photosensitive layer side) being rendered conductive and having further coated thereon at least one layer for the purpose of prevention of curling the above-described supports having thereon a water-resistant adhesive layer; the above-described supports having thereon at least one precoat layer; and paper laminated with a synthetic resin film on which aluminum, etc. is deposited.

Specific examples of conductive supports and materials for imparting conductivity are described in Yuko Sakamoto, *Denshishashi*, Vol. 14, No. 1, pp. 2 to 11 (1975), Hiroyuki Moriga, *Nyumon Tokushushi no Kagaku*, Kobunshi Kankokai (1975), and M. F. Hoover, *J. Macromol. Sci. Chem.*, A-4(6), pp. 1327 to 1417 (1970).

The present invention will now be illustrated in greater detail by way of Synthesis Examples, Examples and Comparative Examples, but it should be understood that the present invention is not deemed to be limited thereto. Unless otherwise indicated herein, all parts, percents, ratios and the like are by weight.

Synthesis Examples of the Macromonomers for the Resin (A)

Synthesis Example 1 of Macromonomers: MM-1

A mixture of 90.1 g of 1,4-butanediol, 105.1 g of succinic anhydride, 1.6 g of p-toluenesulfonic acid monohydrate, and 200 g of toluene was heated in a flask equipped with a Dean-Stark refluxing device under refluxing with stirring for 4 hours. The amount of water azeotropically distilled out with toluene was 17.5 g.

Then, after adding a mixture of 17.2 g of acrylic acid and 150 g of toluene to the reaction mixture obtained above together with 1.0 g of t-butylhydroquinone, the reaction was further carried out under refluxing with stirring for 4 hours. After cooling to room temperature, the reaction mixture obtained was reprecipitated from 2 liters of methanol and the solid thus precipitated was collected by filtration and dried under reduced pressure to obtain 135 g of Macromonomer MM-1 having a weight average molecular weight of $6.8\times10^3$.

$$CH_2{=}CH{-}COO\!\left(CH_2\right)_4OCO\left(CH_2\right)_2COO\!\right)H \quad \text{(MM-1)}:$$

Synthesis Example 2 of Macromonomer: MM-2

A mixture of 120 g of 1,6-hexanediol, 114.1 g of glutaric acid anhydride, 3.0 g of p-toluenesulfonic acid monohydrate, and 250 g of toluene was heated under the same condition as used in Synthesis Example 1 of macromonomer. The amount of water azeotropically distilled out was 17.5 g.

After cooling to room temperature, the reaction mixture was reprecipitated from 2 liters of n-hexane and, after removing the liquid phase by decantation, the solid thus precipitated was collected by filtration and dried under reduced pressure.

The reaction product thus obtained was dissolved in toluene, and the content of the carboxy group was measured by a method of performing a neutralization titration with a methanol solution of 0.1N potassium hydroxide. The content was confirmed to be 500 μmol/g.

A mixture of 100 g of the aforesaid solid product, 8.6 g of methacrylic acid, 1.0 g of t-butylhydroquinone, and 200 g of methylene chloride was stirred at room temperature to dissolve the solid product.

Then, a mixture of 20.3 g of dicyclohexylcarbodiimide (D.C.C.), and 100 g of methylene chloride was added dropwise to the aforesaid solution with stirring over a period of one hour and the resulting mixture was stirred for 4 hours as it was.

With the dropwise addition of the D.C.C. solution, insoluble crystals precipitated. The reaction mixture was passed through a 200 mesh nylon cloth to remove insoluble materials.

The filtrate thus obtained was reprecipitated from 2 liters of hexane, and the powder formed was collected by filtration. To the powder was added 500 ml of acetone followed by stirring for one hour and then insoluble materials were filtered off by using a filter paper. The filtrate was concentrated under reduced pressure to ½ of the original volume, and the solution was added to 1 liter of diethyl ether followed by stirring for one hour. Then, the solid thus precipitated was collected by filtration and dried under reduced pressure to obtain 53 g of Macromonomer MM-2 having a weight average molecular weight of $8.2\times10^3$.

$$CH_2{=}C(CH_3){-}COO\!\left(CH_2\right)_6OCO\left(CH_2\right)_5COO\!\right)H \quad \text{(MM-2)}:$$

Synthesis Example 3 of Macromonomer: MM-3

In an oil bath having an outer temperature of 150° C., 500 g of 12-hydroxystearic acid was stirred under a reduced pressure of from 10 to 15 mmHg for 10 hours while distilling off water being formed.

The content of the carboxy group of the liquid product obtained was 600 μmol/g.

A mixture of 100 g of the aforesaid liquid product, 18.5 g of methacrylic acid anhydride, 1.5 g of t-butylhydroquinone, and 200 g of tetrahydrofuran was stirred for 6 hours at a temperature of from 40° C. to 45° C. The reaction mixture obtained was added dropwise to one liter of water with stirring over a period of one hour, and the mixture was further stirred for one hour. The mixture was allowed to stand, the liquid product thus deposited was recovered by decantation, dissolved in 200 g of tetrahydrofuran (THF), and the solution formed was reprecipitated from one liter of methanol. The liquid product thus deposited was recovered by decantation and dried under reduced pressure to obtain 62 g of Macromonomer MM-3 having a weight average molecular weight of $6.7\times10^3$.

MM-3:

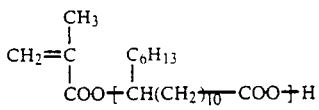

Synthesis Example 4 of Macromonomer: MM-4

According to the synthesis method described in S. Penczek et al, *Makromol. Chem.*, 188, 1347(1987), Macromonomer MM-4 having the following structure was synthesized. The weight average molecular weight thereof was $7.3\times10^3$.

MM-4:

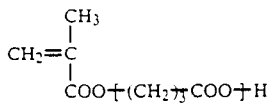

Synthesis Example 5 of Macromonomer: MM-5

A mixture of 90.1 g of 1,4-butanediol, 105.1 g of succinic anhydride, 1.6 g of p-toluenesulfonic acid monohydrate, and 200 g of toluene was heated in a flask equipped with a Dean—Stark refluxing device under refluxing with stirring for 4 hours. The amount of water azeotropically distilled out with toluene was 17.5 g.

Then, a mixture of 21.2 g of 2-hydroxyethyl methacrylate and 150 g of toluene was added to the aforesaid reaction mixture with 1.0 g of t-butylhydroquinone, and a mixture of 33.5 g of dicyclohexylcarbodiimide (D.C.C.), 1.0 g of 4-(N,N-dimethylamino)pyridine, and 100 g of methylene chloride was added dropwise to the aforesaid mixture with stirring over a period of one hour, and the mixture was further stirred for 4 hours.

The reaction mixture obtained was passed through a 200 mesh nylon cloth to filter off insoluble materials. The filtrate was reprecipitated from 3 liters of methanol, and the powder thus precipitated was collected by filtration. The powder was dissolved in 200 g of methylene chloride, and the solution was reprecipitated again from 3 liters of methanol. The powder thus precipitated was collected by filtration and dried under reduced pressure to obtain 103 g of Macromonomer MM-5 having a weight average molecular weight of $6.3\times10^3$.

MM-5:

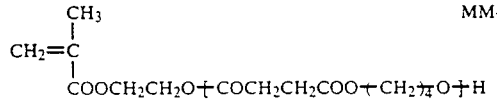

Synthesis Example 6 of Macromonomer: MM-6

A mixture of 120 g of 1,6-hexanediol, 114.1 g of glutaric anhydride, 3.0 g of p-toluenesulfonic acid monohydrate, and 250 g of toluene was heated under the same condition as in Synthesis Example 1. The amount of water azeotropically distilled out with toluene was 17.5 g.

After cooling to room temperature, the reaction mixture was reprecipitated from 2 liters of n-hexane, and the liquid product was collected by decantation, and the residue was collected and dried under reduced pressure.

The reaction product thus obtained was dissolved in toluene, and the content of the carboxy group was measured by neutralization titration with a methanol solution of 0.1N potassium hydroxide. The content thereof was 500 μmol/g.

A mixture of 100 g of the aforesaid solid product, 10.7 g of glycidyl methacrylate, 1.0 g of t-butylhydroquinone, 1.0 g of N,N-dimethyldodecylamine, and 200 g of xylene was stirred for 5 hours at 140° C.

After cooling, the reaction mixture was reprecipitated from 3 liters of n-hexane and, after removing liquid phase by decantation, the residue was collected and dried under reduced pressure.

The content of the remaining carboxy group in the macromonomer measured by the aforesaid neutralization titration method was 8 μmol/g, which showed the conversion being 99.8%.

The amount of Macromonomer MM-6 was 63 g and the weight average molecular weight was $7.6\times10^3$.

MM-6:

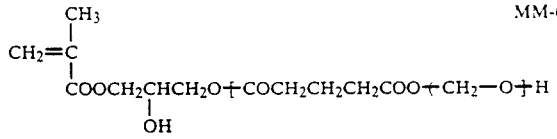

Synthesis Example 7 of Macromonomer: MM-7

To a mixture of 100 g of the polyester oligomer obtained in Synthesis Example 6 described above, 200 g of methylene chloride, and 1 ml of dimethylformamide was added dropwise 15 g of thionyl chloride with stirring at a temperature of from 25° C. to 30° C. Thereafter, the mixture was stirred for 2 hours. Then, after distilling off methylene chloride and excessive thionyl chloride under reduced pressure by an aspirator, the residue was dissolved in 200 g of tetrahydrofuran and 11.9 g of pyridine, and 8.7 g of allyl alcohol was added dropwise to the solution with stirring at a temperature of from 25° C. to 30° C. Thereafter, the mixture was stirred for 3 hours, and then the reaction mixture was poured into one liter of water, followed by stirring for one hour. The mixture was allowed to stand, and the deposited liquid product was collected by decantation. The liquid product was poured into one liter of water, followed by stirring again for 30 minutes. The mixture was allowed to stand, and the deposited liquid product was collected by decantation.

The aforesaid operation was repeatedly carried out until the supernatant solution became neutral. Then, 500 ml of diethyl ether was added to the liquid product finally obtained, followed by stirring, to solidify the product.

The solid product was collected by filtration and dried under reduced pressure to obtain 59 g of Macromonomer MM-7 having a weight average molecular weight of $7.7\times10^3$.

MM-7:

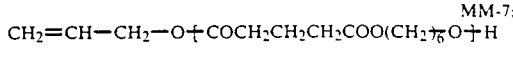

Synthesis Example 8 of Macromonomer: MM-8

500 g of 12-hydroxystearic acid was stirred in an oil bath having an outer temperature of 150° C. for 10 hours under a reduced pressure of from 10 to 15 mmHg while distilling off water being formed.

The carboxy group content of the liquid product obtained was 600 μmol/g.

To a mixture of 100 g of the liquid product, 13.9 g of 2-hydroxyethyl acrylate, 1.5 g of t-butylhydroquinone and 200 g of methylene chloride was added dropwise a mixture of 24.8 g of dicyclohexylcarbodiimide (D.C.C.), 0.8 g of 4-(N,N-dimethyl)aminopyridine, and 100 g of methylene chloride with stirring at room temperature over a period of one hour. Then, the resulting mixture was further stirred for 4 hours in situ. The reaction mixture obtained was passed through a 200 mesh nylon cloth to filtrate away insoluble materials. The filtrate was concentrated under reduced pressure, 300 g of n-hexane was added to the concentrate followed by stirring, and the insoluble materials were removed using a filter paper. The filtrate was concentrated, and the residue thus formed was dissolved in 100 g of tetrahydrofuran. The solution was reprecipitated from one liter of methanol, and the liquid product thus deposited was collected by decantation and dried under reduced pressure to obtain 60 g of Macromonomer MM-8 having a weight average molecular weight of $6.7\times10^3$.

MM-8:

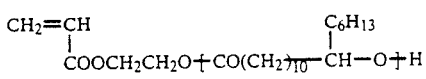

Synthesis Examples of Resin (A)

Synthesis Example 1 of Resin (A): A-1

A mixture of 60 g of benzyl methacrylate, 20 g of methyl acrylate, 20 g of the compound MM-1 obtained in Synthesis Example 1 of macromonomer, and 200 g of toluene was heated to 90° C. under nitrogen gas stream and, after adding 6.0 g of 2,2'-azobisisobutyronitrile (A.I.B.N) to the reaction mixture, the mixture was stirred for 4 hours. Then, after adding 2 g of A.I.B.N to the reaction mixture, the mixture was stirred for 2 hours and, after further adding thereto 1 g of A.I.B.N., the mixture was stirred for 3 hours to obtain the desired copolymer A-1. The weight average molecular weight thereof was $9.6\times10^3$.

A-1:

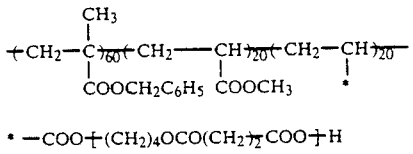

Synthesis Example 2 of Resin (A): A-2

A mixture of 50 g of benzyl methacrylate, 50 g of the compound MM-2 obtained in Synthesis Example 2 of macromonomer, 1.0 g of n-dodecylmercaptan, and 200 g of toluene was heated to 75° C. under nitrogen gas stream. After adding 1.0 g of 2,2'-azobisisobutyronitrile (A.I.B.N.) to the reaction mixture thus obtained, the mixture was stirred for 4 hours. Then, after adding 0.2 g of A.I.B.N. to the reaction mixture, the mixture was stirred for 2 hours and, after further adding thereto 0.2 g of A.I.B.N., the mixture was stirred for 3 hours to obtain the desired copolymer A-2 having a weight average molecular weight of $7.5\times10^3$.

A-2:

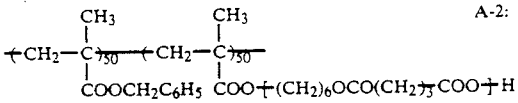

Synthesis Example 3 of Resin (A): A-3

A mixture of 47 g of 2-bromophenyl methacrylate, 50 g of the compound MM-3 obtained in Synthesis Example 3 of macromonomer, 3.0 g of thioglycolic acid, and 200 g of toluene was heated to 75° C. under nitrogen gas stream and, after adding 1.5 g of A.I.B.N. to the reaction mixture, the mixture was stirred for 4 hours. Then, after adding 0.4 g of A.I.B.N. to the reaction mixture, the mixture was stirred for 2 hours and, after further adding thereto 0.2 g of A.I.B.N., the mixture was stirred for 3 hours to obtain the desired copolymer A-3 having a weight average molecular weight of $7.0\times10^3$.

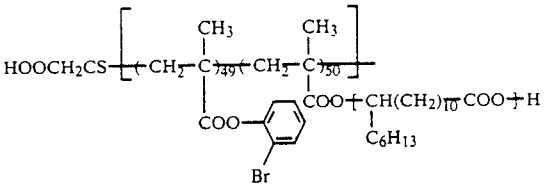

Synthesis Example 4 of Resin (A): A-4

A mixture of 60 g of 2-chlorophenyl methacrylate, 40 g of the compound MM-4 obtained in Synthesis Example 4 of macromonomer, 150 g of toluene, and 50 g of isopropyl alcohol was headed to 85° C. under nitrogen gas stream. After adding 5.0 g of 4,4'-azobis(2-cyanovaleric acid) (A.C.V.) to the reaction mixture, the mixture was stirred for 4 hours. Then, after adding 1 g of A.C.V. to the reaction mixture, the mixture was stirred for 2 hours and, after further adding 1 g of A.C.V. thereto, the mixture was stirred for 3 hours to obtain the desired copolymer A-4 having a weight average molecular weight of $8.5\times10^3$.

A-4:

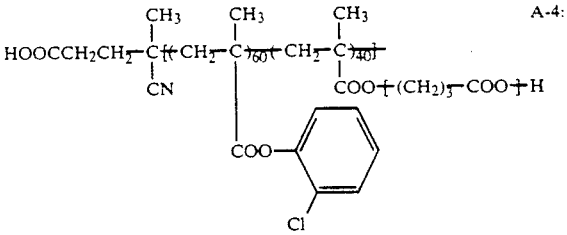

Synthesis Examples 5 to 14 of Resin (A): A-5 to A-14

By following the similar procedure to that in Synthesis Example 1 of Resin (A), each of Resins (A) shown in Table 1 below was produced. The weight average molecular weights of these resins were from $8.5\times10^3$ to $1.0\times10^4$.

TABLE 1

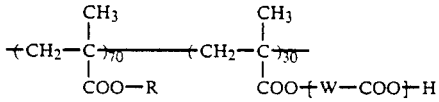

| Example of Resin (A) | R | —W— |
|---|---|---|
| A-5 | $-CH_3$ | $-CH(C_4H_9)(CH_2)_{10}-$ |
| A-6 | $-C_2H_5$ | $-(CH_2)_6OCO-CH_2C(C_2H_5)-$ |
| A-7 | 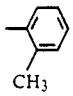 | $-CH_2CH_2OCH_2CH_2OCOCH_2CH_2-$ |
| A-8 | " | 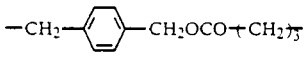 |
| A-9 | 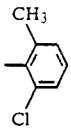 | $-CH(C_6H_{13})(CH_2)_{10}-$ |
| A-10 | $-CH_3$ | $-(CH_2)_3-$ |
| A-11 | 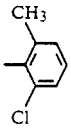 | 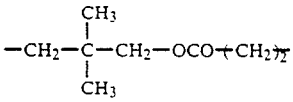 |
| A-12 | $-CH_2C_6H_5$ | 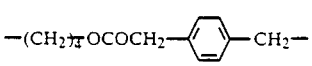 |
| A-13 | 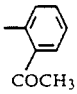 | $-OCH_2CH=CH-CH_2OCO-(CH_2)_3-$ |
| A-14 | 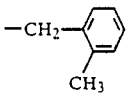 | $-CH(CH_3)OCO-(CH_2)_4-$ |

Synthesis Examples 15 to 20 of Resin (A): A-15 to A-20

By following the same procedure as Synthesis Example 3 of Resin (A) except that 3 g of each of the mercapto compounds (chain transfer agents) shown in Table 2 below was used in place of 3 g of thioglycolic acid, each of the resins A-15 to A-20 was produced.

TABLE 2

| Example of Resin (A) | Chain Transfer Agent | Weight Average Molecular Weight of Copolymer obtained |
|---|---|---|
| A-15 | $HS(CH_2)_2-COOH$ | 8,300 |
| A-16 | $HS-CH(CH_2-COOH)-COOH$ | 7,600 |
| A-17 | 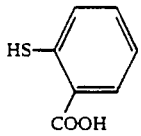 | 7,700 |
| A-18 | $HSCH_2CH_2SO_3H$ | 7,600 |
| A-19 | $HS(CH_2)_3O-P(=O)(OH)-OH$ | 7,800 |
| A-20 | $HS(CH_2)_2O-P(=O)(OC_2H_5)-OH$ | 8,000 |

Synthesis Example 21 of Resin (A): A-21

A mixture of 50 g of 2,6-dichlorophenyl methacrylate, 50 g of the compound MM-1 obtained in Synthesis Example 1 of macromonomer, 2 g of thioglycolic acid, 150 g of toluene, and 50 g of ethanol was heated to 80° C. and, after adding 3 g of A.C.V. to the reaction mixture, the reaction was carried out for 4 hours. Also, after further adding thereto 1.0 g of A.C.V., the reaction was carried out for 4 hours to obtain the desired copolymer A-21 having a weight average molecular weight of $8.5\times10^3$.

A-21:

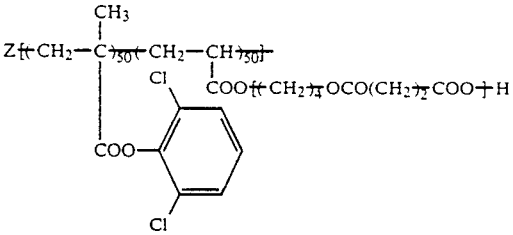

Z: $-C(CN)(CH_3)-CH_2CH_2COOH/-SCH_2COOH$ (1/2, by weight ratio)

Synthesis Examples 22 and 23 of Resin (A): A-22 and A-23

By following the similar procedure to Synthesis Example 3 of Resin (A), each of the resins A-22 and A-23 was produced.

A-22:

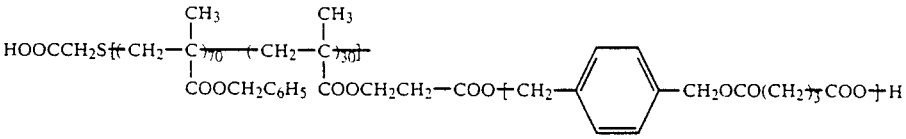

-continued

Weight average molecular weight: $8.6 \times 10^3$.

A-23:

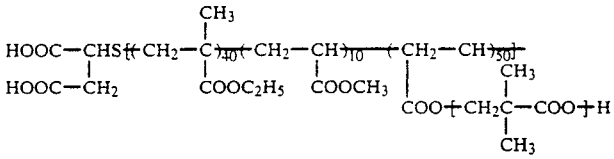

Weight average molecular weight: $8.1 \times 10^3$.

Synthesis Examples 24 and 25 of Resin (A): A-24 and

A-26:

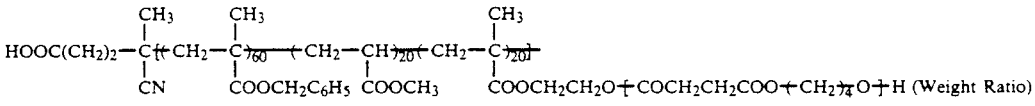

A-25

By following the similar procedure to Synthesis Example 3 of Resin (A), each of the resins A-24 and A-25 shown in Table 3 below was produced. The weight average molecular weights of the resins were from $3.0 \times 10^3$ to $8 \times 10^4$.

TABLE 3

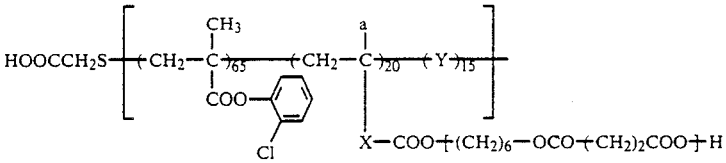

| Example of Resin (A) | X | a | —Y— |
|---|---|---|---|
| A-24 | —CONH(CH₂)₁₀— | H | —CH₂—C(CH₃)(COO(CH₂)₂OH)— |
| A-25 | —COO(CH₂)₆— | CH₃ | —CH₂—C(CH₃)(COO(CH₂)₁₀OH)— |

Synthesis Example 26 of Resin (A): A-26

A mixture of 60 g of benzyl methacrylate, 20 g of methyl acrylate, 20 g of the compound MM-5 obtained in Synthesis Example 5 of macromonomer, 150 g of toluene, and 50 g of isopropyl alcohol was heated to 80° C. under nitrogen gas stream and, after adding 5.0 g of 4,4'-azobis(2-cyanovaleric acid) (A.C.V.) to the reaction mixture, the mixture was stirred for 4 hours. Then, after adding 0.2 g of A.C.V. to the reaction mixture, the mixture was stirred for 2 hours and, after further adding thereto 0.2 g of A.C.V., the mixture was stirred for 3 hours to obtain the desired copolymer A-26 having a weight average molecular weight of $8.5 \times 10^3$.

Synthesis Example 27 of Resin (A): A-27

A mixture of 60 g of phenyl methacrylate, 40 g of the compound MM-6 obtained in Synthesis Example 6 of macromonomer, 150 g of toluene, and 50 g of isopropyl alcohol was heated to 90° C. under nitrogen gas stream and, after adding 5.0 g of A.C.V. to the reaction mixture, the mixture was stirred for 3 hours. Then, after adding 1.0 g of A.C.V. to the reaction mixture, the mixture was stirred for 2 hours and, after further adding thereto 0.5 g of A.C.V., the mixture was stirred for 3 hours to obtain the desired copolymer A-27 having a weight average molecular weight of $8.5 \times 10^3$.

A-27:

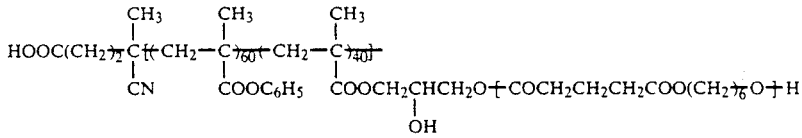

Synthesis Example 28 of Resin (A): A-28

A mixture of 70 g of 2-bromophenyl methacrylate, 30 g of the compound MM-5 obtained in Synthesis Example 5 of macromonomer, 3.0 g of thioglycolic acid, and 200 g of toluene was heated to 75° C. under nitrogen gas stream and, after adding 1.0 g of 2,2'-azobisisobutyronitrile (A.I.B.N.) to the reaction mixture, the mixture was stirred for 4 hours. Then, after adding 0.4 g of A.I.B.N. to the reaction mixture, the mixture was stirred for 2 hours and, after further adding thereto 0.2 g of A.I.B.N., the mixture was stirred for 3 hours to obtain the desired copolymer A-28 having a weight average molecular weight of $7.5\times10^3$.

A-28:

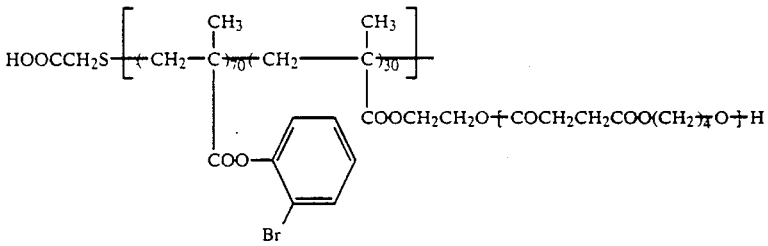

Synthesis Example 29 of Resin (A): A-29

A mixture of 70 g of 2-chlorophenyl methacrylate, 30 g of the compound MM-8 obtained in Synthesis Example 8 of macromonomer, 3.0 g of thioglycolic acid, and 200 g of toluene was heated to 75° C. under nitrogen gas stream and, after adding 1.5 g of A.I.B.N. to the reaction mixture, the mixture was stirred for 4 hours. Then, after adding 0.4 g of A.I.B.N. to the reaction mixture, the mixture was stirred for 2 hours and, after further adding thereto 0.2 g of A.I.B.N., the mixture was stirred for 3 hours to obtain the desired copolymer A-29 having a weight average molecular weight of $7.0\times10^3$.

A-29:

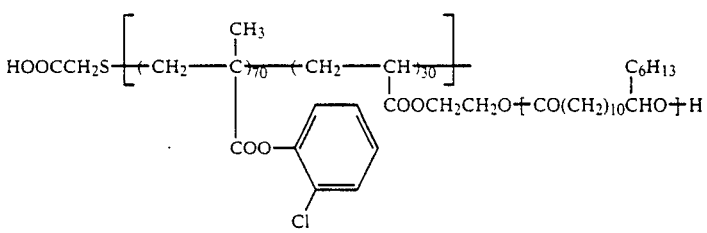

Synthesis Example 30 of Resin (A): A-30

A mixture of 50 g of n-butyl methacrylate, 50 g of the compound MM-7 obtained in Synthesis Example 7 of macromonomer and 200 g of toluene was heated to 80° C. under nitrogen gas stream and, after adding 6.0 g of 2,2'-azobis(isobutyronitrile) (A.I.B.N.) to the reaction mixture, the mixture was stirred for 4 hours. Then, after adding 3 g of A.I.B.N. to the reaction mixture, the mixture was stirred for 2 hours and, after further adding thereto 1 g of A.I.B.N., the mixture was stirred for 3 hours to obtain the desired copolymer A-30 having a weight average molecular weight of $7.8\times10^3$.

A-30:

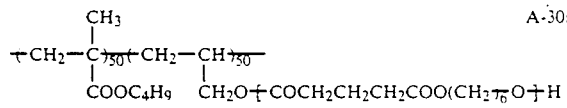

Synthesis Examples 31 to 40 of Resin (A): A-31 to A-40

By following the similar procedure to Synthesis Example 26 of Resin (A) described above, each of the resins (A) shown in Table 4 below was produced.

The weight average molecular weights of these resins were from $5\times10^3$ to $8\times10^3$.

TABLE 4

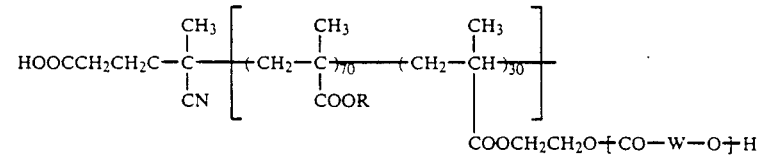

| Example of Resin (A) | R | —W— |
|---|---|---|
| A-31 | $-CH_3$ | $-CH_2CH_2CH_2COOCH_2C(CH_3)_2-CH_2-$ |
| A-32 | $-C_2H_5$ | $-CH_2CH_2COOCH_2CH(C_2H_5)CH_2-$ |

TABLE 4-continued

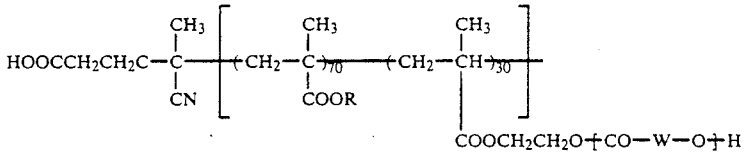

| Example of Resin (A) | R | —W— |
|---|---|---|
| A-33 | 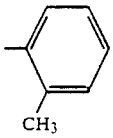 | $-(CH_2)_{10}CH(C_6H_{13})-$ |
| A-34 | 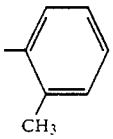 | $-CH_2CH_2-COO(CH_2)_4-$ |
| A-35 | 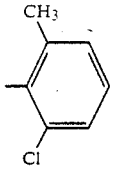 | $-CH_2CH_2COOCH_2-C(C_2H_5)_2-CH_2-$ |
| A-36 | $-CH_3$ | $-CH_2CH_2COOCH_2CH_2OCH_2CH_2-$ |
| A-37 | 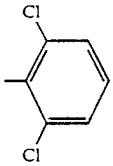 | $-(CH_2)_4COOCH(CH_3)-$ |
| A-38 | $-CH_2C_6H_5$ | $-C(CH_3)_2-CH_2-$ |
| A-39 | 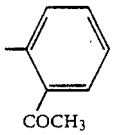 | $-(CH_2)_2-COO-(CH_2)_6-$ |
| A-40 | 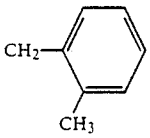 | $-CH=CH-COO-CH_2-CH(CH_3)-CH_2-$ |

Synthesis Examples 41 to 46 of Resin (A): A-41 to A-46

By following the same procedure as Synthesis Example 28 except that 3 g of each of the mercapto compounds (chain transfer agents) shown in Table 5 below was used in place of 3 g of thioglycolic acid, each of Resins A-41 to A-46 was produced.

TABLE 5

| Example of Resin (A) | Chain Transfer Agent | Weight Average Molecular Weight of Copolymer obtained |
|---|---|---|
| A-41 | $HS(CH_2)_2-COOH$ | 8,300 |
| A-42 | $HS-CH(CH_2-COOH)-COOH$ | 7,600 |

TABLE 5-continued

| Example of Resin (A) | Chain Transfer Agent | Weight Average Molecular Weight of Copolymer obtained |
|---|---|---|
| A-43 | 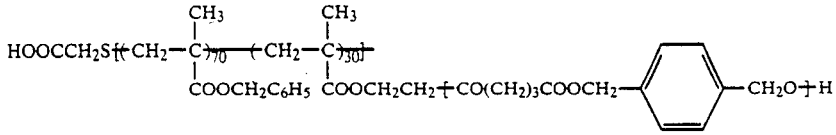 | 7,700 |
| A-44 | $HSCH_2CH_2SO_3H$ | 7,600 |
| A-45 | $HS(CH_2)_3O-P(=O)(OH)-OH$ | 7,800 |
| A-46 | $HS(CH_2)_2O-P(=O)(OC_2H_5)-OH$ | 8,000 |

Synthesis Example 47 of Resin (A): A-47

A mixture of 60 g of 2,6-dichlorophenyl methacrylate 40 g of the compound MM-5 obtained in Synthesis Example 5 of macromonomer, 2 g of thioglycolic acid, 150 g of toluene, and 50 g of ethanol was heated to 80° C. under nitrogen gas stream and, after adding 3 g of A.C.V. to the reaction mixture, the mixture was stirred for 4 hours. Then, 1.0 g of A.C.V. was added to the reaction mixture, the mixture was stirred for 4 hours to obtain the desired copolymer A-47 having a weight average molecular weight of $8.5\times10^3$.

A-47:

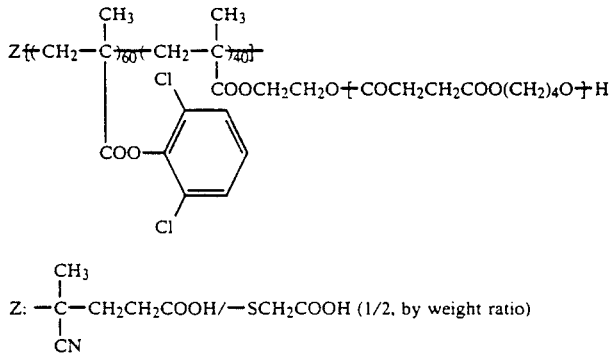

Synthesis Examples 48 and 49 of Resin (A): A-48 and A-49

By following the similar procedure to Synthesis Example 28, each of the following resins A-48 and A-49 was produced.

Resin A-48:

Weight average molecular weight: $8.6\times10^3$.

Resin A-49:

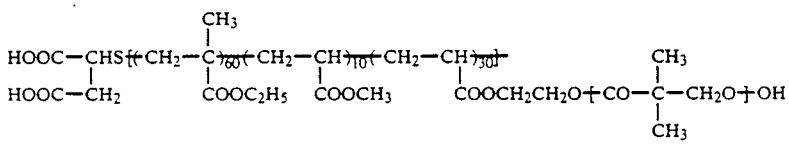

Weight average molecular weight: $8.1\times10^3$.

Production Examples of Macromonomers for Resin (B)

Production Example 1 of Macromonomer: M-1

A mixture of 95 g of methyl methacrylate, 5 g of thioglycolic acid, and 200 g of toluene was heated to 75° C. with stirring under nitrogen gas stream. After adding 1.0 g of 2,2'-azobis(cyanovaleric acid) (A.C.V.) to the reaction mixture, the reaction was carried out for 8 hours. Then, to the reaction mixture were added 8 g of glycidyl methacrylate, 1.0 g of N,N-dimethyldodecylamine, and 0.5 g of t-butylhydroquinone, and the resulting mixture was stirred for 12 hours at 100° C. After cooling, the reaction mixture was reprecipitated from 2 liters of methanol to obtain 82 g of the desired polymer M-1 as a white powder. The number average molecular weight thereof was 6,500.

Production Example 2 of Macromonomer: M-2

A mixture of 95 g of methyl methacrylate, 5 g of thioglycolic acid, and 200 g of toluene was heated to 70° C. with stirring under nitrogen gas stream, and, after adding 1.5 g of 2,2'-azobis(isobutyronitrile) (A.I.B.N.) to the reaction mixture, the reaction was carried out for 8 hours. To the reaction mixture were added 7.5 g of glycidyl methacrylate, 1.0 g of N,N-dimethyldodecylamine and 0.8 g of t-butylhydroquinone, and the resulting mixture was stirred for 12 hours at 100° C. After cooling, the reaction mixture was reprecipitated from 2 liters of methanol to obtain 85 g of the desired polymer M-2 as a colorless transparent viscous product. The number average molecular weight of the product was 2,400.

Production Example 3 of Macromonomer: M-3

A mixture of 94 g of propyl methacrylate, 6 g of 2-mercaptoethanol, and 200 g of toluene was heated to 70° C. under nitrogen gas stream, and, after adding 1.2 g of A.I.B.N. to the reaction mixture, the reaction was carried out for 8 hours.

Then, the reaction mixture was cooled to 20° C. in a water bath and, after adding thereto 10.2 g of triethylamine, 14.5 g of methacrylic acid chloride was added dropwise to the mixture with stirring at a temperature of not higher than 25° C. Thereafter, the resulting mixture was further stirred for one hour. Then, 0.5 g of t-butylhydroquinone was added thereto, and the mixture was stirred for 4 hours at 60° C. After cooling, the reaction mixture was reprecipitated from 2 liters of methanol to obtain 79 g of the desired polymer M-3 as a colorless transparent viscous product. The number average molecular weight thereof was 4,500.

Production Example 4 of Macromonomer: M-4

A mixture of 95 g of ethyl methacrylate and 200 g of toluene was heated to 70° C. under nitrogen gas stream and, after adding 5 g of 2,2'-azobis(cyanoheptanol) to the reaction mixture, the reaction was carried out for 8 hours. After cooling the reaction mixture to 20° C. in a water bath, 1.0 g of triethylamine and 21 g of methacrylic acid anhydride were added thereto, and the mixture was stirred for one hour at the temperature and then for 6 hours at 60° C. After cooling, the reaction mixture was reprecipitated from 2 liters of methanol to obtain 75 g of the desired polymer M-4 as a colorless transparent viscous product. The number average molecular weight of the product was 6,200.

Production Example 5 of Macromonomer: M-5

A mixture of 93 g of benzyl methacrylate, 7 g of 3-mercaptopropionic acid, 170 g of toluene, and 30 g of isopropanol was heated to 70° C. under nitrogen gas stream to form a uniform solution and, after adding thereto 2.0 g of A.I.B.N., the reaction was carried out for 8 hours. After cooling, the reaction mixture was reprecipitated from 2 liters of methanol, and the system was heated to 50° C. under reduced pressure to distil off the solvent. The viscous residue obtained was dissolved in 200 g of toluene and, after adding 16 g of glycidyl methacrylate, 1.0 g of N,N-dimethyldodecyl methacrylate, and 1.0 g of t-butylhydroquinone to the solution, the resulting mixture was stirred for 10 hours at 110° C. The reaction mixture was reprecipitated again from 2 liters of methanol to obtain the desired polymer M-5 as a light yellow viscous product. The number average molecular weight thereof was 3,400.

Production Example 6 of Macromonomer: M-6

A mixture of 95 g of propyl methacrylate, 5 g of thioglycolic acid and 200 g of toluene was heated to 70° C. with stirring under nitrogen gas stream and, after adding 1.0 g of A.I.B.N. to the reaction mixture, the reaction was carried out for 8 hours. Then, to the reaction mixture were added 13 g of glycidyl methacrylate, 1.0 g of N,N-dimethyldodecylamine, and 1.0 g of t-butylhydroquinone, and the resulting mixture was stirred for 10 hours at 110° C. After cooling, the reaction mixture was reprecipitated from 2 liters of methanol to obtain 86 g of the desired polymer M-6 as a white powder. The number average molecular weight thereof was 3,500.

Production Example 7 of Macromonomer: M-7

A mixture of 40 g of methyl methacrylate, 54 g of ethyl methacrylate, 6 g of 2-mercaptoethylamine, 150 g of toluene and 50 g of tetrahydrofuran was heated to 75° C. with stirring under nitrogen gas stream and, after adding 2.0 g of A.I.B.N. to the reaction mixture, the reaction was carried out for 8 hours.

Then, after cooling the reaction mixture to 20° C. in a water bath, 23 g of methacrylic anhydride was added dropwise to the reaction mixture in such a manner that the temperature did not exceed 25° C., and, then, the mixture was further stirred as it was. Then, 0.5 of 2,2'-methylenebis(6-t-butyl-p-cresol) was added to the reaction mixture, followed by stirring for 3 hours at 40° C. After cooling, the mixture was reprecipitated from 2 liters of methanol to obtain 83 g of the desired polymer M-7 as a viscous product. The number average molecular weight thereof was 2,200.

Production Example 8 of Macromonomer: M-8

A mixture of 95 g of 2-chlorophenyl methacrylate, 150 g of toluene, and 150 g of ethanol was heated to 75° C. under nitrogen gas stream and, after adding 5 g of A.C.V. to the mixture, the reaction was carried out for 8 hours. Then, after adding thereto 15 g of glycidyl acrylate, 1.0 g of N,N-dimethyldodecylamine, and 1.0 g of 2,2'-methylenebis-(6-t-butyl-p-cresol), the mixture was stirred for 15 hours at 100° C. After cooling, the reaction mixture was reprecipitated from 2 liters of methanol to obtain 83 g of the desired polymer M-8 as a transparent viscous product. The number average molecular weight thereof was 3,600.

Production Examples 9 to 18 of Macromonomer: M-9 to M-18

By following the same procedure as Production Example 4 except that each of the acid halide compounds shown in Table 6 below was used in place of methacrylic acid chloride, each of the macromonomers M-9 to M-18 was produced.

The number average molecular weights of the macromonomers obtained were from 4,000 to 5,000.

TABLE 6

| Production Example | Macromonomer | Acid Halide | Amount Used (g) | Yield (g) |
|---|---|---|---|---|
| 9 | M-9 | $CH_2=CH-COCl$ | 13.5 | 75 |
| 10 | M-10 | $CH_3$<br>\|<br>$CH=CH-COCl$ | 14.5 | 80 |

TABLE 6-continued

| Production Example | Macromonomer | Acid Halide | Amount Used (g) | Yield (g) |
|---|---|---|---|---|
| 11 | M-11 | 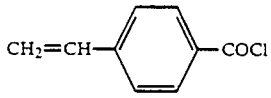 | 15.0 | 83 |
| 12 | M-12 | $CH_2{=}CH(COO(CH_2)_2COCl)$ | 15.5 | 73 |
| 13 | M-13 | $CH_2{=}C(CH_3)(COO(CH_2)_2OCO(CH_2)_2COCl)$ | 18.0 | 75 |
| 14 | M-14 | $CH_2{=}C(CH_3)(CONH(CH_2)_4COCl)$ | 18.0 | 80 |
| 15 | M-15 | 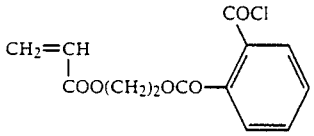 | 20.0 | 81 |
| 16 | M-16 | $CH_2{=}C(CH_3)(COOCH_2CH(Br)CH_2OCO(CH_2)_3COCl)$ | 20.0 | 78 |
| 17 | M-17 | $CH_2{=}CH{-}CH_2(OCO(CH_2)_2COCl)$ | 16.0 | 72 |
| 18 | M-18 | $CH_2{=}C(CH_2COOCH_3){-}COCl$ | 17.5 | 75 |

Production Examples 19 to 27 of Macromonomer: M-19 to M-27

By following the same procedure as Production Example 4 except that each of the monomers shown in Table 7 below was used in place of methyl methacrylate, each of the macromonomers M-19 to M-27 was produced.

TABLE 7

| Production Example | Macromonomer | Monomer (Amount) | | Weight Average Molecular Weight |
|---|---|---|---|---|
| 19 | M-19 | Ethyl methacrylate | 95 g | 2,800 |
| 20 | M-20 | Methyl methacrylate | 60 g | 3,200 |
| | | Butyl methacrylate | 35 g | |
| 21 | M-21 | Butyl methacrylate | 85 g | 3,300 |
| | | 2-Hydroxyethyl methacrylate | 10 g | |
| 22 | M-22 | Ethyl methacrylate | 75 g | 2,200 |
| | | Styrene | 20 g | |
| 23 | M-23 | Methyl methacrylate | 80 g | 2,500 |
| | | Methyl acrylate | 15 g | |
| 24 | M-24 | Ethyl acrylate | 75 g | 3,000 |
| | | Acrylonitrile | 20 g | |
| 25 | M-25 | Propyl methacrylate | 87 g | 2,200 |
| | | N,N-Dimethylaminoethyl methacrylate | 8 g | |
| 26 | M-26 | Butyl methacrylate | 90 g | 3,000 |
| | | N-Vinylpyrrolidone | 5 g | |
| 27 | M-27 | Methyl methacrylate | 89 g | |
| | | Dodecyl methacrylate | 6 g | 3,000 |

Production Example 28 of Macromonomer: M-28

A mixture of 95 g of methyl methacrylate, 5 g of thioglycolic acid, and 200 g of toluene was heated to 75° C. with stirring under nitrogen gas stream and, after adding 1.0 g of 2,2'-azobis(cyanovaleric acid) (A.C.V.) to the reaction mixture, the reaction was carried out for 8 hours. Then, to the reaction mixture were added 8 g of glycidyl methacrylate, 1.0 g of N,N-dimethyldodecylamine and 0.5 g of t-butylhydroquinone, and the mixture was stirred for 12 hours at 100° C. After cooling, the reaction mixture was re-precipitated from 2 liters of methanol to obtain 82 g of the desired polymer M 28 as a white powder. The number average molecular weight thereof was 6,500.

Production Example 29 of Macromonomer: M-29

A mixture of 95 g of methyl methacrylate, 5 g of thioglycolic acid, and 200 g of toluene was heated to 70° C. with stirring under nitrogen gas stream, and, after adding 1.5 g of A.I.B.N. to the reaction mixture, the reaction was carried out for 8 hours. Then, to the reaction mixture were added 7.5 g of glycidyl methacrylate, 1.0 g of N,N-dimethyldodecylamine and 0.8 g of t-butylhydroquinone, and the resulting mixture was stirred for 12 hours. at 100° C. After cooling, the reaction mixture was re-precipitated from 2 liters of methanol to obtain 85 g of the desired polymer M-29 as a colorless transparent viscous product. The number average molecular weight thereof was 2,400.

Production Example 30 of Macromonomer: M-30

A mixture of 94 g of propyl methacrylate, 6 g of 2-mercaptoethanol and 200 g of toluene was heated to 70° C. under nitrogen gas stream, and, after adding 1.2 g of A.I.B.N. to the mixture, the reaction was carried out for 8 hours.

Then, the reaction mixture was cooled to 20° C. in a water bath and after adding thereto 10.2 g of triethylamine, 14.5 g of methacrylic acid chloride was added dropwise to the mixture with stirring at 25° C. Thereafter, the mixture was further stirred for one hour. Then, 0.5 g of t-butylhydroquinone was added thereto, and the mixture was stirred for 4 hours at 60° C. After cooling, the reaction mixture was reprecipitated from 2 liters of methanol to obtain 79 g of the desired polymer M-30 as a colorless transparent viscous product. The number average molecular weight thereof was 4,500.

Production Example 31 of Macromonomer: M-31

A mixture of 95 g of ethyl methacrylate and 200 g of toluene was heated to 70° C. under nitrogen gas stream and, after adding 5 g of azobis(cyanoheptanol) to the reaction mixture, the reaction was carried out for 8 hours. After cooling the reaction mixture to 20° C. in water bath, 1.0 g of triethylamine and 21 g of methacrylic anhydride were added thereto, and the mixture was stirred for one hour at that temperature and then for 6 hours at 60° C.

After cooling, the resulting reaction product was reprecipitated from 2 liters of methanol to obtain 75 g of the desired polymer M-31 as a colorless transparent viscous product. The number average molecular weight of the product was 6,200.

Production Example 32 of Macromonomer: M-32

A mixture of 93 g of benzyl methacrylate and 7 g of 3-mercaptopropionic acid, 170 g of toluene and 30 g of isopropanol was heated to 70° C. under nitrogen gas stream to form a uniform solution, and, after adding 2.0 g of A.I.B.N. to the solution, the reaction was carried out for 8 hours. After cooling, the reaction mixture was reprecipitated from 2 liters of methanol, and the system was heated to 50° C. under reduced pressure to distil off the solvent. The viscous residue obtained was dissolved in 200 g of toluene and, after adding 16 g of glycidyl methacrylate, 1.0 g of N,N-dimethyldodecyl methacrylate and 1.0 g of t-butylhydroquinone to the solution, the resulting mixture was stirred for 10 hours at 110° C. The reaction mixture was reprecipitated again from 2 liters of methanol to obtain the desired polymer M-32 as a light yellow viscous product. The number average molecular weight of the product was 3,400.

Production Example 33 of Macromonomer: M-33

A mixture of 95 g of propyl methacrylate, 5 g of thioglycolic acid, and 200 g of toluene was heated to 70° C. with stirring under nitrogen gas stream and, after adding 1.0 g of A.I.B.N. to the reaction mixture, the reaction was carried out for 8 hours. Then, to the reaction mixture were added 13 g of glycidyl methacrylate, 1.0 g of N,N-dimethyldodecylamine and 1.0 g of t-butylhydroquinone, and the mixture was stirred for 10 hours at 110° C. After cooling, the reaction mixture thus obtained was reprecipitated from 2 liters of methanol to obtain 86 g of the desired polymer M 33 as a white powder. The number average molecular weight of the product was 3,500.

Production Example 34 of Macromonomer: M-34

A mixture of 40 g of methyl methacrylate, 54 g of ethyl methacrylate, 6 g of 2-mercaptoethylamine, 150 g of toluene and 50 g of tetrahydrofuran was heated to 75° C. with stirring under nitrogen gas stream and, after adding 2.0 g of A.I.B.N. to the reaction mixture, the reaction was carried out for 8 hours. Then, after cooling the reaction mixture to 20° C. in a water bath, 23 g of methacrylic anhydride was added dropwise to the reaction mixture in such a manner that the temperature did not exceed 25° C., and the mixture was stirred for one hour. Then, after adding thereto 0.5 g of 2,2'-methylenebis(6-t-butyl-p-cresol), the mixture was stirred for 3 hours at 40° C. After cooling, the reaction mixture was reprecipitated from 2 liters of methanol to obtain 83 g of the desired polymer M-34 as a viscous product. The number average molecular weight of the product was 2,200.

Production Example 35 of Macromonomer: M-35

A mixture of 95 g of 2-chlorophenyl methacrylate, 150 g of toluene and 150 g of ethanol was heated to 75° C. under nitrogen gas stream and, after adding 5 g of A.C.V. to the reaction mixture, the reaction was carried out for 8 hours. Then, after adding thereto 15 g of glycidyl acrylate, 1.0 g of N,N-dimethyldodecylamine and 1.0 g of 2,2'-methylenebis(6-t-butyl-p-cresol), the mixture was stirred for 15 hours at 100° C. After cooling, the reaction mixture thus obtained was reprecipitated from 2 liters of methanol to obtain the desired polymer M-35 as a transparent viscous product. The number average molecular weight thereof was 3.600.

Production Examples 36 to 45 of Macromonomer: M-36 to M-45

By following the same procedure as Production Example 30 of macromonomer except that each of the acid halide compounds shown in Table 9 was used in place of methacrylic acid chloride, each of the macromonomers M-36 to M-45 was produced. The number average molecular weights of these macromonomers were from 4,000 to 5,000.

TABLE 9

| Production Example | Macromonomer | Acid Halide | Amount Used (g) | Yield (g) |
|---|---|---|---|---|
| 36 | M-36 | $CH_2=CH-COCl$ | 13.5 | 75 |
| 37 | M-37 | $CH_3$<br>\|<br>$CH=CH-COCl$ | 14.5 | 80 |
| 38 | M-38 | 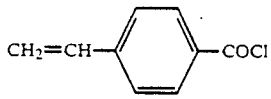 | 15.0 | 83 |
| 39 | M-39 | $CH_2=CH$<br>\|<br>$COO(CH_2)_2COCl$ | 15.5 | 73 |
| 40 | M-40 | $CH_3$<br>\|<br>$CH_2=C$<br>\|<br>$COO(CH_2)_2OCO(CH_2)_2COCl$ | 18.0 | 75 |
| 41 | M-41 | $CH_3$<br>\|<br>$CH_2=C$<br>\|<br>$CONH(CH_2)_4COCl$ | 18.0 | 80 |
| 42 | M-42 | 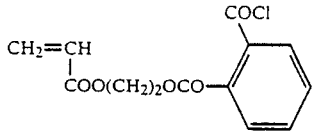 | 20.0 | 81 |
| 43 | M-43 | $CH_3$<br>\|<br>$CH_2=C$ Br<br>\| \|<br>$COOCH_2CHCH_2OCO(CH_2)_3COCl$ | 20.0 | 78 |
| 44 | M-44 | $CH_2=CH-CH_2$<br>\|<br>$OCO(CH_2)_2COCl$ | 16.0 | 72 |
| 45 | M-45 | $CH_2=C-COCl$<br>\|<br>$CH_2COOCH_3$ | 17.5 | 75 |

Production Examples 46 to 54 of Macromonomer: M-46 to M-54

By following the same procedure as Production Example 29 except that each of the monomers shown in Table 10 below was used in place of methyl methacrylate, each of the macromonomers M-46 to M-54 was produced.

TABLE 10

| Production Example | Macromonomer | Monomer (Amount) | | Weight Average Molecular Weight |
|---|---|---|---|---|
| 46 | M-46 | Ethyl methacrylate | 95 g | 2,800 |
| 47 | M-47 | Methyl methacrylate | 60 g | 3,200 |
| | | Butyl methacrylate | 35 g | |
| 48 | M-48 | Butyl methacrylate | 85 g | 3,300 |
| | | 2-Hydroxyethyl methacrylate | 10 g | |
| 49 | M-49 | Ethyl methacrylate | 75 g | 2,200 |
| | | Styrene | 20 g | |
| 50 | M-50 | Methyl methacrylate | 80 g | 2,500 |
| | | Methyl acrylate | 15 g | |
| 51 | M-51 | Ethyl acrylate | 75 g | 3,000 |
| | | Acrylonitrile | 20 g | |
| 52 | M-52 | Propyl methacrylate | 87 g | 2,200 |
| | | N,N-Dimethylaminoethyl methacrylate | 8 g | |
| 53 | M-53 | Butyl methacrylate | 90 g | 3,000 |
| | | N-Vinylpyrrolidone | 5 g | |
| 54 | M-54 | Methyl methacrylate | 89 g | 3,000 |
| | | Dodecyl methacrylate | 6 g | 3,000 |

Production Examples of Resin (B)

Production Example 1 of Resin (B): Resin B-1

A mixture of 70 g of ethyl methacrylate, 30 g of Macromonomer M-1, and 150 g of toluene was heated to 70° C. under nitrogen gas stream. Then, after adding 0.5 g of A.I.B.N. to the reaction mixture, the reaction was carried out for 4 hours and, after further adding thereto 0.3 g of A.I.B.N., the reaction was carried out for 6 hours to obtain the desired copolymer B-1.

The weight average molecular weight of the product was $9.8\times10^4$ and the glass transition point thereof was 72° C.

B-1:

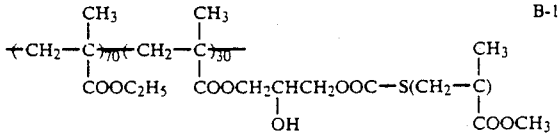

Production Examples 2 to 15 of Resin (B): B-2 to B-15

By following the similar procedure to Production Example 1 of Resin (B), each of the resins (B) shown in Table 11 below was produced. The weight average molecular weights of the resins were in the range of from $8\times10^4$ to $1.5\times10^5$.

TABLE 11

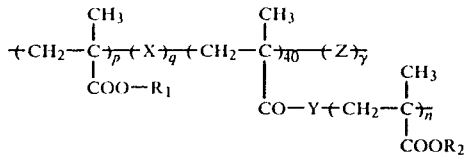

| Production Example of Resin (B) | Resin (B) | $R_1$ | p | $\leftarrow X \rightarrow$ | q | Y | $R_2$ | Z | $\gamma$ |
|---|---|---|---|---|---|---|---|---|---|
| 2 | B-2 | $-CH_3$ | 60 | — | 0 | $-OCH_2CH(OH)CH_2OOC-CH_2-S-$ | $-C_4H_9$ | — | 0 |
| 3 | B-3 | 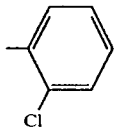 | 60 | — | 0 | " | $-C_3H_7$ | — | 0 |
| 4 | B-4 | $-C_2H_5$ | 60 | — | 0 | " | $-C_2H_5$ | — | 0 |
| 5 | B-5 | $-C_2H_5$ | 50 | $\leftarrow CH_2-CH \rightarrow$ 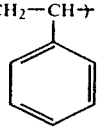 | 10 | $-OCH_2CH(OH)CH_2OOC-CH_2-S-$ | $-C_2H_5$ | — | 0 |
| 6 | B-6 | 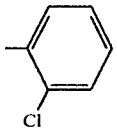 | 50 | $\leftarrow CH_2-CH(COOCH_3) \rightarrow$ | 10 | " | " | — | 0 |
| 7 | B-7 | $-CH_2C_6H_5$ | 60 | — | 0 | " | " | — | 0 |
| 8 | B-8 | $-C_2H_5$ | 59.2 | $\leftarrow CH_2-CH(COOCH_3) \rightarrow$ | 10 | $-OCH_2CH(OH)CH_2OOC-CH_2-S-$ | $-C_2H_5$ | $\leftarrow CH_2-CH(COOH) \rightarrow$ | 0.8 |
| 9 | B-9 | $-C_2H_5$ | 45 | $\leftarrow CH_2-CH(CN) \rightarrow$ | 15 | $-OCH_2CH_2-S-$ | 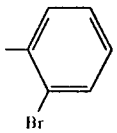 | — | 0 |

TABLE 11-continued
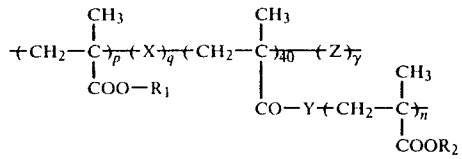
| Production Example of Resin (B) | Resin (B) | $R_1$ | p | $\leftarrow X \rightarrow$ | q | Y | $R_2$ | Z | γ |
|---|---|---|---|---|---|---|---|---|---|
| 10 | B-10 | $-CH_3$ | 49.5 | 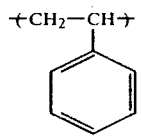 | 10 | $-NHCH_2CH_2-S-$ | $-C_4H_9$ | 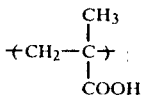 | 0.5 |
| 11 | B-11 | 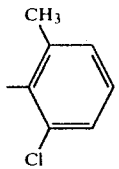 | 57 | — | 0 | 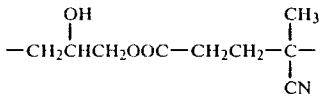 | $-CH_2C_6H_5$ | 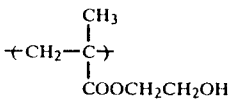 | 3 |
| 12 | B-12 | $-C_3H_7$ | 45 | 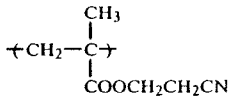 | 15 | " | $-C_2H_5$ | — | 0 |
| 13 | B-13 | $-C_2H_5$ | 40 | 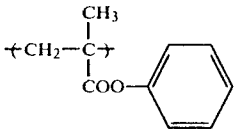 | 15 | 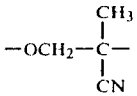 | $-C_3H_7$ | 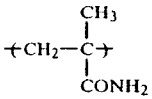 | 5 |
| 14 | B-14 | $-CH_3$ | 49.5 | 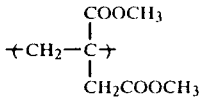 | 10 | 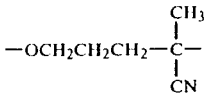 | $-C_4H_9$ | 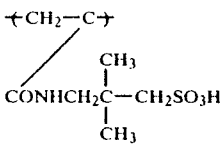 | 0.5 |

TABLE 11-continued
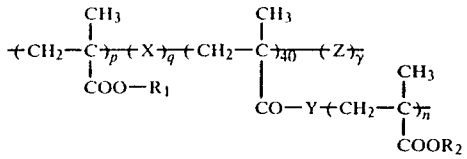
| Production Example of Resin (B) | Resin (B) | $R_1$ | p | $\leftarrow X \rightarrow$ | q | Y | $R_2$ | Z | $\gamma$ |
|---|---|---|---|---|---|---|---|---|---|
| 15 | B-15 | $-C_3H_7$ | 50 | $\leftarrow CH_2-CH \rightarrow$ 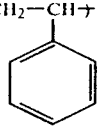 | 10 | $-OCH_2CHCH_2OOC-CH_2CH_2-S-$ (OH) | 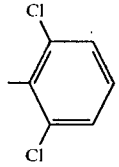 | — | 0 |

Production Example 16 of Resin (B): B-16

A mixture of 70 g of ethyl methacrylate, 30 g of Macromonomer M-2, 150 g of toluene and 50 g of isopropanol was heated to 70° C. and, after adding 0.8 g of 4,4'-azobis(4-cyanovaleric acid) to the reaction mixture, the reaction was carried out for 10 hours to obtain the desired copolymer B-16. The weight average molecular weight of the product was $9.8\times10^4$ and the glass transition point thereof was 72° C.

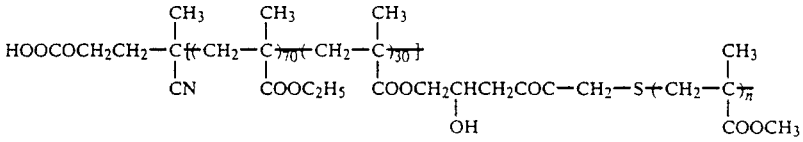

Production Examples 17 to 24 of Resin (B): B-17 to B-24

By following the same procedure as Production Example 16 of Resin (B) except that each of the macromonomers shown in Table 12 below was used in place of Macromonomer M-2, each of the resins B-17 to B-24 was produced.

The weight average molecular weights of these resins were from $9\times10^4$ to $1.2\times10^5$.

TABLE 12

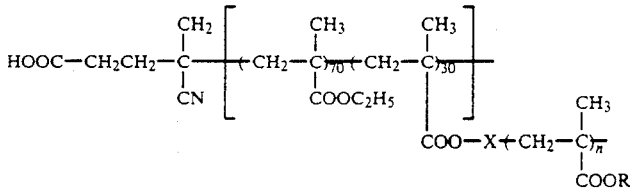

| Production Example of Resin (B) | Resin (B) | Macro-monommer | —X— | —R |
|---|---|---|---|---|
| 17 | B-17 | M-3 | $-CH_2CH_2-S-$ | $-C_4H_9$ |
| 18 | B-18 | M-4 | $-CH_2CH_2CH_2C(CH_3)(CN)-$ | $-C_2H_5$ |
| 19 | B-19 | M-5 | $-CH_2CH_2-S-$ | $-CH_2C_6H_5$ |
| 20 | B-20 | M-6 | $-CH_2CH(OH)CH_2OOC-CH_2-S-$ | $-C_3H_7$ |
| 21 | B-21 | M-28 | $-CH_2CH(OH)CH_2OOC-CH_2-S-$ | 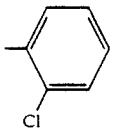 |
| 22 | B-22 | M-29 | " | $-C_4H_9$ |
| 23 | B-23 | M-30 | " | $-CH_2C_6H_5$ |
| 24 | B-24 | M-32 | " | $-C_6H_5$ |

Production Examples 25 to 31 of Resin (B): B-25 to B-31

By following the same procedure as Production Example 16 of Resin (B) except that each of the azobis compounds shown in Table 13 below was used in place of A.C.V., each of the resins B-25 to B-31 was produced.

TABLE 13

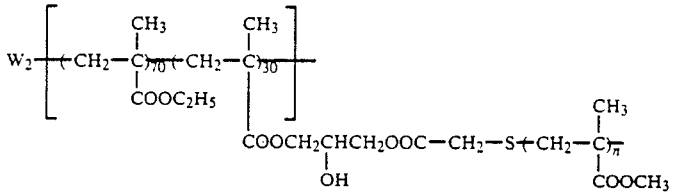

| Production Example of Resin (B) | Resin (B) | Azobis Compound | $W_2$— | Mw |
|---|---|---|---|---|
| 25 | B-25 | 2,2'-Azobis(2-cyanopropanol) | $HOCH_2-C(CH_3)(CN)-$ | $10.5 \times 10^4$ |
| 26 | B-26 | 2,2'-Azobis(2-cyanobuthanol) | $HOCH_2CH_2CH_2C(CH_3)(CN)-$ | $10 \times 10^4$ |
| 27 | B-27 | 2,2'-Azobis{2-methyl-N-[1,1-bis-(hydroxymethyl)-2-hydroxyethyl]-propionamide} | $HOH_2C-C(CH_2OH)_2-NHCO-C(CH_3)_2-$ | $9 \times 10^4$ |
| 28 | B-28 | 2,2'-Azobis[2-methyl-N-(2-hydroxy-ethyl)propionamide] | $HOCH_2CH_2-NHCO-C(CH_3)(CN)-$ | $9.5 \times 10^4$ |
| 29 | B-29 | 2,2'-Azobis{2-methyl-N-[1,1-bis-(hydroxymethyl)ethyl]propionamide} | $CH_3-C(CH_2OH)_2-NHCO-C(CH_3)_2-$ | $8.5 \times 10^4$ |
| 30 | B-30 | 2,2'-Azobis[2-(5-hydroxy-3,4,5,6-tetrahydropyrimidin-2-yl)propane] | | $8.0 \times 10^4$ |
| 31 | B-31 | 2,2'-Azobis{2-[1-(2-hydroxyethyl)-2-imidazolin-2-yl]propane} | | $7.5 \times 10^4$ |

Production Example 32 of Resin (B): B-32

A mixture of 80 g of butyl methacrylate, 20 g of Macromonomer M-8, 1.0 g of thioglycolic acid, 100 g of toluene, and 50 g of isopropanol was heated to 80° C. under nitrogen gas stream and, after adding 0.5 g of 1,1-azobis(cyclohexane-1-carbonitrile) (A.C.H.N.) to the reaction mixture, the mixture was stirred for 4 hours. Then, after further adding thereto 0.3 g of A.C.H.N., the mixture was stirred for 4 hours to obtain the desired resin B-32 having a weight average molecular weight of $8.0 \times 10^4$ and a glass transition point of 41° C.

Resin B-32:

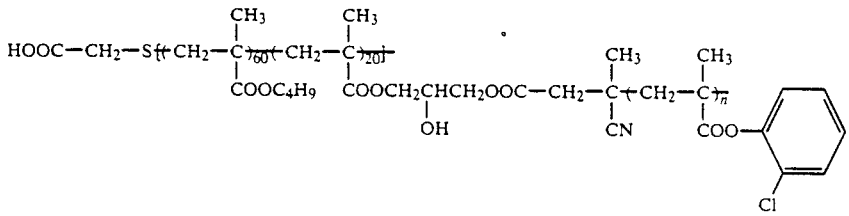

Production Examples 33 to 39 of Resin (B): B-33 to B-39

By following the same procedure as Production Example 32 of Resin (B) except that each of the compounds shown in Table 14 was used in place of thioglycolic acid, the polymers (resins) B-33 to B-39 was produced.

Production Examples 40 to 48 of Resin (B): B-40 to B-48

TABLE 14

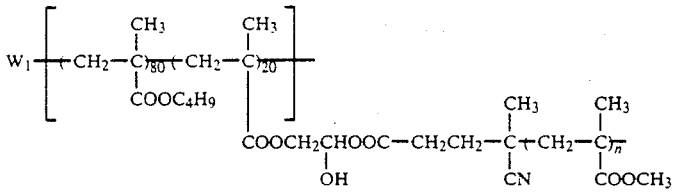

| Production Example of Resin (B) | Resin (B) | Mercaptan Compound | $W_1$— | Mw |
|---|---|---|---|---|
| 33 | B-33 | 3-Mercaptopropionic acid | $HOOC—CH_2CH_2—S—$ | $8.5 \times 10^4$ |
| 34 | B-34 | 2-Mercaptosuccinic acid | $HOOC—HC(HOOC—CH_2)—S—$ | $10 \times 10^4$ |
| 35 | B-35 | Thiosalicyclic acid | 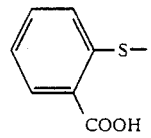 | $9 \times 10^4$ |
| 36 | B-36 | 2-Mercaptoethanesulfonic acid pyridine salt | 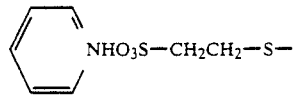 | $8 \times 10^4$ |
| 37 | B-37 | $HSCH_2CH_2CONHCH_2COOH$ | $HOOCH_2CNHCOCH_2CH_2—S—$ | $9.5 \times 10^4$ |
| 38 | B-38 | 2-Mercaptoethanol | $HO—CH_2CH_2—S—$ | $9 \times 10^4$ |
| 39 | B-39 | $HSCH_2CH_2COOCH_2CH_2—O—P(=O)(OH)—OH$ | $HO—P(=O)(OH)—OCH_2CH_2COOCH_2CH_2—S—$ | $10.5 \times 10^4$ |

By following the similar procedure to Production Example 26 of Resin (B), each of the copolymers shown in Table 15 below was produced.

The weight average molecular weights of these resins were in the range of from $9.5 \times 10^4$ to $1.2 \times 10^5$.

TABLE 15

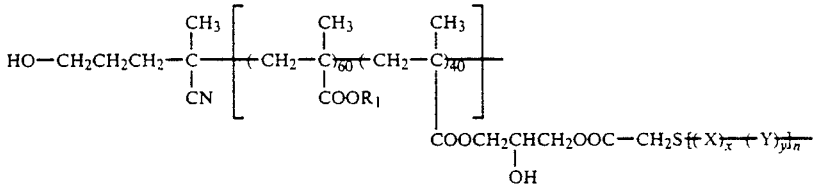

| Production Example of Resin (B) | Resin (B) | $R_1$ | X | x | Y | y |
|---|---|---|---|---|---|---|
| 40 | B-40 | $—C_2H_5$ | 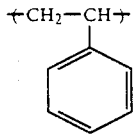 | 20 | 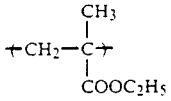 | 80 |

TABLE 15-continued

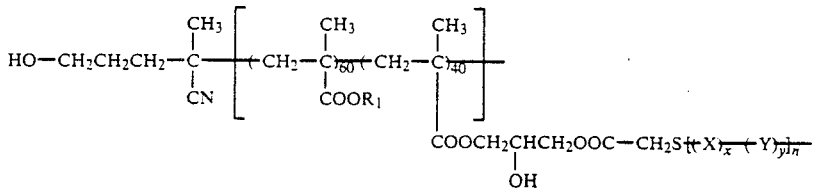

| Production Example of Resin (B) | Resin (B) | $R_1$ | X | x | Y | y |
|---|---|---|---|---|---|---|
| 41 | B-41 | $-C_2H_5$ | 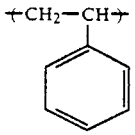 | 40 | 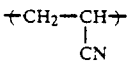 | 60 |
| 42 | B-42 | $-C_2H_5$ | 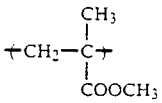 | 90 | 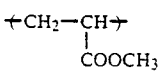 | 10 |
| 43 | B-43 | $-C_3H_7$ | 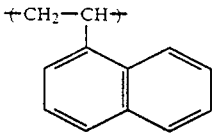 | 100 | — | 0 |
| 44 | B-44 | $-C_3H_7$ | 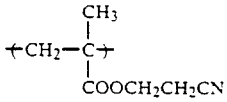 | 50 | 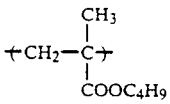 | 50 |
| 45 | B-45 | $-C_2H_5$ | 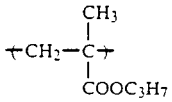 | 85 | 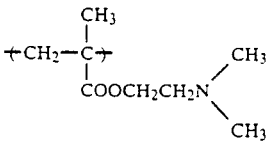 | 75 |
| 46 | B-46 | $-C_2H_5$ | 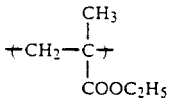 | 90 | 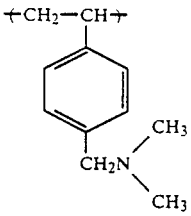 | 10 |
| 47 | B-47 | $-C_3H_7$ | 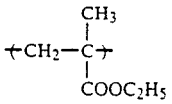 | 90 | 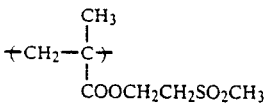 | 10 |
| 48 | B-48 | $-C_2H_5$ | 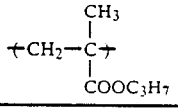 | 75 | 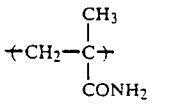 | 15 |

Production Examples 49 to 56 of Resin (B): B-49 to B-56

By following the similar procedure to Production Example 16 of Resin (B), each of the resins shown in Table 16 below was produced.

The weight average molecular weights of these resins were in the range of from $9.5\times10^4$ to $1.1\times10^5$.

TABLE 16

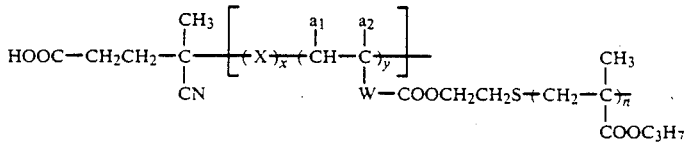

| Production Example of Resin (B) | Resin (B) | —X— | $a_1$ | $a_2$ | —W— | x/y (Weight Ratio) | Macro-monomer Used |
|---|---|---|---|---|---|---|---|
| 49 | B-49 | $-CH_2-C(CH_3)(COOC_2H_5)-$ | H | H | — | 80/20 | M-9 |
| 50 | B-50 | " | $CH_3$ | H | — | 70/30 | M-10 |
| 51 | B-51 | $-CH_2-CH-$ 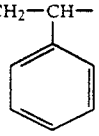 | H | H | 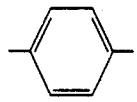 | 60/40 | M-11 |
| 52 | B-52 | $-CH_2-C(CH_3)(COOC_2H_5)-$ | H | H | $-COOCH_2CH_2-$ | 80/20 | M-12 |
| 53 | B-53 | $-CH_2-C(CH_3)(COOC_2H_5)-$ | H | $CH_3$ | $-COO(CH_2)_2OCO(CH_2)_2-$ | 80/20 | M-13 |
| 54 | B-54 | $-CH_2-C(CH_3)(COOCH_2C_6H_5)-$ | H | $CH_3$ | $-CONH(CH_2)_4-$ | 80/20 | M-14 |
| 55 | B-55 | $-CH_2-C(CH_3)(COOCH_3)-$ | H | H | $-COO(CH_2)_2OCO-$ 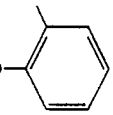 | 50/50 | M-15 |
| 56 | B-56 | $-CH_2-CH-$ 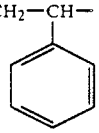 | H | H | $-CH_2OCO(CH_2)_2-$ | 80/20 | M-17 |

Production Example 57 of Resin (8): B-52

A mixture of 70 g of ethyl methacrylate, 30 g of Macromonomer M-28 and 150 g of toluene was heated to 70° C. under nitrogen gas stream, and, after adding 0.5 g of A.I.B.N. to the reaction mixture, the reaction was carried out for 4 hours. Then, after further adding thereto 0.3 g of A.I.B.N., the reaction was carried out for 6 hours to obtain the copolymer B-52 having a weight average molecular weight of $9.8\times10^4$ and a glass transition point of 72° C.

Resin B-52:

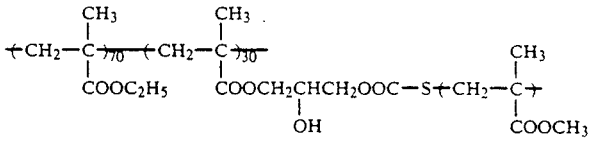

Production Examples 58 to 71 of Resin (B): B-58 to B-71

By following the similar procedure to Production Example 57 of Resin (B), each of the resins shown in Table 17 below was produced. The weight average molecular weights of these resins were in the range of from $8\times10^4$ to $1.5\times10^5$.

TABLE 17

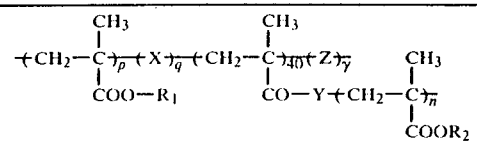

| Production Example of Resin (B) | Resin (B) | $R_1$ | p | $\leftarrow X \rightarrow$ | q | Y | $R_2$ | Z | γ |
|---|---|---|---|---|---|---|---|---|---|
| 58 | B-58 | $-CH_3$ | 60 | — | 0 | $-OCH_2CH(OH)CH_2OOC-CH_2-S-$ | $-C_4H_9$ | — | 0 |
| 59 | B-59 | 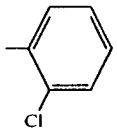 | 60 | — | 0 | " | $-C_3H_7$ | — | 0 |
| 60 | B-60 | $-C_2H_5$ | 60 | — | 0 | " | $-C_2H_5$ | — | 0 |
| 61 | B-61 | $-C_2H_5$ | 50 | $\leftarrow CH_2-CH(C_6H_5)\rightarrow$ | 10 | $-OCH_2CH(OH)CH_2OOC-CH_2-S-$ | $-C_2H_5$ | — | 0 |
| 62 | B-62 | 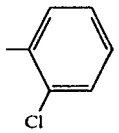 | 50 | $\leftarrow CH_2-CH(COOCH_3)\rightarrow$ | 10 | " | " | — | 0 |
| 63 | B-63 | $-CH_2C_6H_5$ | 60 | — | 0 | " | " | — | 0 |
| 64 | B-64 | $-C_2H_5$ | 59.2 | $\leftarrow CH_2-CH(COOCH_3)\rightarrow$ | 10 | $-OCH_2CH(OH)CH_2OOC-CH_2-S-$ | $-C_2H_5$ | $\leftarrow CH_2-CH(COOH)\rightarrow$ | 0.8 |
| 65 | B-65 | $-C_2H_5$ | 45 | $\leftarrow CH_2-CH(CN)\rightarrow$ | 15 | $-OCH_2CH_2-S-$ | 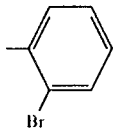 | — | 0 |

TABLE 17-continued
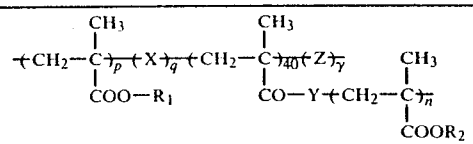
| Production Example of Resin (B) | Resin (B) | $R_1$ | p | X | q | Y | $R_2$ | Z | γ |
|---|---|---|---|---|---|---|---|---|---|
| 66 | B-66 | $-CH_3$ | 49.5 | 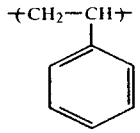 | 10 | $-NHCH_2CH_2-S-$ | $-C_4H_9$ | 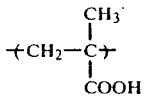 | 0.5 |
| 67 | B-67 | 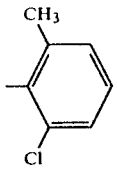 | 57 | — | 0 | 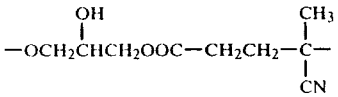 | $-CH_2C_6H_5$ | 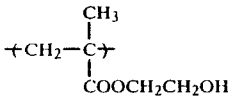 | 3 |
| 68 | B-68 | $-C_3H_7$ | 45 | 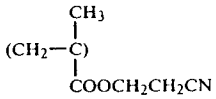 | 15 | " | $-C_2H_5$ | — | 0 |
| 69 | B-69 | $-C_2H_5$ | 40 | 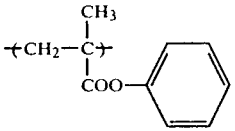 | 15 | 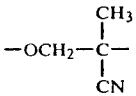 | $-C_3H_7$ | 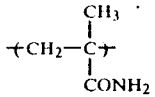 | 5 |
| 70 | B-70 | $-CH_3$ | 49.5 | 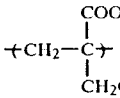 | 10 | 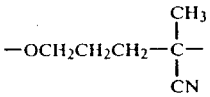 | $-C_4H_9$ | 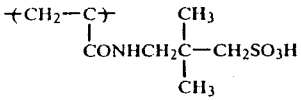 | 0.5 |
| 71 | B-71 | $-C_3H_7$ | 50 | 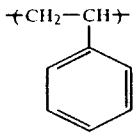 | 10 | 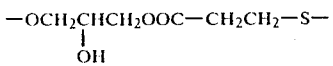 | 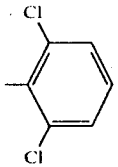 | — | 0 |

Production Example 72 of Resin (B): B-72

A mixture of 70 g of ethyl methacrylate, 30 g of Macromonomer M-29, 150 g of toluene and 50 g of isopropanol was heated to 70° C. under nitrogen gas stream and, after adding 0.8 g of 4,4'-azobis(4-cyanovaleric acid) to the reaction mixture, the reaction was carried out for 10 hours to obtain the desired copolymer B-72 having a weight average molecular of $9.8\times10^4$ and a glass transition point of 72° C.

Resin B-72:

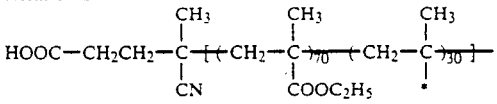

-continued

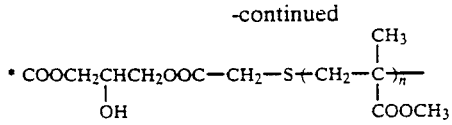

Production Examples 73 to 80 of Resin (B): B-73 to B-80

By following the same procedure as Production Example 72 of Resin (B) except that each of the macromonomers shown in Table 18 below was produced.

The weight average molecular weights of these resins were in the range of from $9\times10^4$ to $1.2\times10^5$.

TABLE 18

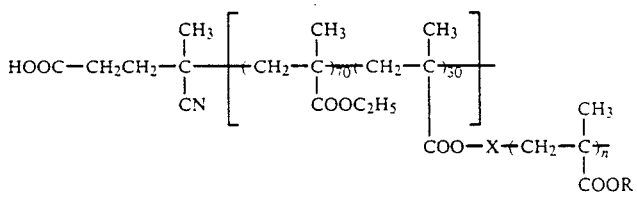

| Production Example of Resin (B) | Resin (B) | Macro-monomer | —X— | —R |
|---|---|---|---|---|
| 73 | B-73 | M-30 | $-CH_2CH_2-S-$ | $-C_4H_9$ |
| 74 | B-74 | M-31 | $-CH_2CH_2CH_2C(CH_3)(CN)-$ | $-C_2H_5$ |
| 75 | B-75 | M-32 | $-CH_2CH_2-S-$ | $-CH_2C_6H_5$ |
| 76 | B-76 | M-33 | $-CH_2CH(OH)CH_2OOC-CH_2-S-$ | $-C_3H_7$ |
| 77 | B-77 | M-28 | $-CH_2CH(OH)CH_2OOC-CH_2-S-$ | 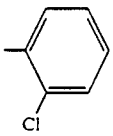 |
| 78 | B-78 | M-29 | " | $-C_4H_9$ |
| 79 | B-79 | M-30 | " | $-CH_2C_6H_5$ |
| 80 | B-80 | M-32 | " | $-C_6H_5$ |

Production Examples 81 to 87 of Resin (B): B-81 to B-87

By following the same procedure as Production Example 72 of Resin (B) except that each of the azobis compounds shown in Table 19 below was used in place of A.C.V., each of the resins shown in the table was produced.

TABLE 19

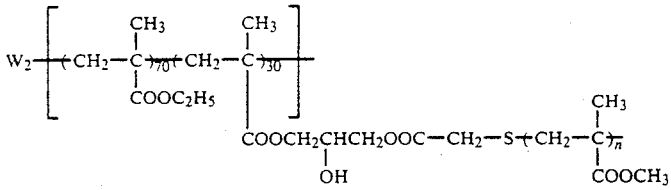

| Production Example of Resin (B) | Resin (B) | Azobis Compound | $W_2$— | $\overline{M}w$ |
|---|---|---|---|---|
| 81 | B-81 | 2,2'-Azobis(2-cyanopropanol) | 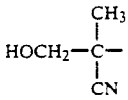 | $10.5 \times 10^4$ |
| 82 | B-82 | 2,2'-Azobis(2-cyanobuthanol) | 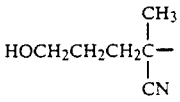 | $10 \times 10^4$ |
| 83 | B-83 | 2,2'-Azobis{2-methyl-N-[1,1-bis-(hydroxymethyl)-2-hydroxymethyl]-propionamide} | 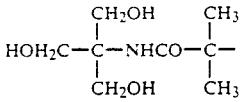 | $9 \times 10^4$ |
| 84 | B-84 | 2,2'-Azobis[2-methyl-N-(2-hydroxy-ethyl)propionamide] | 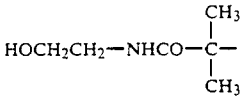 | $9.5 \times 10^4$ |
| 85 | B-85 | 2,2'-Azobis{2-methyl-N-[1,1-bis-(hydroxymethyl)ethyl]propionamide} | 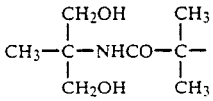 | $8.5 \times 10^4$ |
| 86 | B-86 | 2,2'-Azobis[2-(5-hydroxy-3,4,5,6-tetrahydropyrimidin-2-yl]propane | 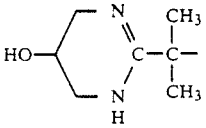 | $8.0 \times 10^4$ |
| 87 | B-87 | 2,2'-Azobis{2-[1-(2-hydroxyethyl)-2-imidazolin-2-yl]propane} | 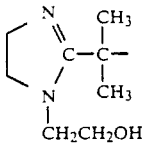 | $7.5 \times 10^4$ |

Production Example 88 of Resin (B): B-88

A mixture of 80 g of butyl methacrylate, 20 g of Macromonomer M-35, 1.0 g of thioglycolic acid, 100 g of toluene, and 50 g of isopropanol was heated to 80° C. under nitrogen gas stream, and, after adding 0.5 g of 1,1-azobis(cyclohexane-1-carbonitrile) (A.C.H.N.), the mixture was stirred for 4 hours. Then, after further adding thereto 0.3 g of A.C.H.N., the mixture was stirred for 4 hours to obtain the desired polymer B-88 having a weight average molecular weight of $8.0 \times 10^4$ and a glass transition point of 41° C.

Resin B-88:

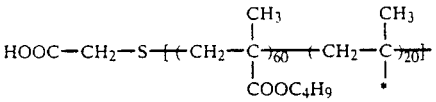

-continued

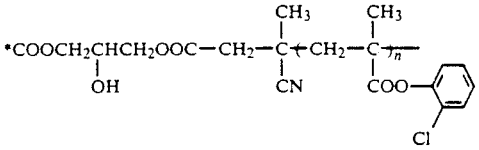

Production Examples 89 to 95 of Resin (B): B-89 to B-95

By following the same procedure as Production Example 88 of Resin (B) except that each of the compounds shown in Table 20 below was used in place of thioglycolic acid, each of the resins (B) shown in the table was produced.

TABLE 20

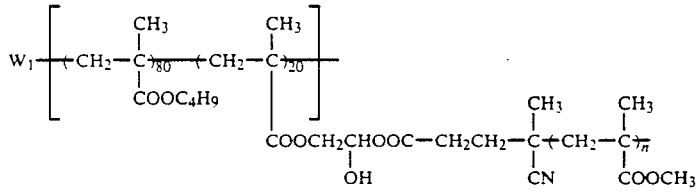

| Production Example of Resin (B) | Resin (B) | Mercaptan Compound | $W_1$— | Mw |
|---|---|---|---|---|
| 89 | B-89 | 3-Mercaptopropionic acid | HOOC—$CH_2CH_2$—S— | $8.5 \times 10^4$ |
| 90 | B-90 | 2-Mercaptosuccinic acid | HOOC—HC(HOOC—$CH_2$)—S— | $10 \times 10^4$ |
| 91 | B-91 | Salicylic acid | 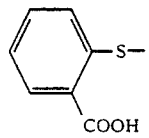 | $9 \times 10^4$ |
| 92 | B-92 | 2-Mercaptoethanesulfonic acid pyridine salt | 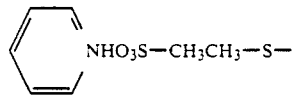 | $8 \times 10^4$ |
| 93 | B-93 | $HSCH_2CH_2CONHCH_2COOH$ | $HOOCH_2CNHCOCH_2CH_2$—S— | $9.5 \times 10^4$ |
| 94 | B-94 | 2-Mercaptoethanol | HO—$CH_2CH_2$—S— | $9 \times 10^4$ |
| 95 | B-95 | $HSCH_2CH_2COOCH_2CH_2$—O—P(=O)(OH)—OH | HO—P(=O)(OH)—$OCH_2CH_2OOCCH_2CH_2$—S— | $10.5 \times 10^4$ |

Production Examples 96 to 104 of Resin: B 96 to B-104

By following the similar procedure to Production Example 72 of Resin (B). each of the resins (copolymers) shown in Table 21 below was produced.

The weight average molecular weights of the resins were in the range of from $9.5 \times 10^4$ to $1.2 \times 10^5$.

TABLE 21

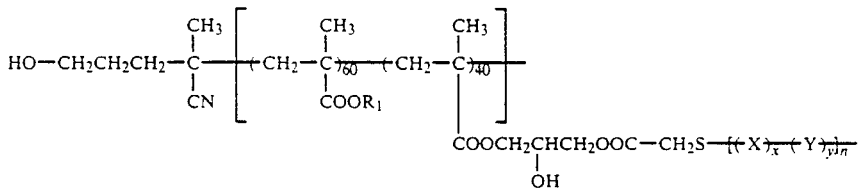

| Production Example of Resin (B) | Resin (B) | $R_1$ | X | x | Y | y |
|---|---|---|---|---|---|---|
| 96 | B-96 | $-C_2H_5$ | 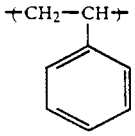 | 20 | 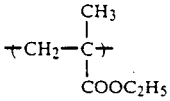 | 80 |
| 97 | B-97 | $-C_2H_5$ | 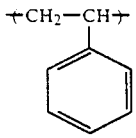 | 40 | 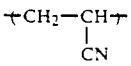 | 60 |

TABLE 21-continued
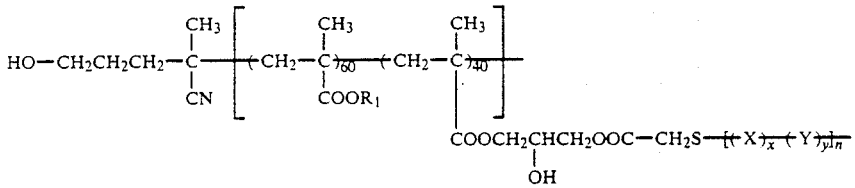
| Production Example of Resin (B) | Resin (B) | $R_1$ | X | x | Y | y |
|---|---|---|---|---|---|---|
| 98 | B-98 | $-C_2H_5$ | 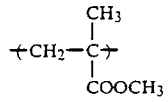 | 90 | 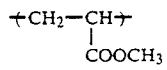 | 10 |
| 99 | B-99 | $-C_3H_7$ | 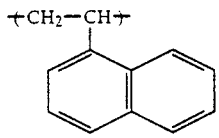 | 100 | — | 0 |
| 100 | B-100 | $-C_3H_7$ | 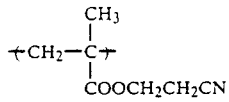 | 50 | 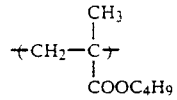 | 50 |
| 101 | B-101 | $-C_2H_5$ | 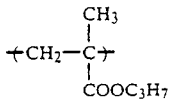 | 85 | 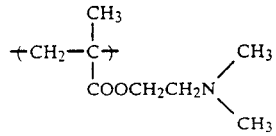 | 75 |
| 102 | B-102 | $-C_2H_5$ | 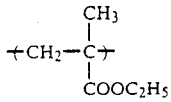 | 90 | 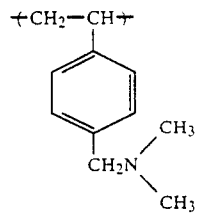 | 10 |
| 103 | B-103 | $-C_3H_7$ | 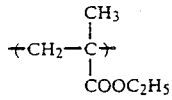 | 90 | 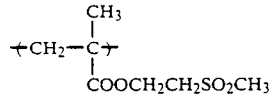 | 10 |
| 104 | B-104 | $-C_2H_5$ | 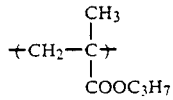 | 75 | 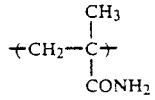 | 15 |
Production Examples 105 to 112 of Resin (B): B-105 to B-112
By following the similar procedure to Production Example 72 of Resin (B), each of the resins shown in table was produced.
The weight average molecular weights of the resins were in the range of from $9.5\times10^4$ to $1.1\times10^5$.

TABLE 22

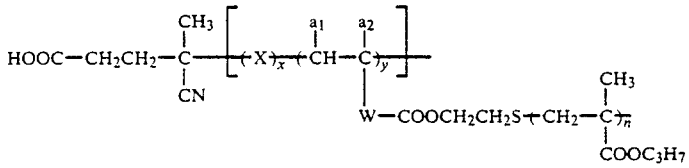

| Production Example of Resin (B) | Resin (B) | —X— | $a_1$ | $a_2$ | —W— | x/y (Weight Ratio) | Macro-monomer Used |
|---|---|---|---|---|---|---|---|
| 105 | B-105 | $-CH_2-C(CH_3)(COOC_2H_5)-$ | H | H | — | 80/20 | M-9 |
| 106 | B-106 | " | $CH_3-$ | H | — | 70/30 | M-10 |
| 107 | B-107 | $-CH_2-CH-$ (C6H5) | H | H | 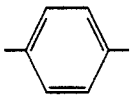 | 60/40 | M-11 |
| 108 | B-108 | $-CH_2-C(CH_3)(COOC_2H_5)-$ | H | H | $-COOCH_2CH_2-$ | 80/20 | M-12 |
| 109 | B-109 | $-CH_2-C(CH_3)(COOC_2H_5)-$ | H | $CH_3$ | $-COO(CH_2)_2OCO(CH_2)_2-$ | 80/20 | M-13 |
| 110 | B-110 | $-CH_2-C(CH_3)(COOCH_2C_6H_5)-$ | H | $CH_3$ | $-CONH(CH_2)_4-$ | 80/20 | M-14 |
| 111 | B-111 | $-CH_2-C(CH_3)(COOCH_3)-$ | H | H | 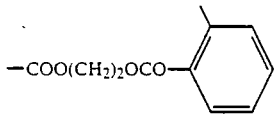 | 50/50 | M-15 |
| 112 | B-112 | $-CH_2-CH-$ (C6H5) | H | H | $-CH_2OCO(CH_2)_2-$ | 80/20 | M-17 |

EXAMPLE 1

A mixture of 6 g (as solid component) of Resin A-4 produced in Synthesis Example 4 of Resin (A), 34 g (as a solid content) of Resin B-1 produced in Production Example 1 of Resin (B), 200 g of zinc oxide, 0.018 g of the cyanine dye (A) having the structure shown below, 0.40 g of phthalic anhydride, and 300 g of toluene was dispersed in a ball mill for 3 hours to prepare a coating composition for a photoconductive layer. The composition was coated on a paper which had been subjected to a conductive treatment at a dry coating amount of 20 g/m$^2$ by a wire bar, dried for 30 seconds at 110° C., and allowed to stand for 24 hours in the dark under the condition of 20° C. and 65% RH to prepare an electrophotographic light-sensitive material.

Cyanine Dye (A):

-continued

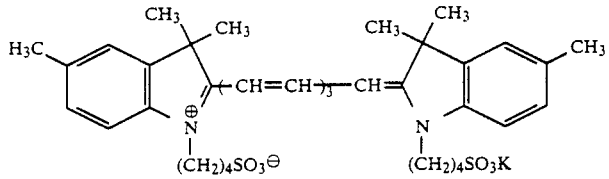

EXAMPLE 2

By following the same procedure as Example 1 except that 34 g of Resin B-16 was used in place of 34 g Resin B-1, an electrophotographic light-sensitive material was prepared.

Comparison Example A

By following the same procedure as Example 1 except that 40 g (as a solid content) of Resin A-1 only was used in place of Resin A-4 and Resin B-1, an electrophotographic light-sensitive material A was prepared.

Comparison Example B

By following the same procedure as Example 1 except that 40 g of Resin R-1 shown below was used alone as a binder resin, an electrophotographic light-sensitive material B was prepared.

Resin (R-1):

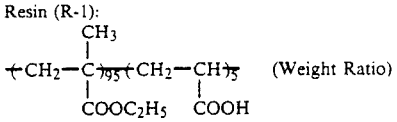

(Weight Ratio)

Weight average molecular weight: 6,500
Glass transition point: 40° C.

Comparison Example C

By following the same procedure as Example 1 except that 6 g of the aforesaid Resin R-1 and 34 g of the aforesaid Resin B-1 were used as binder resins, an electrophotographic light-sensitive material C was prepared.

Comparison Example D

By following the same procedure as Example 1 except that 40 g of Resin R-2 having the structure shown below was used as a binder resin, an electrophotographic light-sensitive material D was prepared.

Resin (R-2):

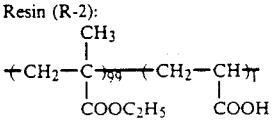

(Weight Ratio)

Weight average molecular weight: 4,500
Glass transition point: 40° C.

On each of the light-sensitive materials thus prepared, the coating property (surface smoothness), the film strength, the electrostatic characteristics and the image-forming performance under the condition of 20° C., 65% RH and the condition of 30° C., 80% RH were determined.

Furthermore, each of the light-sensitive materials was used as an offset printing master plate, and the oil desensitizing property of the photoconductive layer (shown by the contact angle between the photoconductive layer after being oil-desensitized and water) and the printing property (background stains, printing durability, etc.) in this case were also determined.

The results obtained are shown in Table 23 below.

TABLE 23

| | Example 1 | Example 2 | Comparison Example A | Comparison Example B | Comparison Example C | Comparison Example D |
|---|---|---|---|---|---|---|
| Surface Smoothness of Photoconductive Layer (sec/cc)*1) | 125 | 130 | 130 | 125 | 125 | 45 |
| Strength of Photoconductive Layer (%)*2) | 89 | 97 | 60 | 60 | 88 | 65 |
| Electrostatic Characteristics*3) | | | | | | |
| $V_{10}$ (−V) | | | | | | |
| I: (20° C., 65% RH) | 585 | 590 | 590 | 500 | 505 | |
| II: (30° C., 80% RH) | 570 | 585 | 585 | 485 | 500 | 230 |
| DRR (%) | | | | | | |
| I | 83 | 84 | 84 | 75 | 73 | 42 |
| II | 82 | 84 | 84 | 70 | 68 | 10 |
| $E_{1/10}$ (erg/cm$^2$) | | | | | | |
| I | 20 | 18 | 17 | 50 | 55 | 125 |
| II | 21 | 20 | 19 | 48 | 58 | 200 or more |
| Image Forming*4) Performance | | | | | | |
| I: | good | good | good | No good to Good (reduced Dmax) | No good to Good (reduced Dmax) | poor (no Dmax) |
| II: | good | good | good | No good (illegible fine lines) | No good (illegible fine lines) | Very poor (fine lines and letters disappeared) |
| Contact Angle*5) with Water (Degree) | 10° or less | 10° or less | 10° or less | 10° or less | 10° | 25 to 30° (widely varied) |

TABLE 23-continued

| | Example 1 | Example 2 | Comparison Example A | Comparison Example B | Comparison Example C | Comparison Example D |
|---|---|---|---|---|---|---|
| Printing Durability*6) | 8000 sheets | 10,000 sheets or more | 3,000 sheets | 3,000 sheets | 10,000 sheets or more | Stain occurred from the 1 st print |

The terms shown in Table 22 above were evaluated as follows.

1) Smoothness of Photoconductive layer

The smoothness (sec/cc) was measured using a Beck's smoothness tester (manufactured by Kumagaua Riko K.K.) under an air volume condition of 1 cc.

2) Mechanical Strength of Photoconductive Layer

The surface of the light-sensitive material was repeatedly rubbed 1000 times with emery paper (#1000) under a load of 50 g/cm$^2$ using a Heidon surface testing machine (manufactured by Shinto Kagaku K.K.). After dusting, the abrasion loss of the photoconductive layer was measured as film retention (%), which was employed as the mechanical strength.

3) Electrostatic Characteristics

Each sample was charged by applying corona discharging of −6 kV for 20 seconds in the dark at 20° C. and 65% RH using paper analyzer (Paper Analyzer SP-428, manufactured by Kawaguchi Denki K.K.), then allowed to stand for 10 seconds, and the surface potential $V_{10}$ in this case was measured. Then, the sample was allowed to stand for 180 seconds in the dark as it was and then the surface potential $V_{190}$ was measured. Thus, the dark decay retentivity (DRR %), i.e., the percent retention of potential after dark decaying for 180 seconds, was calculated by the following equation:

$$DRR\ (\%) = (V_{190}/V_{10}) \times 100(\%)$$

Also, after charging the surface of the photoconductive layer to 400 V by corona discharging, the surface was irradiated by monochromatic light having a wavelength of 780 nm, the time required for decaying the surface potential ($V_{10}$) to 1/10 was measured, and the exposure amount $E_{1/10}$ (erg/cm$^2$) was calculated from the value.

4) Image-Forming Performance

Each sample was allowed to stand a whole day and night under the surrounding condition of 20° C., 65% RH or 30° C., 80% RH. Then, each sample was charged to −5 kV, exposed to laser light emitted from a gallium-aluminum-arsenic semiconductor laser (oscillation wavelength of 750 nm) of an output of 2.8 mW under an exposure amount of 64 erg/cm$^2$ at a pitch of 25 μm and a scanning speed of 300 m/sec, developed using a liquid developer, ELP-T (trade name, made by Fuji Photo Film Co., Ltd.), and fixed. The reproduced images (fog and image quality) were visually evaluated.

5) Contact Angle with Water

Each sample was passed once through an etching processor using a de-sensitizing solution, ELP-EX (trade name, made by Fuji Photo Film Co., Ltd.) diluted with distilled water to twice the original volume to de-sensitize the surface of the photoconductive layer of the sample. On the thus de-sensitized surface was placed a drop of 2 μl of distilled water, and the contact angle between the surface and water was measured using a goniometer.

6) Printing Durability

Each sample was processed in the same manner as in 4) described above to form toner images thereon, and the surface of the photoconductive layer was desensitized by the same condition as in 5) described above. The sample thus processed was mounted on an offset printing machine (Oliver Model 52, manufactured by Sakurai Seisakusho K.K.) as an offset master and the number of prints obtained without causing background staining of the non-image portions of the print and any problems on the image quality of the imaged portions was determined. (The larger the number of the prints, the higher the printing durability.)

As shown in Table 22, the only sample in Comparison Example D using the conventionally known resin as the binder resin was greatly inferior in surface smoothness of the photoconductive layer and electrostatic characteristics.

When the environmental condition became severe (30° C., 80% RH), in the samples in Comparison Examples B and C, the electrostatic characteristics were deviated and reduced and, in particular, the dark decay retentivity (D.R.R.) for 180 seconds is greatly reduced. Thus, as to the practical image-forming performance by the scanning exposure, the image quality of the reproduced images was reduced.

The sample in Comparison Example A scarecely showed the changes of the electrostatic characteristics and the imaging property by the change of the environmental condition and further the electrostatic characteristics thereof at normal temperature and humidity condition (20° C., 65% RH) were excellent as compared to those of the sample in Comparison B, which showed the sample in Comparison Example A being very effective in a scanning exposure system by a semiconductor laser of low output.

In the sample in Comparison Example D, the film strength, the electrostatic characteristics, and the printing characteristics were not in the level of practical use.

On the other hand, the sample in the example of this invention had almost the same electrostatic characteristics and image-forming performance as those of the sample in Comparison Example A and further had a greatly improved film strength of the photoconductive layer.

When the sample of this invention is used as an offset master plate, the de sensitization by a de-sensitizing solution to the photoconductive layer is sufficiently applied and the surface thereof is sufficiently rendered hydrophilic such that the contact angle of the non-imaged portion with water is as low as less than 15 degree.

When printing was practically run, the staining of the prints was not observed. However, in the case of the sample in Comparison Example C, the testes for the strength of the photoconductive layer and the printing resistance (printing durability) shown that the film strength was insufficient and there was a problem in the durability thereof.

Also, in the electrophotographic light-sensitive material of this invention, the sample in Example 2 using the resin (B) having the polar group therein was superior in characteristics and the printing durability as offset master plate in film strength as compared to the sample of this invention in Example 1 although the latter sample might by excellent in the aforesaid points as compared to conventional light-sensitive materials.

From the aforesaid descriptions, it can be seen that the electrophotographic light-sensitive material of this invention is excellent in all the points of the surface smoothness and film strength of the photoconductive layer as well as the electrostatic characteristics and printing property.

Examples 3 to 22

By following the same procedure as Example 1 except that 6 g of each if the resins (A) shown in Table 24 below and 34 g of each of the resins (B) shown in the table were used in place of 6 g of Resin A-4 and 34 g of Resin B-1, respectively and also 0.018 g of the cyanine dye (B) shown below was used in place of 0.018 g of the cyanine dye (A), each of electrophotographic light-sensitive materials was prepared.

Cyanine Dye (B):

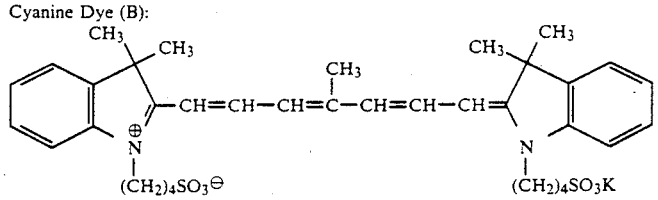

TABLE 24

| Example | Resin (A) | Resin (B) | Film strength (%) | Electrostatic Characteristics (30° C. 80% RH) $V_{10}$ (−V) | D.R.R. (%) | $E_{1/10}$ (erg/cm$^2$) | Printing Durability (number of Prints) |
|---|---|---|---|---|---|---|---|
| 3 | A-2 | B-2 | 90 | 560 | 80 | 30 | 8000 |
| 4 | A-3 | B-3 | 87 | 565 | 82 | 28 | 8000 |
| 5 | A-7 | B-3 | 90 | 550 | 81 | 23 | 8000 |
| 6 | A-8 | B-4 | 88 | 555 | 83 | 29 | 8000 |
| 7 | A-9 | B-5 | 93 | 565 | 83 | 24 | 8300 |
| 8 | A-11 | B-6 | 88 | 570 | 83 | 23 | 8000 |
| 9 | A-12 | B-8 | 96 | 550 | 79 | 33 | 10,000 or more |
| 10 | A-13 | B-10 | 97 | 555 | 80 | 25 | " |
| 11 | A-14 | B-11 | 98 | 550 | 79 | 28 | " |
| 12 | A-16 | B-12 | 93 | 560 | 80 | 29 | 8500 |
| 13 | A-17 | B-13 | 92 | 565 | 83 | 23 | 8500 |
| 14 | A-18 | B-14 | 96 | 550 | 79 | 28 | 10,000 or more |
| 15 | A-19 | B-16 | 98 | 550 | 80 | 27 | " |
| 16 | A-20 | B-17 | 98 | 545 | 78 | 33 | " |
| 17 | A-21 | B-18 | 98 | 560 | 81 | 29 | " |
| 18 | A-22 | B-20 | 98 | 550 | 79 | 30 | " |
| 19 | A-24 | B-21 | 98 | 545 | 78 | 29 | " |
| 20 | A-25 | B-25 | 92 | 550 | 80 | 30 | 8500 |
| 21 | A-4 | B-27 | 93 | 560 | 81 | 23 | 8500 |
| 22 | A-4 | B-35 | 97 | 565 | 80 | 24 | 10,000 or more |

As shown in Table 24 above, the light-sensitive material of this invention exhibited excellent results. Also, when the resin (B) contained a polymer component having an acid group or contained a terminal polar group, the printing durability was particularly improved.

Examples 23 to 36

By following the same procedure as Example 1 except that 6 g of each of the resins (A) shown in Table 25 below and 34 g of each of the resins (B) shown in the table were used in place of 6 g of the resin A-4 and 34 g of the resin B-1, respectively, the 0.016 g of the methine dye (C) shown below was used in place of 0.018 g of the cyanine dye (A), each of electrophotographic light-sensitive materials was prepared.

Methine Dye (C):

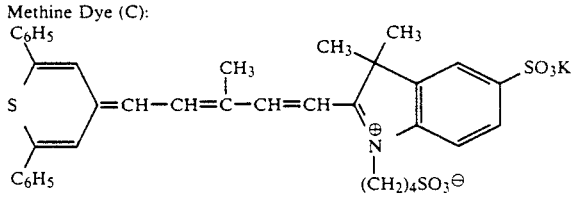

TABLE 25

| Example | Resin (A) | Resin (B) |
|---|---|---|
| 23 | A-4 | B-2 |
| 24 | A-5 | B-4 |
| 25 | A-6 | B-7 |
| 26 | A-8 | B-9 |
| 27 | A-11 | B-15 |

TABLE 25-continued

| Example | Resin (A) | Resin (B) |
|---|---|---|
| 28 | A-13 | B-16 |
| 29 | A-15 | B-19 |
| 30 | A-17 | B-22 |
| 31 | A-18 | B-23 |
| 32 | A-19 | B-24 |
| 33 | A-20 | B-28 |
| 34 | A-21 | B-30 |
| 35 | A-22 | B-32 |
| 36 | A-25 | B-37 |

Then, on each of the samples, the characteristics thereof were measured in the same manners as in Example 1. The surface smoothness and the film strength of each electrophotographic light-sensitive material were almost same as those of the sample in Example 1.

Each of the electrophotographic light-sensitive materials of this invention was excellent in charging property, dark charge retentivity, and light sensitivity and gave clear images having no background stains even under severe high-temperature high-humidity condition (30° C, 80% RH) in practical image reproduction.

Examples 37 to 40

A mixture of 6.5 g of each of the resins (A) shown in Table 26 below and 33.5 g of each of the resin (B) shown in the table as a binder resin, 200 g of zinc oxide, 0.05 g of Rose Bengale, 0.03 g of bromophenol Blue, 0.02 g of uranine, 0.3 g of phthalic anhydride and 240 g of toluene was dispersed in a ball mill for 3 hours. The composition prepared was coated on a paper which had been subjected to a conductive treatment by a wire bar at a dry coating amount of 20 g g/m$^2$ and heated to 110° C for 30 seconds. Then, the coated product was allowed to stand for 24 hours under a condition of 20° C and 65% RH to prepare each of electrophotographic light-sensitive materials.

TABLE 26

| Example | Resin (A) | Resin (B) | $V_{10}(-V)$ | D.R.R. (%) | $E_{1/10}$ (lux · sec) | Printing Durability (Number of Prints) |
|---|---|---|---|---|---|---|
| 37 | A-1 | B-1 | 560 | 88 | 11.2 | 8,000 |
| 38 | A-6 | B-22 | 550 | 84 | 11.8 | 10,000 or more |
| 39 | A-23 | B-31 | 545 | 84 | 10.9 | 8,500 |
| 40 | A-21 | B-34 | 575 | 92 | 8.3 | 10,000 or more |

Each of the electrophotographic light-sensitive materials of this invention was excellent in charging property, dark charge retentivity, and light sensitivity as well as gave clear images having no background stains even under severe conditions of high-temperature and high-humidity condition (30° C, 80% RH) in practical image reproduction.

Furthermore, when each of the samples was used as an offset master plate for printing, the number of prints having clear images shown in Table 26 above was obtained.

In the electrostatic characteristics shown in Table 26, the exposure amount $E_{1/10}$ (lux·sec) was obtained as follows. That is, the surface of the photoconductive layer was charged to −400 V by corona discharging, then, the surface thereof was exposed to visible light of 2.0 lux, the time required for decaying the surface potential ($V_{10}$) to 1/10 thereof, and the exposure amount was calculated therefrom.

Also, in making the printing plate from each electrophotographic light-sensitive material, toner images were formed by a full automatic printing plate making machine ELP 404V (made by Fuji Photo Film Co., Ltd.) using ELP-T as a toner.

EXAMPLE 41

A mixture of 6 g of the resin A-29 produced in Synthesis Example of Resin (A), 34 g of the resin B-57 produced in Production Example 57, 200 g of zinc oxide, 0.018 g of the cyanine dye (A) having the structure shown below, 0.30 g of phthalic anhydride, and 300 g of toluene was dispersed in a ball mill for 2 hours to prepare a coating composition for photoconductive layer. The composition was coated on a paper which has been subjected to a conductive treatment by a wire bar at a dry coating amount of 20 g/m$^2$ and dried for 30 seconds at 110° C. The coated sample was allowed to stand for 24 hours under a condition of 20° C, 65% RH to prepare an electrophotographic light-sensitive material.

Cyanine Dye (A):

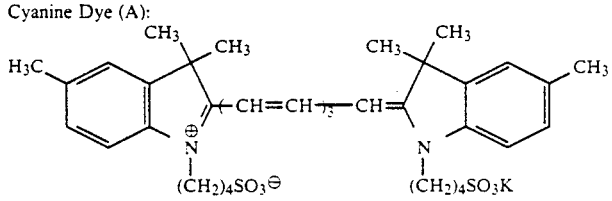

EXAMPLE 42

By following the same procedure as Example 41 except that 34 g of the resin B-72 produced in Production Example 72 was used in place of 34 g of the resin B-57, an electrophotographic light-sensitive material was prepared.

COMPARISON EXAMPLE E

By following the same procedure as Example 41 except that 40 g (as solid component) of the resin A-29 only was used in place of the resin A-29 and the resin B-57 as a binder resin, an electrophotographic light-sensitive material E was produced.

COMPARISON EXAMPLE F

By following the same procedure as Example 41 except that 40 g of the resin R-1 used in aforesaid Comparison Example B was used alone as a binder resin, an electrophotographic light-sensitive material was produced.

COMPARISON EXAMPLE G

By following the same procedure as Example 41 except that 6 g of the resin R-1 used in Comparison Example B and 34 g of the aforesaid resin B-57 were used as binder resins, an electrophotographic light-sensitive material was produced.

COMPARISON EXAMPLE H

By following the same procedure as Example 41 except that 40 g of the resin R-2 used in Comparison Example D was used as binder resin, an electrophotographic light-sensitive material was produced.

On each of the aforesaid electrophotographic light-sensitive material, the coating property (surface smoothness), the film strength, and the electrostatic characteristics and imaging property under environmental condition of 20° C. 65% RH or 30° C, 80% RH were determined by the same evaluation methods as in Example 2.

Furthermore, each sample was used as an offset master plate and the oil-desensitizing property of the photoconductive layer (shown by the contact angle between the oil-desensitized photoconductive layer and water) and the printing property (background stains, printing durability, etc.) were determined in the same manners as in Example 2.

The results obtained are shown in Table 26 below.

TABLE 26

| | Example 41 | Example 42 | Comparison Example E | Comparison Example F | Comparison Example G | Comparison Example H |
|---|---|---|---|---|---|---|
| Surface Smoothness of Photoconductive Layer (sec/cc)*1) | — | — | — | — | — | — |
| Strength of Photoconductive Layer (%)*2) | 88 | 97 | 65 | 60 | 95 | 65 |
| Electrostatic Characteristics*3) | | | | | | |
| $V_{10}$ (−V) | | | | | | |
| I: (20° C., 65% RH) | 575 | 575 | 580 | 520 | 510 | 500 |
| II: (30° C., 80% RH) | 570 | 575 | 580 | 425 | 425 | 230 |
| DRR (%) | | | | | | |
| I | 83 | 84 | 85 | 78 | 75 | 45 |
| II | 80 | 83 | 85 | 70 | 68 | 10 |
| $E_{1/10}$ (erg/cm$^2$) | | | | | | |
| I | 22 | 21 | 20 | 48 | 50 | 195 |
| II | 23 | 21 | 20 | 40 | 41 | 200 or more |
| Image Forming*4) Performance | | | | | | |
| I: (20° C., 65%) | good | good | good | No good to Good (reduced Dmax) | No good to Good (reduced Dmax) | poor (no Dmax) |
| II: (30° C., 80%) | good | good | good | No good (illegible fine lines) | No good (illegible fine lines) | Very poor (fine lines and letters disappeared) |
| Contact Angle*5) with Water (Degree) | 10° or less | 10° or less | 10° or less | 10° or less | 10° | 25 to 30° (widely varied) |
| Printing Durability*6) | 8000 sheets | 10,000 sheets or more | 1,000 sheets | 1,000 sheets | 8,000 sheets | Stain occurred from the 1 st print |

*1)–*6)Same as the evaluations in Table 22.

As shown in Table 26 above, the sample only in Comparison Example H using the conventionally known resin showed the greatly reduced surface smoothness of the photoconductive layer and electrostatic characteristics.

Under severe environmental condition (30° C, 80% RH), in the samples in Comparison Examples F and G, the electrostatic characteristics were deviated and reduced, and in particular, the dark charge retentivity (D.R.R.) for 120 seconds was greatly reduced. Thus, at the practical imaging by scanning exposure, the image quality of reproduced images was reduced.

The sample in Comparison Example E scarcely showed the change of the electrostatic characteristics and imaging property by the change of the environmental condition different from the samples in Comparison Examples F and G and further the electrostatic characteristics thereof at the normal condition (20° C, 60% RH) were superior to the sample in Comparison Example F, which showed that the sample was very effective in a scanning exposure system by a semiconductor laser of low output.

The sample in the example of this invention showed almost same electrostatic characteristics and imaging property as those of the sample in Comparison Example E and further showed the greatly improved film strength of the photoconductive layer.

Also, when the sample of this invention was used as an offset master plate, the photoconductive layer was sufficiently oil-desensitized by an oil-desensitizing solution. That is, the contact angle between the nonimage portion of the desensitized photoconductive layer and water was lower than 10 degree, which showed that the surface thereof was sufficiently rendered hydrophilic. At practical printing using the master plate, no background stains of prints were observed. On the other hand, in the case of the sample in Comparison Example E, the film strength of the photoconductive layer in the film-strength test on photoconductive layer and the durability test was insufficient. That is, the comparison sample had a problem in durability.

Furthermore, the film strength of the sample of Example 42 of this invention using the resin (B) having the polar group (i.e., resin (B') was better than the sample in Example 41 of this invention in printing durability (number of prints) as an offset master plate.

The sample in Comparison Example H was not in a practically usable level in the film strength, electrostatic characteristics, and printing characteristics.

As described above, it can be seen that the only sample of this invention was excellent in all the points of surface smoothness of photoconductive layer, film strength, electrostatic characteristics, and printing characteristics.

EXAMPLES 43 TO 62

By following the same procedure as Example 41 except that 6 g of each of the resins (A) shown in Table 27 below and 34 g of each of the resins (B) shown in the sample table were used in place of 6 g of the resin A-29 and 34 g of the resin B-57, respectively, and also 0.018 g of the cyanine dye (B) having the structure shown below was used in place of 0.018 g of the cyanine dye (A), each of electrophotographic light-sensitive materials was produced.

Cyanine Dye (B):

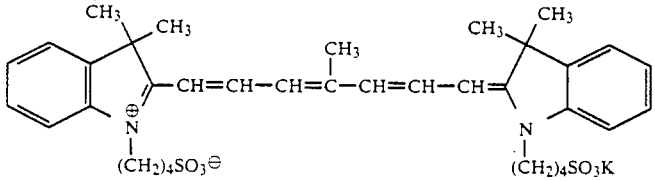

TABLE 27

| Example | Resin (A) | Resin (B) | Film strength (%) | Electrostatic Characteristics (30° C. 80% RH) $V_{10}$ (−V) | D.R.R. (%) | $E_{1/10}$ (erg/cm$^2$) | Printing Durability (number of Prints) |
|---|---|---|---|---|---|---|---|
| 43 | A-27 | B-58 | 88 | 555 | 82 | 25 | 8000 |
| 44 | A-28 | B-59 | 88 | 545 | 80 | 33 | 8000 |
| 45 | A-29 | B-60 | 88 | 585 | 85 | 22 | 8000 |
| 46 | A-33 | B-61 | 89 | 555 | 82 | 26 | 8000 |
| 47 | A-34 | B-62 | 87 | 550 | 81 | 26 | 8000 |
| 48 | A-35 | B-63 | 89 | 585 | 85 | 22 | 8000 |
| 49 | A-37 | B-64 | 97 | 575 | 84 | 23 | 10000 or more |
| 50 | A-38 | B-65 | 92 | 550 | 80 | 31 | 8500 |
| 51 | A-39 | B-66 | 97 | 550 | 80 | 26 | 10000 or more |
| 52 | A-40 | B-70 | 97 | 545 | 79 | 34 | 10000 or more |
| 53 | A-41 | B-71 | 93 | 565 | 83 | 22 | 8500 |
| 54 | A-42 | B-72 | 98 | 560 | 83 | 26 | 10000 or more |
| 55 | A-43 | B-74 | 97 | 570 | 84 | 23 | 10000 or more |
| 56 | A-44 | B-75 | 97 | 545 | 80 | 26 | 10000 or more |
| 57 | A-45 | B-81 | 91 | 550 | 82 | 25 | 8500 |
| 58 | A-46 | B-83 | 90 | 545 | 80 | 28 | 8500 |
| 59 | A-47 | B-85 | 92 | 575 | 84 | 22 | 8500 |
| 60 | A-48 | B-88 | 98 | 555 | 79 | 30 | 10000 or more |
| 61 | A-37 | B-91 | 96 | 575 | 84 | 24 | 10000 or more |
| 62 | A-43 | B-95 | 97 | 565 | 83 | 22 | 10000 or more |

EXAMPLES 63 TO 76

By following the same procedure as Example 41 except that 6 g of each of the resins(A) shown in Table 28 below and 34 g of each of the resins (B) shown in the sample table were used in place of 6 g of the resin A-29 and 34 g of the resin B-57, respectively, and also 0.016 g of the methine dye (C) having the structure shown below was used in place of 0.018 g of the cyanine dye (A), each of electrophotographic light-sensitive materials was produced.

Methine Dye (C):

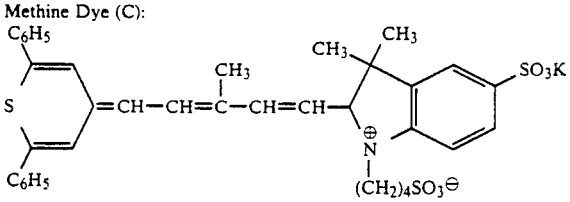

TABLE 28

| Example No. | Resin (A) | Resin (B) |
|---|---|---|
| 63 | A-28 | B-65 |
| 64 | A-39 | B-66 |
| 65 | A-45 | B-67 |
| 66 | A-46 | B-77 |
| 67 | A-29 | B-79 |
| 68 | A-31 | B-80 |
| 69 | A-31 | B-86 |
| 70 | A-32 | B-96 |
| 71 | A-32 | B-97 |
| 72 | A-34 | B-99 |
| 73 | A-43 | B-100 |
| 74 | A-44 | B-101 |
| 75 | A-48 | B-103 |
| 76 | A-49 | B-104 |

Then, on each of the samples, the characteristics were determined in the same manners as in Example 41. The surface smoothness and the film strength of each sample were substantially the same as those of the sample in Example 41.

Furthermore, each of the electrophotographic light-sensitive materials thus produced were excellent in the charging property, dark charge retensitivity, and light sensitivity and gave clear images having no background stains even under severe environmental condition (3° C, 80% RH) at practical image reproduction.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having formed thereon a photoconductive layer containing at least inorganic photoconductive particles and a binder resin, wherein the binder resin comprises at least one kind of a resin (A) shown below and at least one kind of a resin (B) shown below:

Resin (A):

A copolymer having a weight average molecular weight of from $1\times10^3$ to $2.0\times10^4$ containing at least one of polyester type macromonomers each having a weight average molecular weight of from $1.0\times10^3$ to $1.5\times10^4$ represented by the following formula (I), (II), (III), or (IV);

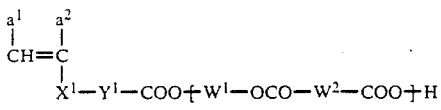

(I)

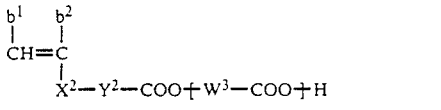

(II)

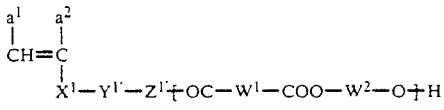

(III)

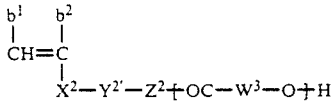

(IV)

wherein the bracketed terms each represents a recurring unit; $a^1$ and $a^2$, which may be the same or different, each represents a hydrogen atom, a halogen atom, a cyano group, a hydrocarbon group having from 1 to 8 carbon atoms, —COOZ, or —COOZ bonded via a hydrocarbon group having from 1 to 8 carbon atoms (wherein Z represents a hydrocarbon group having from 1 to 18 carbon atoms); $X^1$ represents a direct bond or, —COO—, —OCO—, $-(CH_2)_{l_1}COO-$, $-(CH_2)_{l_2}OCO-$ (wherein $l_1$ and $l_2$ each represents an integer of from 1 to 3),

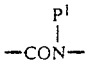

(wherein $P^1$ represents a hydrogen atom or a hydrocarbon group having from 1 to 12 carbon atoms), —CONHCONH—, —CONHCOO—, —O—,

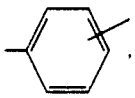

or $—SO_2—$; $Y^1$ represents a group bonding $X^1$ to —COO—; $Y^2$ represents a group bonding $X^2$ to —COO—; $Y^{1'}$ represents a group bonding $X^1$ to $Z^1$; $Y^{2'}$ represents a group bonding $X^2$ to $Z^2$; $Z^1$ represents $—CH_2—$, —O—, or —NH—; $W^1$ and $W^2$, which may be the same or different, each represents a divalent aliphatic group, a divalent aromatic group (each group may have at least one bonding group selected from —O—, —S—,

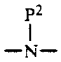

(wherein $P^2$ represents a hydrogen atom or a hydrocarbon group having from 1 to 12 carbon atoms), $—SO_2—$, —COO—, —OCO—, —CONHCO—, —NHCONH—,

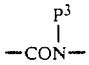

(wherein $P^3$ has the same meaning as $P^2$),

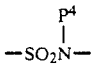

(wherein $P^4$ has the same meaning as $P^2$), and

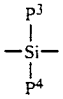

(wherein $P^3$ and $P^4$ are as defined above) in the bond or the divalent organic residue thereof); $b^1$ and $b^2$ have the same meaning as $a^1$ and $a^2$; $X^2$ has the same meaning as $X^1$; and $W^3$ represents a divalent aliphatic group;

Resin (B)

A resin which is a copolymer comprising (1) at least a mono-functional macromonomer having a weight average molecular weight of not more than $2\times10^4$, containing at least one of the polymer components shown by the following formulae (VIa) and (VIb), and having a polymerizable double bond group represented by following formula (V) bonded to only one terminal of the polymer main chain thereof, and (2) a monomer represented by the following formula (VII);

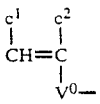

(V)

wherein $V^0$ represents —COO—, —OCO—, $—CH_2OCO—$, $—CH_2CO—$, —O—, $—SO_2—$, —CO—, —CONHCOO—, —CONHCONH—, $—CONHSO_2—$,

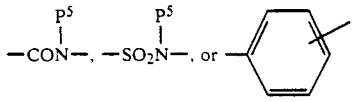

(wherein $P^5$ represents a hydrogen atom or a hydrocarbon group) and $c^1$ and $c^2$, which may be the same or different, each represents a hydrogen atom, a halogen atom, a cyano group, a hydrocarbon group, —COOZ', or —COOZ' bonded via a hydrocarbon group (wherein Z' represents a hydrogen atom or a hydrocarbon group which may be substituted);

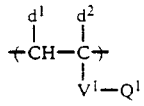

(VIa)

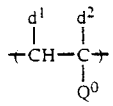

(VIb)

wherein $V^1$ has the same meaning as $V^0$ in formula (V) described above; $Q^1$ represents an aliphatic group having from 1 to 18 carbon atoms or an aromatic group having from 6 to 12 carbon atoms; $d^1$ and $d^2$, which may be the same or different, have the same meaning as $c^1$ and $c^2$ in formula (V); and $Q^0$ represents —CN, —$CONH_2$, or

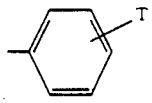

(wherein T represents a hydrogen atom, a hydrocarbon group, an alkoxy group, or —COOZ'' (wherein Z'' represents an alkyl group, an aralkyl group, or an aryl group));

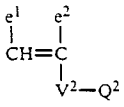

(VII)

wherein $V^2$ has the same meaning as $V^1$ in formula (VIa); $Q^2$ has the same meaning as $Q^1$ in formula (VIa); and $e^1$ and $e^2$, which may be the same or different, have the same meaning as $c^1$ and $c^2$ in formula (V).

2. The electrophotographic light-sensitive material as in claim 1, wherein the copolymer in the resin (A) is a graft copolymer having at least one polar group selected from —$PO_3H_2$, —$SO_3H$, —COOH, —OH, and

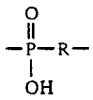

(wherein R represents a hydrocarbon group or —$OR^0$ (wherein $R^0$ represents a hydrocarbon group)) bonded to one terminal of the main chain of the graft polymer.

3. The electrophotographic light-sensitive material as in claim 1, wherein the copolymer in the resin (B) has at least one polar group selected from —$PO_3H_2$, —$SO_3H$, —COOH, —OH, —SH, and

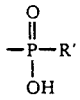

(wherein R' has the same meaning as R) bonded to one terminal of the main chain of the copolymer.

4. The electrophotographic light-sensitive material as in claim 1, wherein said polyester type macromonomer copolymer component contained in resin (A) comprises from 1 to 80% by weight of resin (A).

5. The electrophotographic light-sensitive material as in claim 1, wherein said resin (A) further contains, as a copolymer component, a monomer represented by the general formula (VIII):

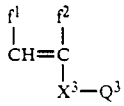

(VIII)

wherein $f^1$ and $f^2$ have the same meaning as $a^1$ and $a^2$ defined in claim 1;

$X^3$ represents —COO—, —OCO— or —O—; and $Q^3$ represents a hydrocarbon group having from 1 to 18 carbon atoms.

6. The electrophotographic light-sensitive material as in claim 1, wherein said resin (B) has a weight average molecular weight of from $5\times10^4$ to $3\times10^5$.

7. The electrophotographic light-sensitive material as in claim 1, wherein said macromonomer in resin (B) has a weight average molecular weight of from $1\times10^3$ to $2\times10^4$.

8. The electrophotographic light-sensitive material as in claim 1, wherein the content of the copolymer component composed of the macromonomer in said resin (B) is from 1 to 80% by weight.

* * * * *